US009419391B2

(12) United States Patent
Bolouri-Saransar et al.

(10) Patent No.: US 9,419,391 B2
(45) **Date of Patent: *Aug. 16, 2016**

(54) COMMUNICATION CONNECTOR

(71) Applicant: Panduit Corp., Tinley Park, IL (US)

(72) Inventors: Masud Bolouri-Saransar, Orland Park, IL (US); Surendra Chitti Babu, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 14 days.

This patent is subject to a terminal disclaimer.

(21) Appl. No.: 14/463,145

(22) Filed: Aug. 19, 2014

(65) Prior Publication Data

US 2015/0056824 A1 Feb. 26, 2015

Related U.S. Application Data

(60) Provisional application No. 61/867,827, filed on Aug. 20, 2013, provisional application No. 61/869,886, filed on Aug. 26, 2013, provisional application No. 61/870,470, filed on Aug. 27, 2013.

(51) Int. Cl.

| | |
|---|---|
| ***H01R 24/00*** | (2011.01) |
| ***H01R 24/64*** | (2011.01) |
| ***H01R 4/24*** | (2006.01) |
| ***H01R 13/648*** | (2006.01) |
| ***H01R 13/66*** | (2006.01) |
| ***H01R 27/00*** | (2006.01) |
| ***H01R 29/00*** | (2006.01) |
| *H01R 107/00* | (2006.01) |

(52) U.S. Cl.

CPC ..... *H01R 24/64* (2013.01); *H01R 4/24* (2013.01); *H01R 13/648* (2013.01); *H01R 13/6658* (2013.01); *H01R 27/00* (2013.01); *H01R 29/00* (2013.01); *H01R 2107/00* (2013.01)

(58) Field of Classification Search

CPC ..... H01R 23/02; H01R 27/00; H01R 29/00

USPC ..... 439/344, 620.11, 620.17, 620.21, 439/620.22, 620.23, 668, 676

See application file for complete search history.

(56) References Cited

U.S. PATENT DOCUMENTS

| | | | |
|---|---|---|---|
| 4,618,207 | A | 10/1986 | Silbernagel |
| 5,387,135 | A | 2/1995 | Shen et al. |
| 5,647,767 | A | 7/1997 | Scheer et al. |
| 5,772,466 | A | 6/1998 | Morin et al. |

(Continued)

FOREIGN PATENT DOCUMENTS

| | | |
|---|---|---|
| WO | WO2013052436 A2 | 4/2013 |

*Primary Examiner* — Briggitte R Hammond
*Assistant Examiner* — Milagros Jeancharles
(74) *Attorney, Agent, or Firm* — Christopher S. Clancy; James H. Williams; Yuri Astvatsaturov

(57) ABSTRACT

Embodiments of the present invention are generally related to communication connectors, and more specifically, to communication connectors such as jacks which are compatible with more than one style of a plug. In one embodiment, the electrical and mechanical design of a jack in accordance with the present invention may extend the usable bandwidth beyond the IEC 60603-7-71 requirement of 1000 MHz to support potential future applications such as, but not limited to, 40GBASE-T. In addition, the jack may be backwards compatible with lower speed BASE-T applications (e.g., 10GBASE-T and/or below) when an RJ45 plug is mated to the jack.

22 Claims, 54 Drawing Sheets

(56) References Cited

U.S. PATENT DOCUMENTS

| | | | |
|---|---|---|---|
| 6,056,568 | A | 5/2000 | Arnett |
| 6,059,578 | A | 5/2000 | Arnett |
| 6,079,996 | A | 6/2000 | Arnett |
| 6,156,981 | A | 12/2000 | Ward et al. |
| 6,159,039 | A | 12/2000 | Wu |
| 6,162,077 | A | 12/2000 | Laes et al. |
| 6,193,533 | B1 | 2/2001 | De Win et al. |
| 6,244,907 | B1 | 6/2001 | Arnett |
| 6,244,908 | B1 | 6/2001 | Hammond et al. |
| 6,276,943 | B1 | 8/2001 | Boutros et al. |
| 6,283,786 | B1 | 9/2001 | Margulis et al. |
| 6,302,741 | B1 | 10/2001 | Fasold et al. |
| 6,358,093 | B1 | 3/2002 | Phommachanh et al. |
| 6,371,793 | B1 * | 4/2002 | Doorhy ..... H01R 13/6469 439/404 |
| 6,394,853 | B1 | 5/2002 | Hammond et al. |
| 6,478,610 | B1 | 11/2002 | Zhou et al. |
| 6,482,039 | B2 | 11/2002 | Phommachanh et al. |
| 6,537,110 | B1 | 3/2003 | Korsunsky et al. |
| 6,540,564 | B1 | 4/2003 | Ko |
| 6,568,966 | B1 | 5/2003 | Korsunsky et al. |
| 6,623,307 | B2 | 9/2003 | Korsunsky et al. |
| 6,638,121 | B1 | 10/2003 | Walker et al. |
| 6,663,437 | B2 | 12/2003 | Korsunsky et al. |
| 6,682,365 | B1 | 1/2004 | Walker et al. |
| 6,688,909 | B1 | 2/2004 | Espenshade et al. |
| 6,699,065 | B1 | 3/2004 | Espenshade et al. |
| 6,709,295 | B2 | 3/2004 | Givens et al. |
| 6,736,681 | B2 | 5/2004 | Arnett |
| 6,739,912 | B2 | 5/2004 | Korsunsky et al. |
| 6,796,806 | B2 | 9/2004 | Boutros et al. |
| 6,835,092 | B2 | 12/2004 | Wan et al. |
| 6,890,197 | B2 | 5/2005 | Liebenow et al. |
| 6,896,553 | B2 | 5/2005 | Espenshade et al. |
| 6,945,820 | B1 | 9/2005 | Blichasz et al. |
| 6,957,982 | B1 | 10/2005 | Hyland et al. |
| 7,025,635 | B2 | 4/2006 | Chang |
| 7,048,550 | B2 | 5/2006 | Hyland et al. |
| 7,074,083 | B2 | 7/2006 | Hyland |
| 7,083,468 | B2 | 8/2006 | Walker et al. |
| 7,090,542 | B2 | 8/2006 | Zheng et al. |
| 7,241,157 | B2 | 7/2007 | Zhuang et al. |
| 7,255,567 | B1 | 8/2007 | Liao |
| 7,517,254 | B2 | 4/2009 | Zhang et al. |
| 7,658,648 | B2 | 2/2010 | Aekins |
| 7,670,183 | B2 | 3/2010 | Huang et al. |
| 7,674,136 | B2 | 3/2010 | Steinke et al. |
| 7,686,650 | B2 | 3/2010 | Belopolsky et al. |
| 7,736,176 | B2 | 6/2010 | Zhang et al. |
| 7,775,828 | B2 | 8/2010 | Zhang |
| 7,785,135 | B2 | 8/2010 | Wu |
| 7,798,866 | B2 | 9/2010 | Hetzer et al. |
| 7,980,882 | B2 | 7/2011 | Hetzer et al. |
| 7,985,101 | B2 | 7/2011 | Fitzpatrick et al. |
| 8,083,551 | B2 | 12/2011 | Hetzer et al. |
| 8,100,701 | B2 | 1/2012 | Gerber et al. |
| 8,182,294 | B2 | 5/2012 | Martich et al. |
| 8,277,252 | B2 | 10/2012 | Fogg et al. |
| 8,376,787 | B2 | 2/2013 | Panella et al. |
| 8,435,083 | B2 | 5/2013 | Hetzer et al. |
| 8,545,267 | B2 | 10/2013 | Fogg et al. |
| 8,545,268 | B2 | 10/2013 | Fogg et al. |
| 8,650,750 | B2 | 2/2014 | Engels et al. |
| 8,758,047 | B2 | 6/2014 | Dietz et al. |
| 8,758,065 | B2 | 6/2014 | Fransen et al. |
| 2007/0270044 | A1 | 11/2007 | Belopolsky et al. |
| 2009/0142968 | A1 | 6/2009 | Goodrich et al. |
| 2009/0186532 | A1 | 7/2009 | Goodrich et al. |
| 2013/0090011 | A1 | 4/2013 | Bolouri-Saransar et al. |
| 2014/0273570 | A1 | 9/2014 | Fransen et al. |

* cited by examiner

COMMUNICATION CONNECTOR

CROSS-REFERENCE TO RELATED APPLICATIONS

This application claims the benefit of U.S. Provisional Patent Application No. 61/867,827, filed on Aug. 20, 2013; U.S. Provisional Patent Application No. 61/869,886, filed on Aug. 26, 2013; and U.S. Provisional Patent Application No. 61/870,470, filed on Aug. 27, 2013, all of which are incorporated herein by reference in their entirety.

FIELD OF INVENTION

Embodiments of the present invention are generally related to communication connectors, and more specifically, to communication connectors such as jacks which are compatible with more than one style of a plug.

BACKGROUND

The fastest communication data rate currently specified by the Institute of Electrical and Electronics Engineers (IEEE) over structured copper cabling is 10 gigabit/second (Gbps) per the IEEE802.3ba standard. The structured cabling infrastructure called out in this standard is based on twisted pair cabling and RJ45 connectivity which calls for plugs and jacks having four pairs of corresponding contacts arranged in a generally parallel 1-8 in-line fashion with one of the pairs split around the center pair. This type of structured copper cabling specified by the IEEE includes four balanced differential pairs over which Ethernet communication takes place. Compliant channels will also meet the TIA568 Category 6A (CAT6A) specifications for cable, connectors, and channels. These CAT6A components and channels provide 500 MHz of bandwidth for data communication across 100 meter links.

In 2010, the IEEE ratified a new standard, IEEE802.3an, for high speed Ethernet communication at speeds of 40 Gbps and 100 Gbps. While this new standard called for both fiber and copper media, the only supported copper media was a short (7 m) twin-ax based copper cable assembly. No provisions were made for twisted pair structured copper links. Additionally, the proposed standard includes a specification that has Medium Dependent Interface (MDI) components such as magnetics and printed circuit board (PCB) traces. This PHY (Physical Layer Transceiver) to PHY specification creates a challenging task for designers.

Traditionally, copper connectivity has been associated with a number of benefits including lower cost, ease of field terminability, and ease of mateability between corresponding connectors. This has prompted the investigation of the feasibility of transmitting 40 Gbps over a structured copper channel. One approach to this is detailed in the International Electrotechnical Commission (IEC) 60603-7-71 standard, which incorporates two "modes" of operation to allow for backward compatibility with RJ45 style plugs and a higher bandwidth style plug, sometimes referred to as "ARJ45", with 4 pairs of contacts isolated in "quadrants." When mated with an RJ45 plug, the connector must provide the necessary electrical crosstalk compensation to comply with the RJ45 rated standard such as CAT6A. When mated with an IEC 60603-7-71 plug, the connector must provide the corresponding isolated contact locations.

This dual-mode functionality is achieved by sharing the two outermost pairs of RJ45 contacts, while also grounding the middle two pairs of RJ45 contacts and providing two new pairs of isolated contacts in case of mating with an IEC 60603-7-71 plug. In total there are six pairs of contacts in the connector, of which only four are used depending on which style plug the connector is mated with.

The presence of the extra pairs and the mechanical operation of the connector results in a challenging electrical design due to the potential parasitic coupling between unused contacts and/or unwanted compensation circuitry. Thus, there exists a continued need for further development and advancement of communication connectors, including PCB-mounted versions, which may allow for increased transfer rates while retaining backward compatibility with the RJ45 standard. Furthermore, since communication connectors are often used in systems which incorporate adjacent connector configurations, there is a continuing need for improved system designs which improve system performance, increase the ease of manufacturability, and provide robust electrical mating points.

SUMMARY

Accordingly, at least some embodiments of the present invention are directed towards communication jacks which are compatible with more than one type of a plug.

Furthermore, at least some other embodiments of the present invention are directed towards communication systems which incorporate multiple communication jacks, methods of use of said systems, and components thereof.

In an embodiment, a jack according to the present invention is a PCB-mounted jack.

In another embodiment, the electrical and mechanical design of a jack in accordance with the present invention may extend the usable bandwidth beyond the IEC 60603-7-71 requirement of 1000 MHz to support potential future applications such as, but not limited to, 40GBASE-T. In addition, the jack may be backwards compatible with lower speed BASE-T applications (e.g., 10GBASE-T and/or below) when an RJ45 plug is mated to the jack.

In yet another embodiment, the present invention is a communication jack capable of mating with either one of a first type of a communication plug and a second type of a communication plug, the first type and second type of a communication plug being different. The communication jack includes a housing having a front portion, the front portion including an aperture for receiving the either one of the first type of a communication plug and the second type of a communication plug. The communication jack also includes a first set of plug interface contacts (PICs) configured to interface the first type of a communication plug, and a second set of PICs configured to interface the second type of a communication plug. The communication jack also includes jack contacts, the jack contacts being one of insulation displacement contacts (IDCs) and connector pin contacts. And the communication jack also includes a printed circuit board (PCB), the PCB being movable between a first position and a second position along a longitudinal plane relative to the communication jack, the first position providing a first electrical path from the first set of PICs to the jack contacts, and the second position providing a second electrical path from the second set of PICs to the jack contacts, the PCB being positioned at the first position when mated with the first type of a communication plug, and the PCB being positioned at the second position when mated with the second type of a communication plug.

In still yet another embodiment, the present invention is a communication jack capable of mating with either one of a first type of a communication plug and a second type of a communication plug, the first type and second type of a communication plug being different. The communication jack includes a housing having a front portion, the front portion including an aperture for receiving the either one of the first type of a communication plug and the second type of a communication plug. The communication jack also includes a first set of PICs configured to interface the first type of a communication plug, and a second set of PICs configured to interface the second type of a communication plug. The communication jack also includes IDCs. And the communication jack also includes a PCB having a top surface and a bottom surface, some of the IDCs interfacing the PCB on the top surface and some of the IDCs interfacing the PCB on the bottom surface, the PCB being movable between a first position and a second position, the first position providing a first electrical path from the first set of PICs to the IDCs, and the second position providing a second electrical path from the second set of PICs to the IDCs.

In still yet another embodiment, the present invention is a duplex communication jack having a housing with a first and a second aperture. The first aperture is made to receive multiple styles of plugs and includes an associated set of first jack components, and the second aperture is made to receive multiple styles of plugs and includes an associated set of second jack components. The first jack components include a first set of lower PICs, a first set of upper PICs, a first PCB, and a first set of connector pins. The second jack components include a second set of lower PICs, a second set of upper PICs, a second PCB, and a second set of connector pins. Each of the first and second PCBs have a first and second circuit, wherein the each of the circuits can be positioned between respective PICs and connector pins depending on the style of plug received within a respective aperture.

In still yet another embodiment, the present invention is a duplex communication jack having a housing with a first and a second aperture. The first aperture is made to receive multiple styles of plugs and includes an associated set of first jack components, and the second aperture is made to receive multiple styles of plugs and includes an associated set of second jack components. The first jack components include a first set of lower PICs, a first set of upper PICs, a first PCB, and a first set of connector pins. The second jack components include a second set of lower PICs, a second set of upper PICs, a second PCB, and a second set of connector pins. The first PCB is positioned over the second PCB where the first PCB is longer than the second PCB such that the first set of connector pins is positioned behind the second set of connector pins.

In still yet another embodiment, the present invention is a duplex communication jack having a housing with a first and a second aperture. The first aperture is made to receive multiple styles of plugs and includes an associated set of first jack components, and the second aperture is made to receive multiple styles of plugs and includes an associated set of second jack components. The first jack components include a first set of lower PICs, a first set of upper PICs, a first PCB, and a first set of connector pins being positioned normally with respect to the first PCB for at least a portion thereof. The second jack components include a second set of lower PICs, a second set of upper PICs, a second PCB positioned at least partially under the first PCB, and a second set of connector pins being positioned normally with respect to the second PCB for at least a portion thereof.

These and other features, aspects, and advantages of the present invention will become better-understood with reference to the following drawings, description, and any claims that may follow.

DETAILED DESCRIPTION

In an embodiment, the present invention is a network jack capable of supporting two different modes of operation depending on the type of a plug that is inserted. In this embodiment, the jack can be mated with an RJ45 plug to operate at some network speeds (e.g., up to 10GBASE-T); and the same jack can be mated with an IEC 60603-7-71 style plug (hereinafter referred to as an "ARJ45 plug") for higher speed applications (e.g., 40GBASE-T). Note that while references are made to an IEC 60603-7-71 plug, jacks according to the present invention are not limited to use with only those plugs, and instead may be used with other plugs which are commonly referred to in the telecommunication art as ARJ45 plugs or GG45 plugs.

Figure 1:
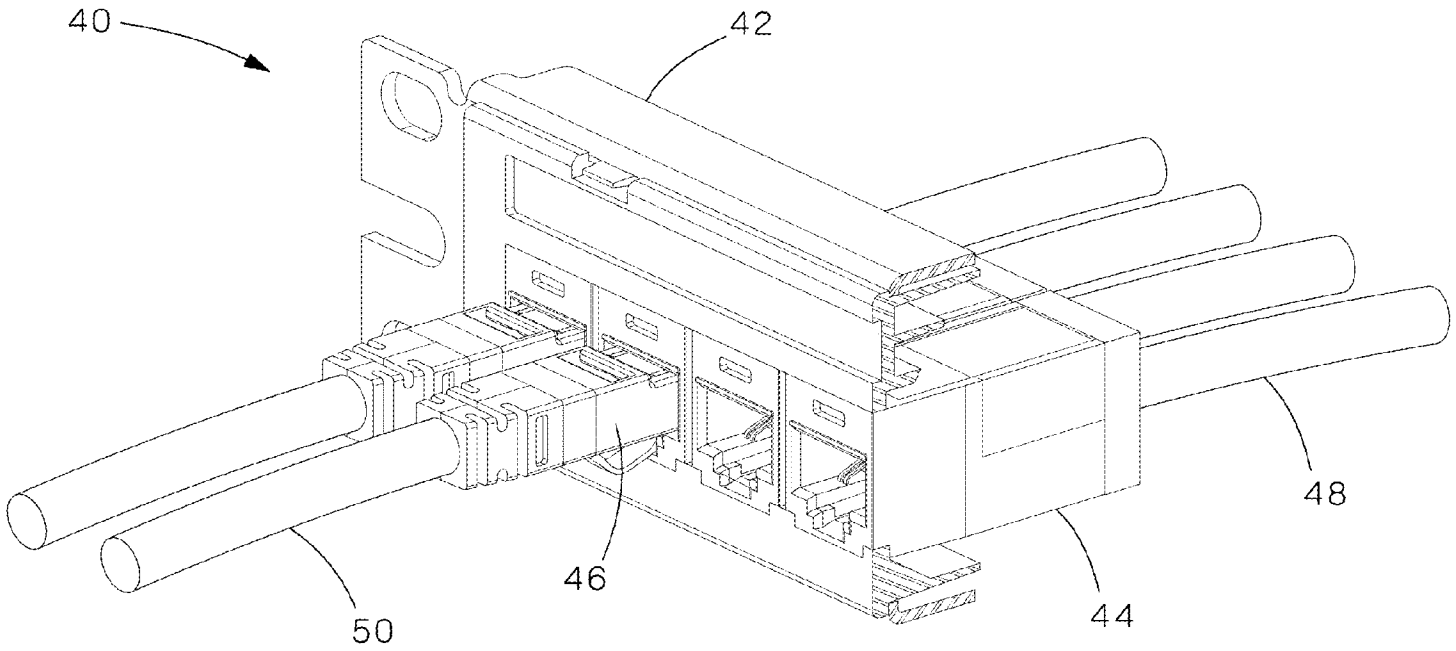
FIG. 1 illustrates a system according to an embodiment of the present invention.

An exemplary embodiment of the present invention is illustrated in FIG. 1, which shows a copper structured cabling communication system 40, which includes a patch panel 42 with jacks 44 and corresponding RJ45 plugs 46. Respective cables 48 are terminated to jacks 44, and respective cables 50 are terminated to plugs 46. Although only RJ45 plugs 46 are illustrated, system 40 can also be used with ARJ45 plugs with associated cables. Once a plug 46 mates with a jack 44 data can flow in both directions through these connectors. Although the communication system 40 is illustrated in FIG. 1 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 40 can further include cabinets, racks, cable management and overhead routing systems, and other such equipment.

Figure 2:
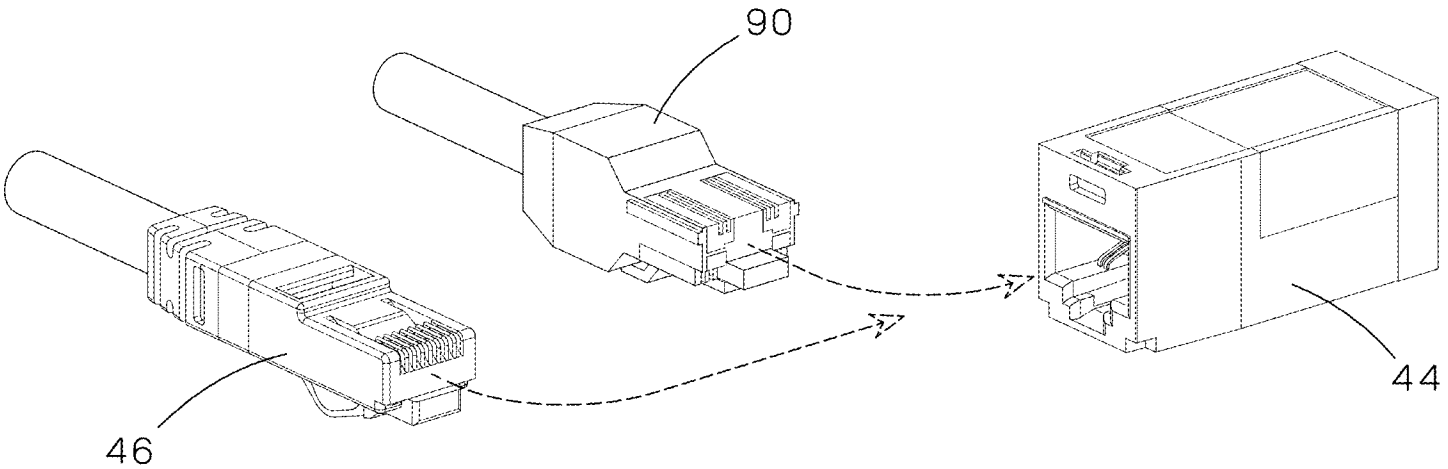
FIG. 2 illustrates an isometric view of a jack and corresponding plugs according to an embodiment of the present invention.
Figure 3:
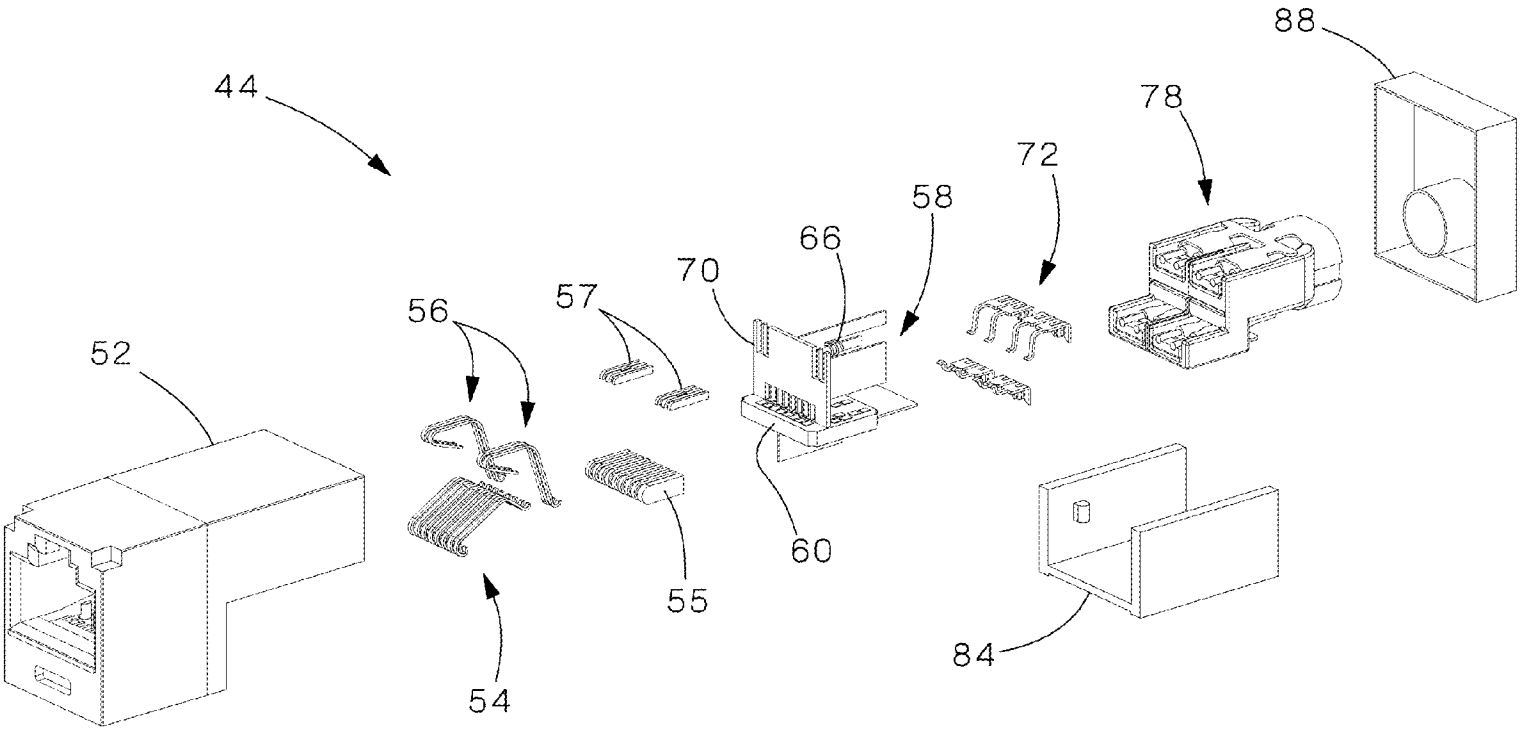
FIG. 3 illustrates an exploded isometric view of a jack according to an embodiment of the present invention.
Figure 7:
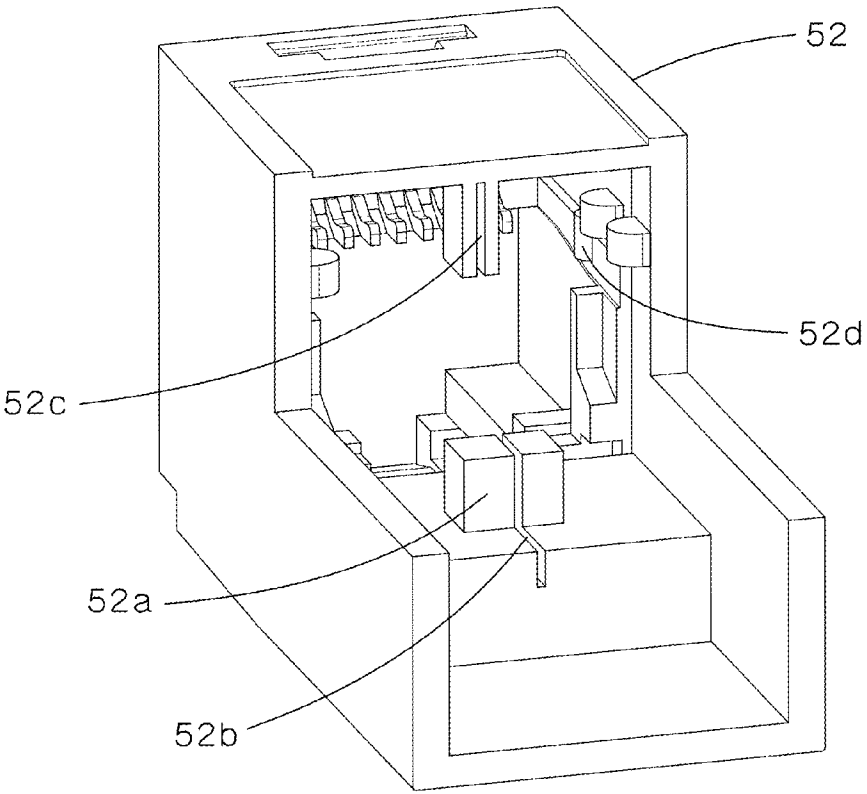
FIG. 7 illustrates a rear isometric view of the front housing of the jack of FIG. 3.

Referring now to FIG. 2, in one embodiment, jack 44 complies with Mini-Com® geometry as employed by Panduit Corp., and installs to Mini-Com® patch panels and faceplates. Examples of a compatible RJ45 plug 46 and a compatible ARJ45 plug 90 are also shown. FIG. 3 shows an exploded view of an embodiment of jack 44. In this embodiment, jack 44 includes a front housing 52, lower plug interface contacts (PICs) 54 ($\mathbf{54}_{1\text{-}8}$), upper PICs 56 ($\mathbf{56}_{3\text{-}6}$), dielectric structures 55 and 57, a PCB 60 connected to a switching plate 70 and dividers 58 (collectively referred to as "the switching components"), a spring 66 positioned between a retention wall 52*a* of the front housing 52 (see FIG. 7) and the switching components, insulation displacement contacts (IDCs) 72 ($\mathbf{72}_1$-$\mathbf{72}_8$), a wire manager assembly 78, a rear housing 84, and a rear cap 88. The front housing 52 may be made of metal (or any other conductive material) and can include plug grounding tabs which can be used to electrically bond a shielded plug to jack 44. Depending on the embodiment, the front housing 52 may be made entirely of metal or may have only some of its parts (e.g., the plug-receiving portion) made out of metal. Similarly, the rear housing 84 and the rear cap 88 may also be metal or may otherwise be made from a conductive material. Alternatively, the housing components may be formed from a non-conductive material such as, for example, plastic.

Based on the type of a plug that is inserted into the jack 44, the PCB 60 is located at one of two possible locations. This enables the switching of the signal paths between PICs 54, 56 and one of two independent circuits on PCB 60.

Figure 4:
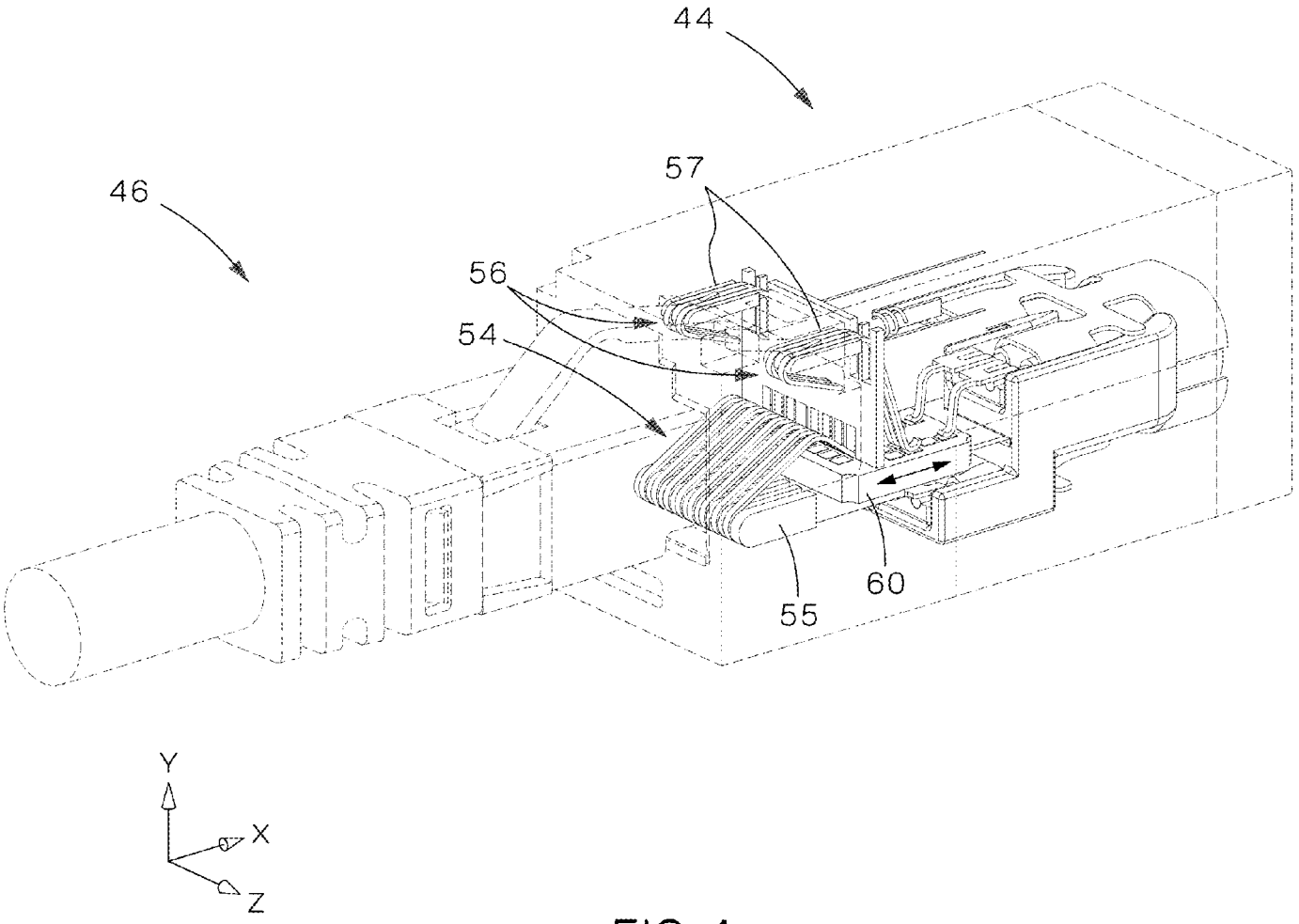
FIG. 4 illustrates the movement of the PCB of the jack of FIG. 3 in response to the jack being mated to an RJ45 plug.
Figure 5:
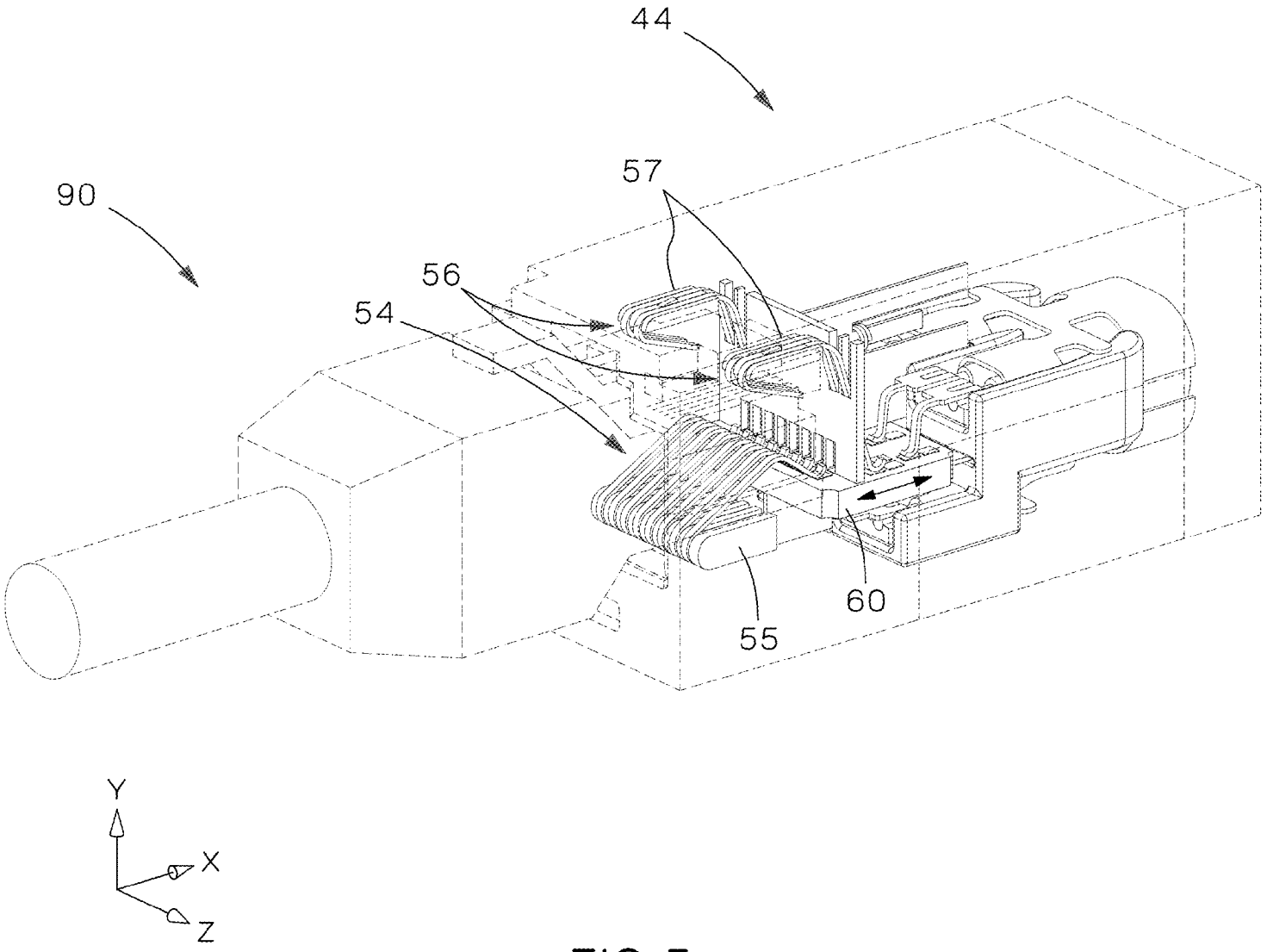
FIG. 5 illustrates the movement of the PCB of the jack of FIG. 3 in response to the jack being mated to an ARJ45 plug.

As shown in FIGS. 4 and 5, the jack 44 is provided with twelve plug interface contacts (PICs $\mathbf{54}_{1\text{-}8}$ and PICs $\mathbf{56}_{3\text{-}6}$) which are at least partially held in place with dielectric structures 55, 57. The PICs 54 and 56 are positioned such that their proximal ends contact the plug contacts of a plug, and their distal ends make contact with contact pads on the PCB 60. PICs $\mathbf{54}_1$ through $\mathbf{54}_8$ are arranged in a fashion to mate with a traditional RJ45 plug, and each subscript number corresponds to the plug contact number of a plug having its plug contacts laid out in accordance with ANSI/TIA-568-C.2. PICs $\mathbf{54}_1$, $\mathbf{54}_2$, $\mathbf{54}_7$, and $\mathbf{54}_8$ are also arranged to mate with four of the eight plug contacts of an ARJ45 plug. The remaining four plug contacts of an ARJ45 plug mate with PICs $\mathbf{56}_3$, $\mathbf{56}_4$, $\mathbf{56}_5$, and $\mathbf{56}_6$.

The switching between the RJ45 and ARJ45 functionality states of the jack 44 is achieved primarily by incorporating independent circuits on the PCB 60 and switching between those circuits by moving the PCB 60 in a generally horizontal direction along the x-axis, as shown by an arrow in FIGS. 4 and 5. Each circuit provides an electrical path from appropriate PICs to respective IDCs.

Figure 6A:
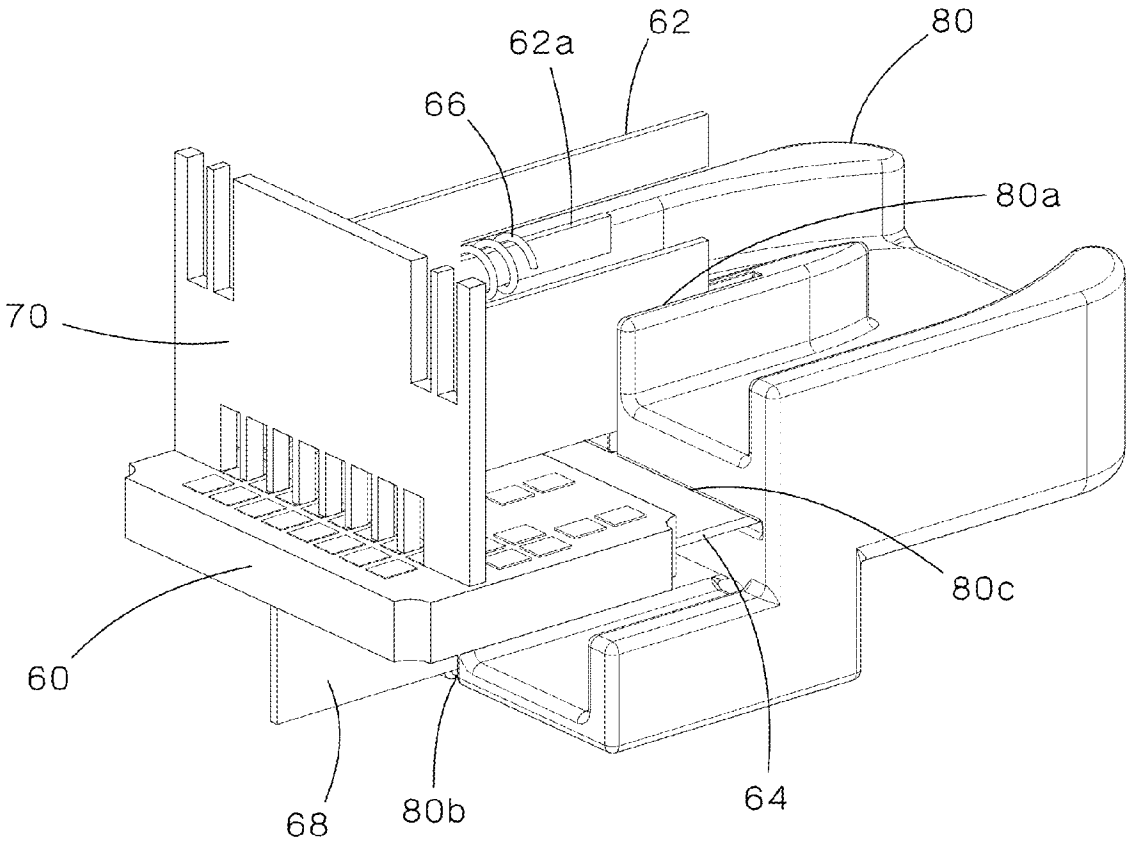
FIGS. 6A and 6B illustrate the interaction of the switching components with some other components of the jack of FIG. 3.
Figure 6B:
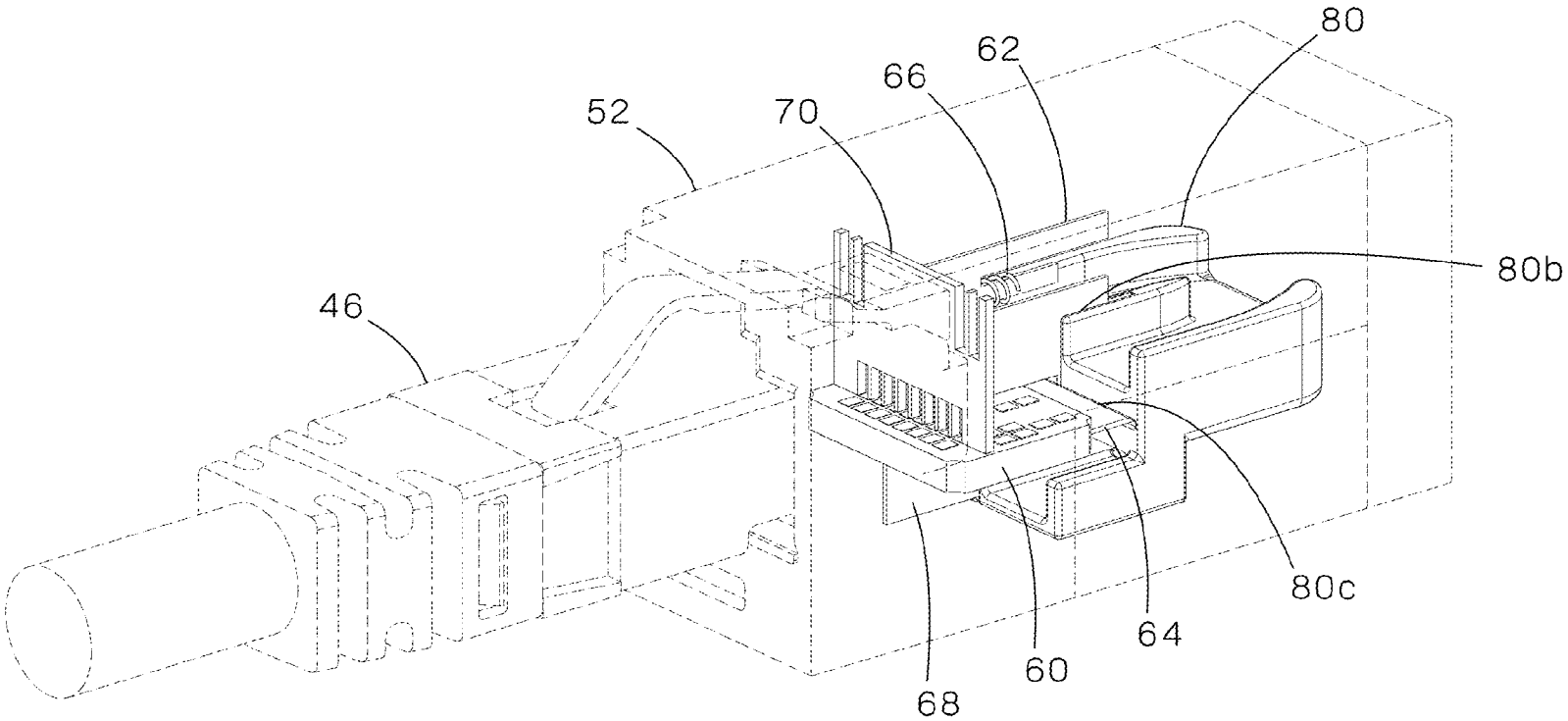

To achieve the necessary switching, PCB 60 incorporates a switching plate 70 (preferably made from a dielectric material such as, but not limited to, plastic) and dividers 58 which allow the PCB to be pushed and guided along an appropriate path. These elements are illustrated in FIGS. 6A and 6B. Dividers 58 are comprised of a top vertical divider 62, a bottom vertical divider 68, and a horizontal divider 64. Preferably, dividers 58 are made from a material which has electromagnetic shielding properties, and in some embodiments dividers 58 are metal. When the jack 44 is assembled, the top vertical divider 62 is partially positioned within guide path 80*a* of the wire manager 80 and partially within guide path guide path 52*b* of the front housing 52 (see FIG. 7), the bottom vertical divider 68 is partially positioned within guide path 80*b* of the wire manager 80 and partially within guide path guide path 52*c* of the front housing 52, and the horizontal divider 64 is partially positioned within guide path 80*c* of the wire manager 80. The top vertical divider 62 includes a protrusion 62*a* which acts as a post for the spring 66. When the top vertical divider 62 is positioned within the guide path 52*b*, the spring 66 becomes trapped between the retention wall 52*a* and the divider 62, and biases the divider 62 along with the PCB 60 towards the front of the jack 44. This retains the PCB 60 in a forward position at all times except for when an ARJ45 plug is inserted.

In addition to guiding the PCB 60, dividers 58 help with crosstalk reduction. In order to maintain some level of isolation between the four signal pairs and reduce unwanted crosstalk therebetween in the IDC region, horizontal divider 64 and vertical dividers 62 and 68 are assembled and positioned between the four pairs of IDCs 72. This arrangement of dividers 58 enables the formation of a quadrant for each pair of wires. Grounding the dividers 58 (when the dividers are metal) may help maintain the continuity of a shield from the plug cable to the jack and therethrough, and reduce undesired crosstalk.

Note that some embodiments of the present invention may omit the horizontal divider 64 and may instead only use the vertical dividers 62 and 68. In these embodiments, the PCB 60 itself may provide shielding properties and act as the necessary divider. Alternatively, the PCB 60 may be extended to replace the horizontal divider 64 so long as it does not interfere with the wire manager assembly 78.

Figure 8:
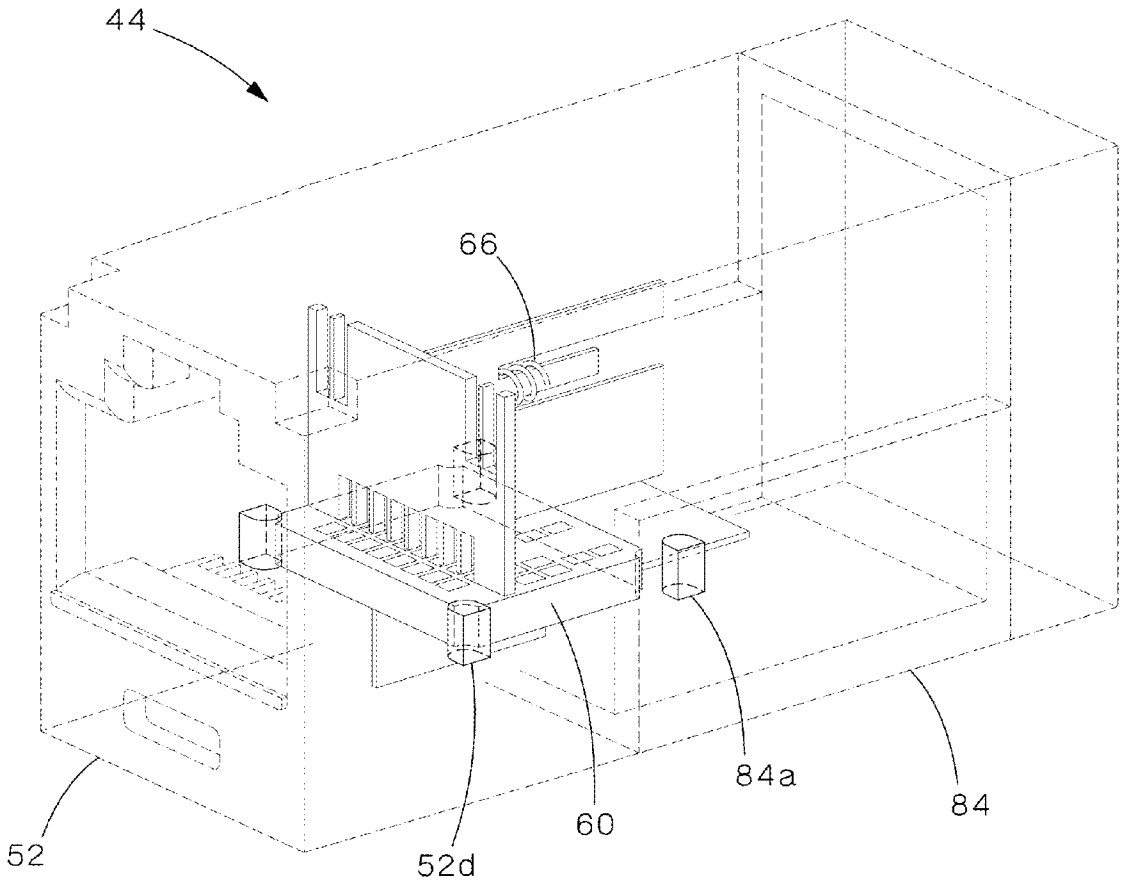
FIG. 8 illustrates the interaction of the PCB and the PCB stops of the jack of FIG. 3.
Figure 10A:
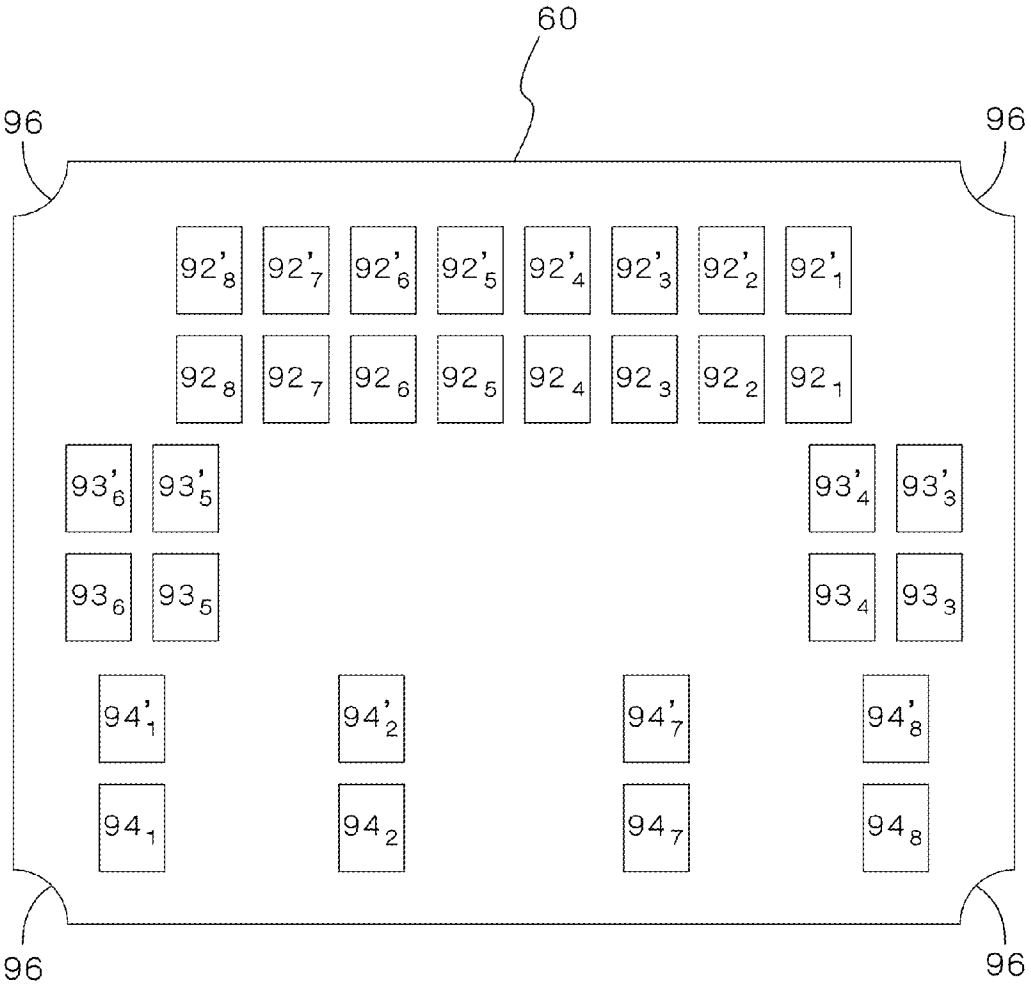
FIG. 10A illustrates a top view of one embodiment of the PCB used in the jack of FIG. 3.
Figure 10B:
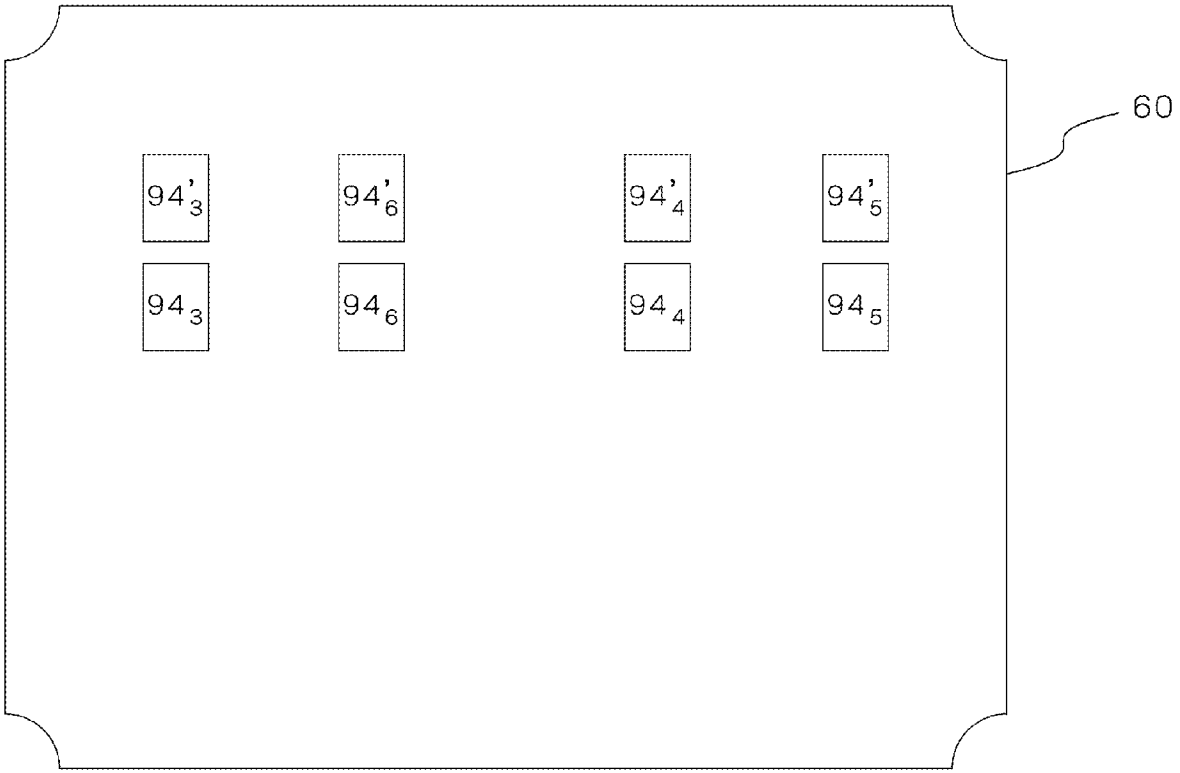
FIG. 10B illustrates a bottom view of the PCB of FIG. 10A.

To retain the PCB 60 within certain bounds along the x-axis, front stops 52*d* and rear stops 84*a* are positioned on the inside of the front housing 52 and the rear housing 84, respectively, as shown in FIG. 8. The stops 52*d* and 84*a* are positioned approximately on the same plane as the PCB 60 and are designed to come in contact with the corners 96 of the PCB 60 (see FIG. 10A). The front stops 52*d* limit the amount of forward displacement that the PCB 60 may undergo. Thus, when the PCB 60 is biased forward via the spring 66, it rests against the front stops 52*d* in a forward position. The rear stops 84*a* limit the amount of rearward displacement that the PCB 60 may undergo when the PCB 60 is moved back. Thus, when an appropriate plug (e.g., an ARJ45 plug) is inserted into the jack 44 and that plug displaces the PCB 60 into its second position, the rear stops 84*a* prevent the PCB 60 from moving too far by having the rear corners 96 rest against the stops 84*a*. When that plug is removed, the spring 66 causes the PCB 60 to again move into its forward position and once again engage the front stops 52*d*. Stops 52*d* and 84*a* may help ensure that the PICs and ICDs contact the appropriate contact pads on the PCB 60.

Figure 9A:
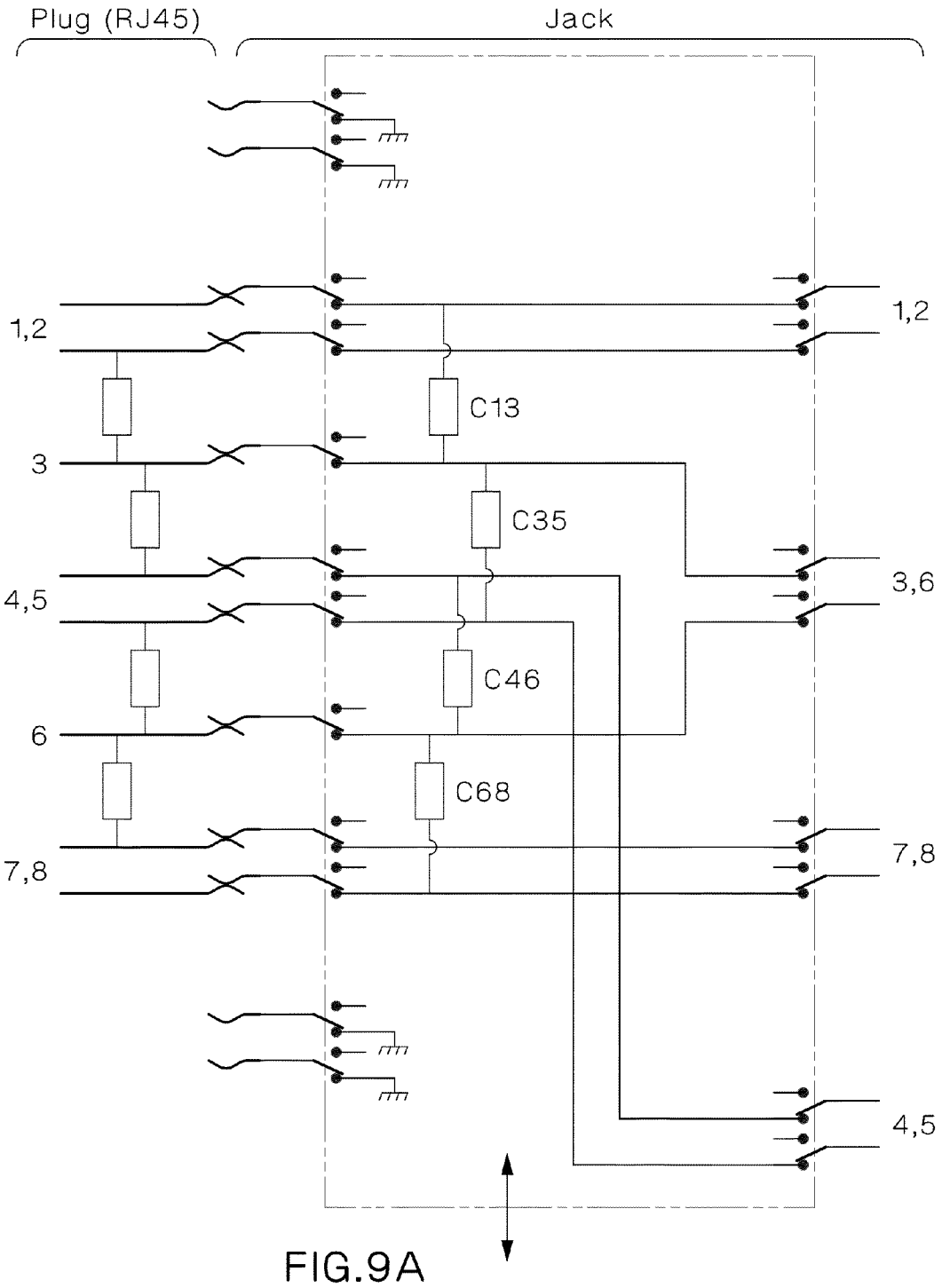
FIG. 9A illustrates a schematic representation of the circuit, according to an embodiment, on the PCB of the jack of FIG. 3 used in RJ45 mode.
Figure 9B:
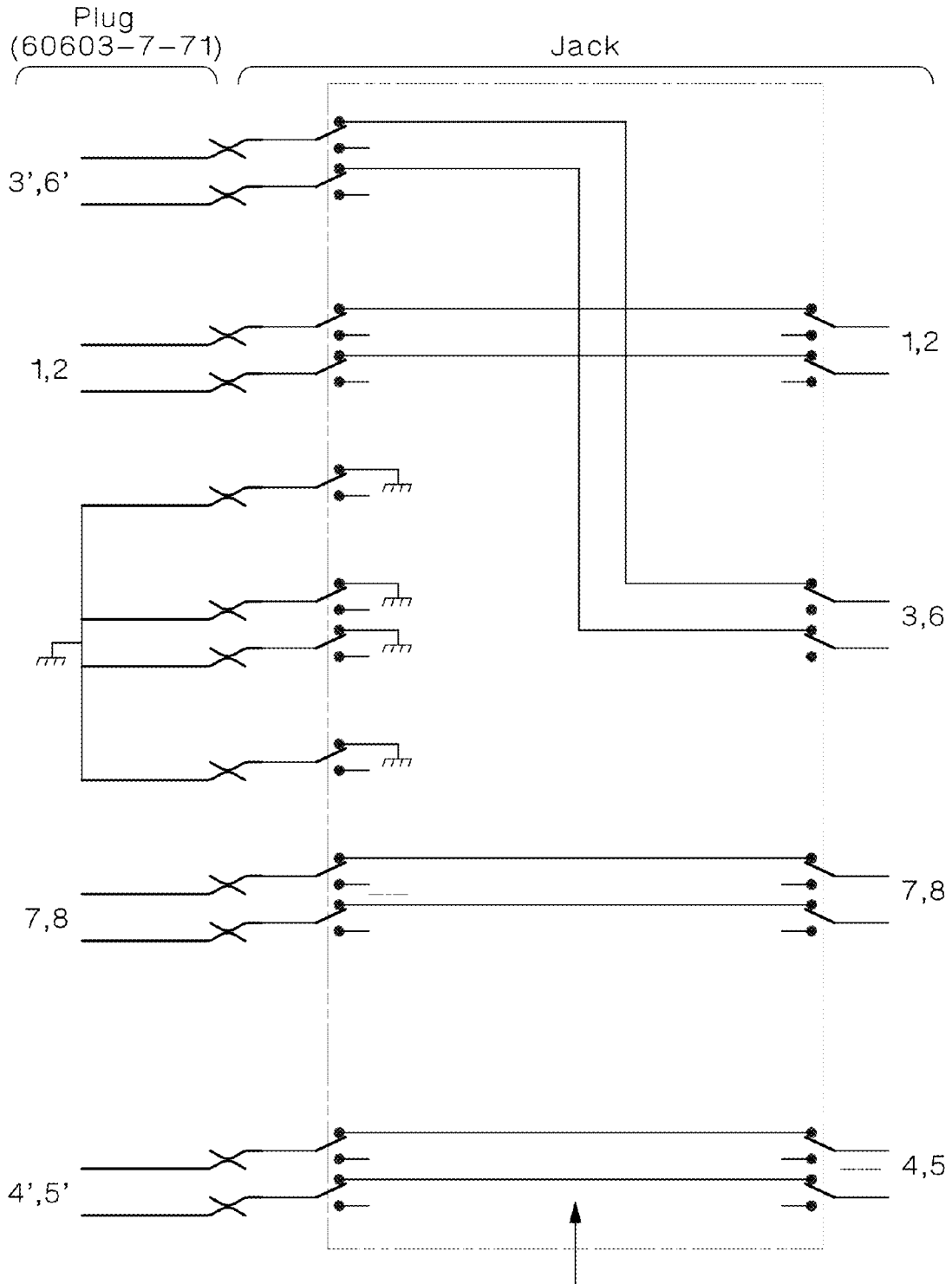
FIG. 9B illustrates a schematic representation of the circuit, according to an embodiment, on the PCB of the jack of FIG. 3 used in ARJ45 mode.
Figure 11:
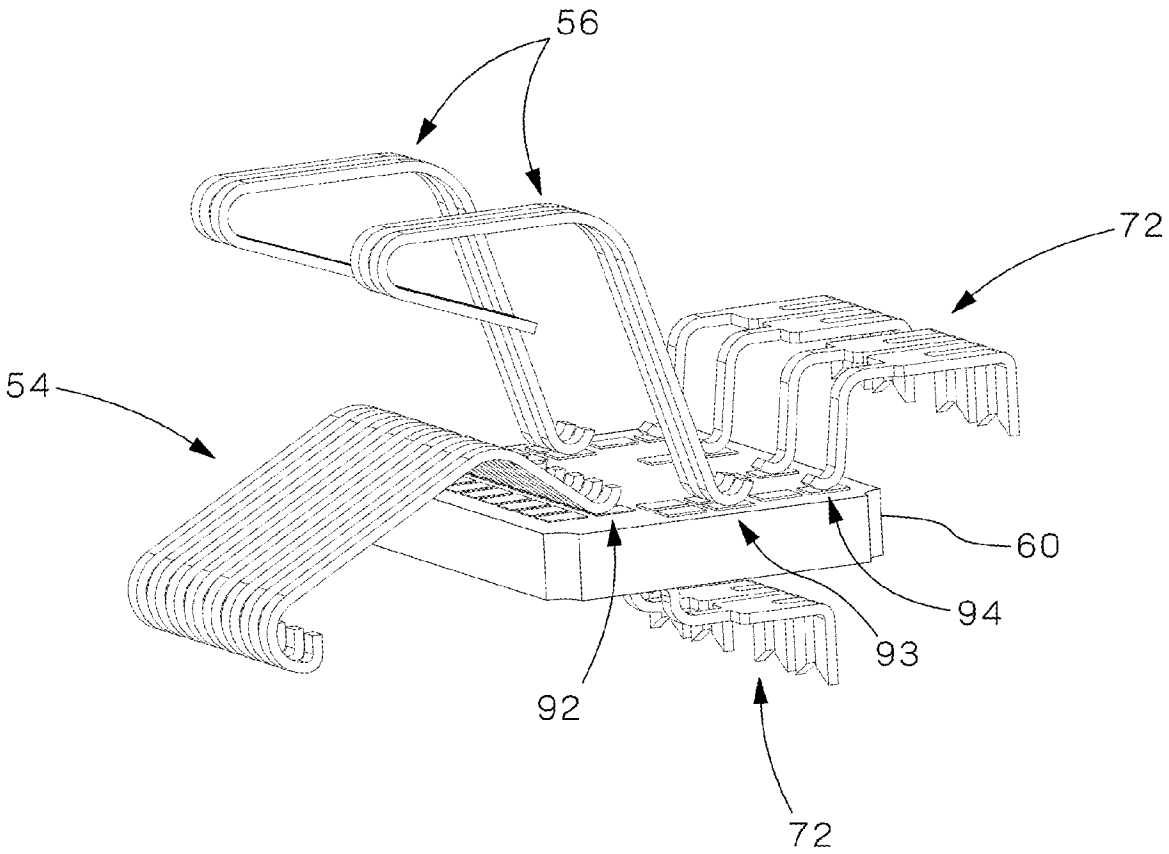
FIGS. 11 and 12 illustrate the interaction of the plug interface contacts (PICs) and the insulation displacement contacts (IDCs) with the PCB of FIG. 10A when mated to an RJ45 plug.

One embodiment of the PCB 60 together with a corresponding arrangement of the PICs is shown in FIGS. 9A-14. In this embodiment, the PCB 60 is provided with two separate circuits; the first circuit is used for RJ45 connectivity and the second circuit is used for ARJ45 connectivity. FIGS. 9A and 9B illustrate schematic representations of these circuits, respectively. Note that not all circuit elements are shown, and instead only active signal paths between the PICs and the IDCs are generally represented. As shown in FIGS. 10A and 10B, the first circuit comprises contact pads $\mathbf{92}_1$-$\mathbf{92}_8$, $\mathbf{93}_3$-$\mathbf{93}_6$, and $\mathbf{94}_1$-$\mathbf{94}_8$. Contact pads $\mathbf{92}_1$-$\mathbf{92}_8$ are designed to contact the distal ends of the PICs $\mathbf{54}_1$-$\mathbf{54}_8$, respectively, and provide an electrical path to pads $\mathbf{94}_1$-$\mathbf{94}_8$ which are designed to contact IDCs $\mathbf{72}_1$-$\mathbf{72}_8$. Contact pads $\mathbf{93}_3$-$\mathbf{93}_6$ are designed to contact the distal ends of PICs $\mathbf{56}_3$-$\mathbf{56}_4$, respectively, and are grounded through the PCB 60. The interaction between the contacts and the PCB is illustrated in FIG. 11.

Figure 12:
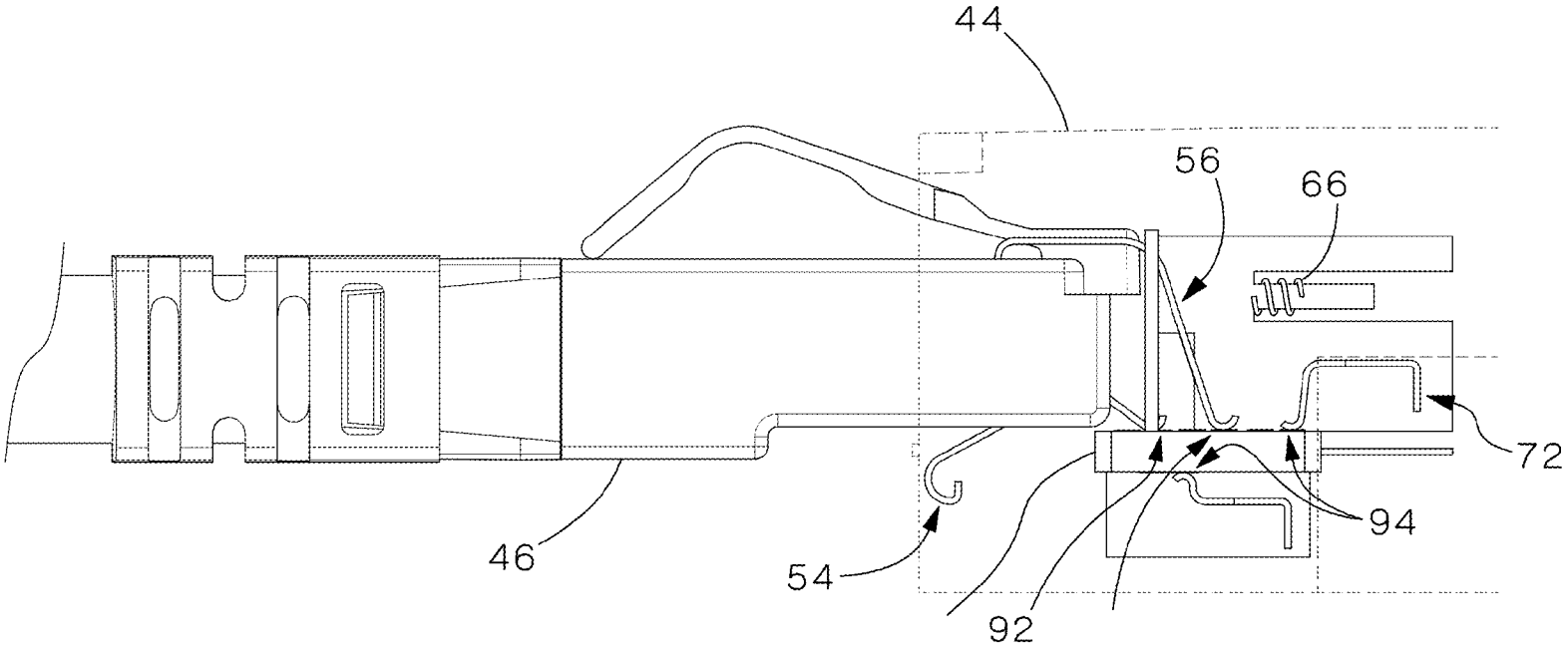

As shown in FIG. 12, the first circuit is activated when there is no plug inserted into jack 44 or when an RJ45 plug is inserted. In this state, spring 66 forces PCB 60 forward where contact pads $\mathbf{92}_1$-$\mathbf{92}_8$ on the top side of the PCB 60 are in alignment with the distal ends of the PICs $\mathbf{54}_{1\text{-}8}$. The same positioning of the PCB 60 also causes the IDC contact pads $\mathbf{94}_{1\text{-}8}$ to also align with the distal ends of the IDCs $\mathbf{72}_{1\text{-}8}$, respectively.

When an RJ45 plug 46 is inserted into jack 44, the plug contacts engage the PICs $\mathbf{54}_{1\text{-}8}$ in the jack 44 and thereby establish continuity between the plug 46 and the cable terminated at the IDCs $\mathbf{72}_{1\text{-}8}$ near the far end of the jack 44. As is typical in RJ45 jacks (e.g., CAT6A), various crosstalk compensation techniques may be used to counteract the inherent crosstalk that exists in an RJ45 plug. This compensation circuitry, which may include discrete and/or distributed capacitive and/or inductive elements between conductors (e.g., C13, C35, C46 and C68 shown schematically in FIG. 9A) may be realized on internal and/or external layers of the PCB 60. Other compensation elements which help optimize return loss, far-end crosstalk, balance, and etc. can also be included. In some instances, while the jack 44 is engaged with an RJ45 plug 46, the unused PICs $\mathbf{56}_3$, $\mathbf{56}_4$, $\mathbf{56}_5$, and $\mathbf{56}_6$ can introduce unintended coupling and crosstalk between signal pairs in the jack 44. To help reduce or prevent this unintended coupling and crosstalk from occurring, PICs $\mathbf{56}_{3\text{-}6}$ are grounded by way of contact pads $\mathbf{93}_3$-$\mathbf{93}_6$ on the PCB 60, which are connected to a grounding source.

Figure 13:
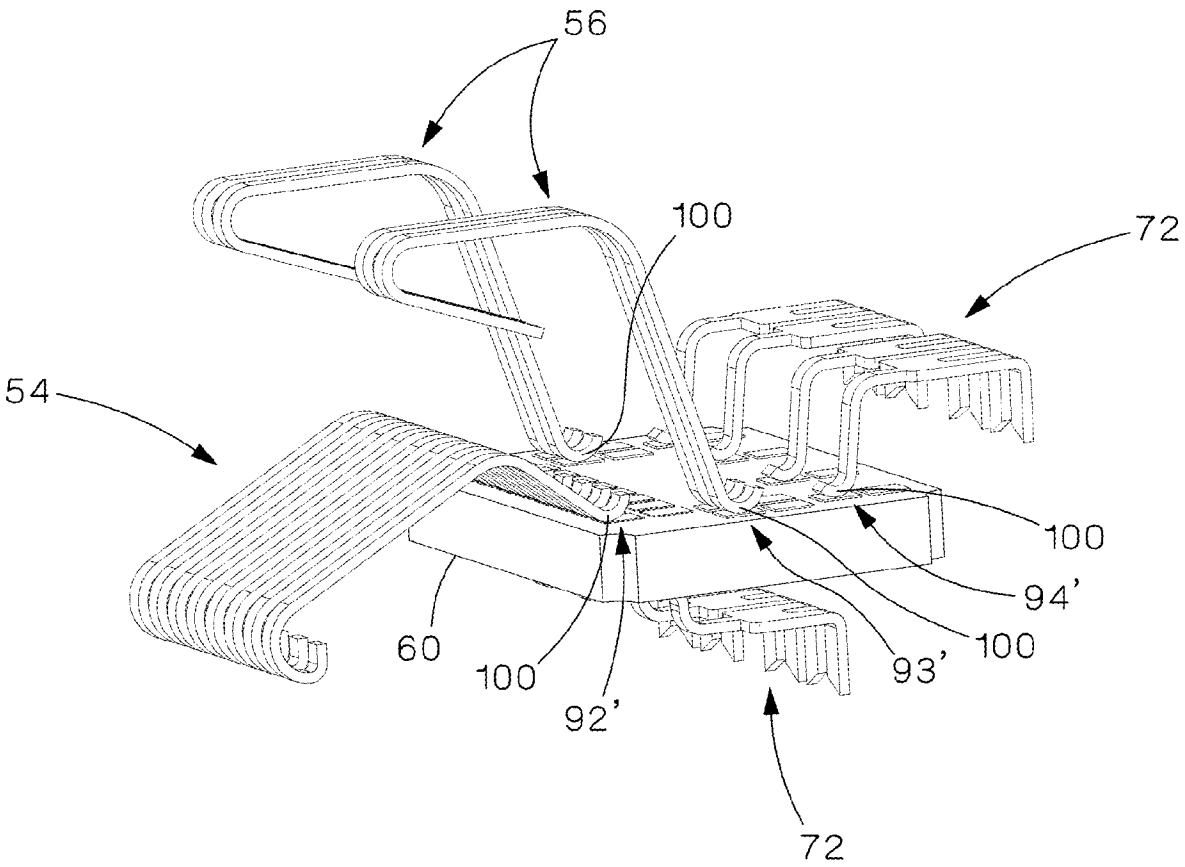
FIGS. 13 and 14 illustrate the interaction of the PICs and the IDCs with the PCB of FIG. 10A when mated to an ARJ45 plug.

The second circuit on the PCB 60 comprises contact pads $\mathbf{92'}_1$-$\mathbf{92'}_8$, $\mathbf{93'}_3$-$\mathbf{93'}_6$, and $\mathbf{94'}_1$-$\mathbf{94'}_8$. Referring to FIG. 13, as in the first circuit, contact pads $\mathbf{92'}_1$-$\mathbf{92'}_8$ contact the distal ends of the PICs $\mathbf{54}_1$-$\mathbf{54}_8$, respectively. However, of those, only contact pads $\mathbf{92'}_1$, $\mathbf{92'}_2$, $\mathbf{92'}_7$, and $\mathbf{92'}_8$ provide an electrical path to contact pads $\mathbf{94'}_1$, $\mathbf{94'}_2$, $\mathbf{94'}_7$, and $\mathbf{94'}_8$. The remaining contact pads $\mathbf{92'}_3$, $\mathbf{92'}_4$, $\mathbf{92'}_5$, and $\mathbf{92'}_6$ can be grounded through the PCB 60. As for contact pads $\mathbf{93'}_3$-$\mathbf{93'}_6$, these pads contact the distal ends of PICs $\mathbf{56}_3$-$\mathbf{56}_6$, respectively, and in this case provide an electrical path to contact pads $\mathbf{94'}_3$, $\mathbf{94'}_4$, $\mathbf{94'}_5$, and $\mathbf{94'}_6$.

Figure 14:
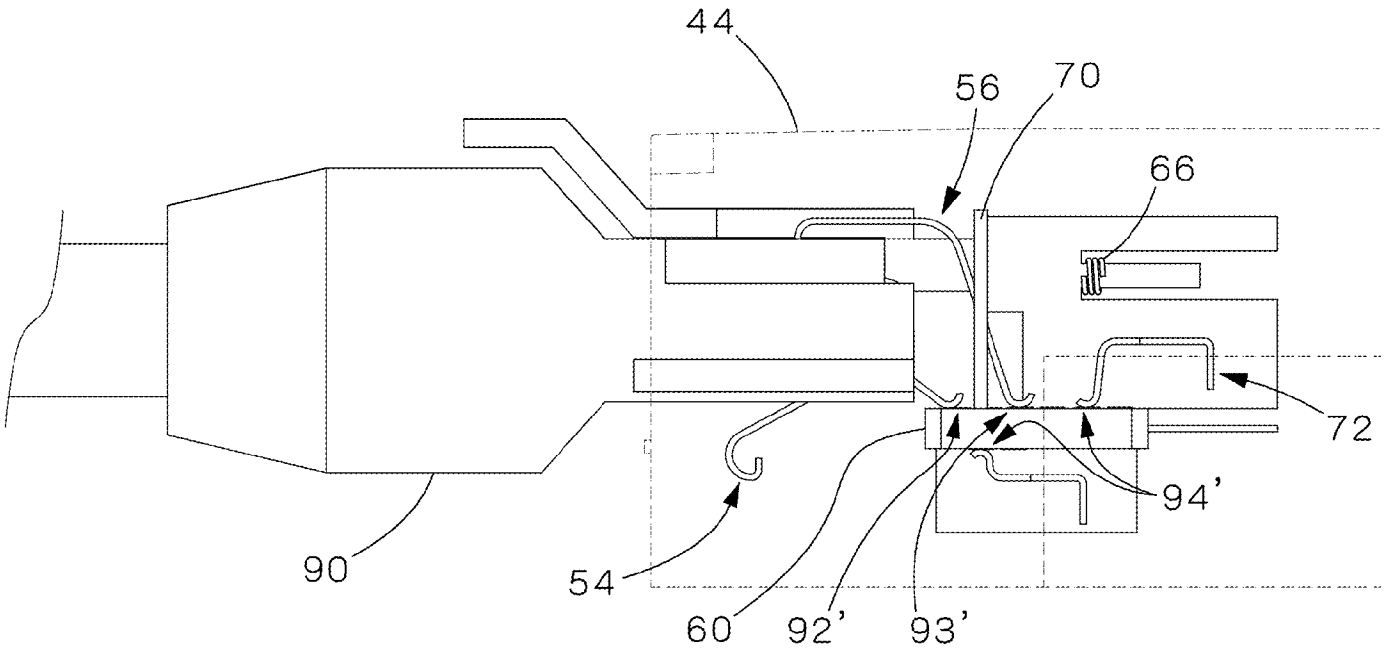

With reference to FIG. 14, when an ARJ45 style plug 90 is inserted into the jack 44 the nose feature 91 on the front of the plug engages the switching plate 70 mounted to the PCB 60. As plug 90 is inserted further into the jack 44, the nose feature 91 applies force against the switching plate 70, and displaces the plate 70 and the PCB 60 horizontally in a rearward direction.

As the PCB 60 travels into its rearward position, the PICs $\mathbf{54}_{1\text{-}8}$ and $\mathbf{56}_{3\text{-}6}$, and IDCs $\mathbf{72}_{1\text{-}8}$ lose contact with contact pads $\mathbf{92}_1$-$\mathbf{92}_8$, $\mathbf{93}_3$-$\mathbf{93}_6$, and $\mathbf{94}_1$-$\mathbf{94}_8$, and instead come into contact with contact pads $\mathbf{92'}_1$-$\mathbf{92'}_8$, $\mathbf{93'}_3$-$\mathbf{93'}_6$, and $\mathbf{94'}_1$-$\mathbf{94'}_8$, respectively. Once the ARJ45 jack is fully inserted into the jack 44, contact pads 92'$_1$-92'$_8$, 93'$_3$-93'$_6$, and 94'$_1$-94'$_8$ on the PCB 60 should align with the distal ends of the PICs and the distal ends of the IDCs. Stops 84*a* prevent the PCB 60 from traveling beyond its intended position. At this point, plug contacts of the ARJ45 plug engage the PICs 54$_1$, 54$_2$, 56$_3$, 56$_4$, 56$_5$, 56$_6$, 54$_7$, and 54$_8$ in the jack 44 and thereby establish continuity between the plug 90 and the cable terminated at the IDCs 72 near the far end of the jack 44.

By switching to a second circuit, the compensation circuitry that is used in the RJ45 operation mode is disconnected from the signal path under ARJ45 operation. As such, separate independent circuitry may be employed on the second circuit if so desired. By having separate circuits, the compensation circuitry required during the RJ45 mode of operation has little to no impact on the jack's 44 electrical performance while operating in the ARJ45 mode. This isolation may be advantageous when meeting the high bandwidth performance targets of jack 44. Furthermore, to reduce unintentional coupling and achieve improved return loss, insertion loss, and electrical balance performance at higher frequencies, contact pads 92'$_3$, 92'$_4$, 92'$_5$, and 92'$_6$, and thus PICs 54$_3$, 54$_4$, 54$_5$, and 54$_6$, are preferably grounded via the PCB 60.

Preferably, PICs 54 and 56, and IDCs 72 are designed to be or resilient nature, causing the distal ends thereof to springingly press against the contact pads on the PCB 60. To help ensure a smooth transition between the contact pads, the distal ends of the PICs 54 and 56, and IDCs 72 are provided with curved feet 100 (see FIG. 13) which may act as ramps. This design may help ensure a constant force on the contact pads and it may also help ensure that in the process of sliding on and off the contact pads of the PCB 60, contaminants or oxidation that may be present on the surface of the PCB 60 contact pads will be wiped away; thereby, providing a robust connection between the PICs, the IDCs, and the circuitry in between.

Figure 15:
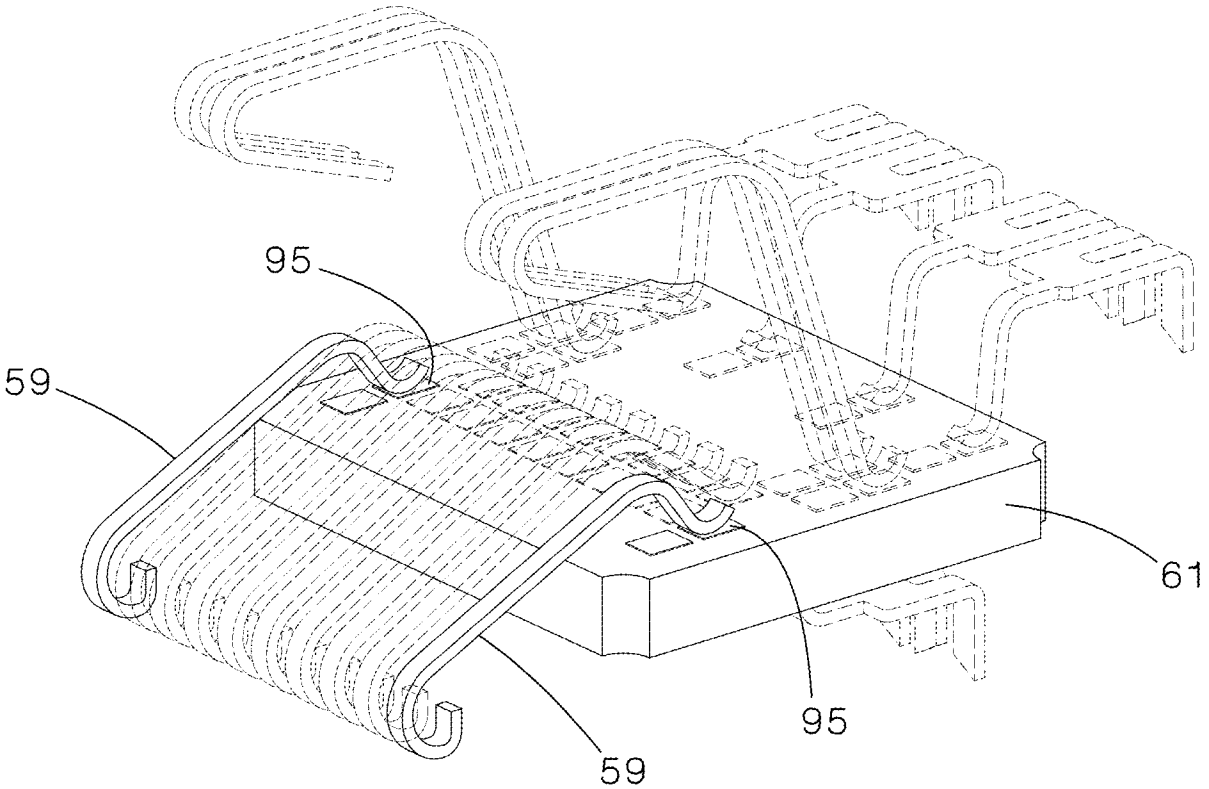
FIGS. 15 and 16 illustrate another embodiment of the PICs and the PCB which may be used in the jack of FIG. 3.
Figure 16:
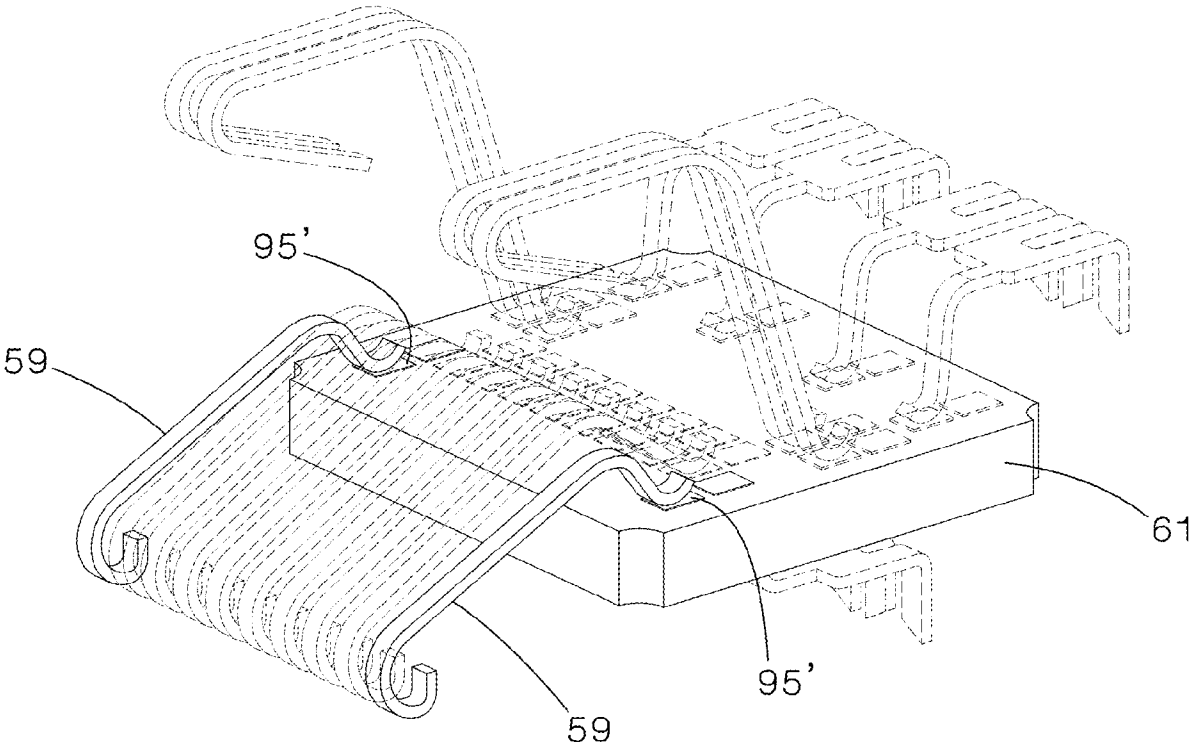

Another embodiment of the present invention is illustrated in FIGS. 15-16 where a PCB 61 together with a corresponding arrangement of the PICs, including two additional contacts 59, is shown. While the entire jack 44 is not illustrated, one of ordinary skill in the art will understand that PCB 61 can substitute for the PCB 60 in the jack 44 and the additional contacts 59 may be implemented in a manner that is similar to the PICs 54 of the previously described embodiment.

The PCB 61 retains some features of the PCB 60, including contact pads 92$_1$-92$_8$, 93$_3$-93$_6$, and 94$_1$-94$_8$ which contact respective PICs and IDCs in the RJ45 mode of operation, contact pads 92'$_1$-92'$_8$, 93'$_3$-93'$_6$, and 94'$_1$-94'$_8$ which contact respective PICs and IDCs in the ARJ45 mode of operation, and any potential interconnecting circuitry. However, PCB 61 includes additional contact pads 95$_0$, 95$_9$, 95'$_0$, and 95'$_9$ which are designed to contact the two additional contacts 59$_0$ and 59$_9$.

When operating PCB 60 in ARJ45 mode, PICs 54$_1$ and 54$_2$ are mated with their corresponding plug contacts of the ARJ45 plug and PIC 54$_3$ is connected to ground. With the position of PIC 54$_3$ being adjacent to PIC 54$_2$, an impedance discontinuity may occur. Even and odd mode impedance of PIC 54$_1$ will be inherently higher than PIC 54$_2$. This impedance discontinuity can results in an increase in electrical reflections at the plug/jack interface and an increase in mode conversion. The differential return loss, insertion loss, and crosstalk performance of signal-pair 1:2 may be degraded due to this inherent condition of the jack. Thus, to avoid these performance degradations, even and odd mode impedances of PICs 54$_1$ and 54$_2$ should be equal and matched to the characteristic impedance of the cable. By introducing contact 59$_0$, which is grounded in the ARJ45 mode of operation, adjacent to PIC 54$_1$ in the PCB 61 the impedances discontinuity may be reduced or otherwise eliminated. This can help provide a balanced configuration of ground conductors and signal conductors (Ground-Signal-Signal-Ground), which can become increasingly advantageous relative to signal integrity as the bandwidth increases.

A similar concern exists with PICs 54$_7$ and 54$_8$ in the ARJ45 mode of operation. PICs 54$_7$ and 54$_8$ are mated with their corresponding plug contacts of the ARJ45 plug and PIC 54$_6$ is grounded. With PIC 54$_6$ being adjacent to PIC 54$_7$, even and odd mode impedance of PIC 54$_8$ will be inherently higher than PIC 54$_7$. By adding an additional grounded contact 59$_9$ adjacent to PIC 54$_8$, a more balanced (Ground-Signal-Signal-Ground) configuration is created and performance degradations may be reduced or otherwise eliminated.

To achieve the necessary grounding, the side contacts 59$_0$ and 59$_9$ are grounded through PCB contact pads 95'$_0$ and 95'$_9$ (which themselves are grounded through the PCB), respectively, which are engaged by the by the contacts 59$_0$ and 59$_9$ when the jack 44 is operating in the ARJ45 operating mode. Furthermore, the side contacts 59$_0$ and 59$_9$ are slightly offset relative to PICs 54$_{1-8}$ to allow the plug body to be fully inserted without interfering with or plastically deforming contacts 59$_0$ and 59$_9$. The plug body can also be beneficially modified to shield the side contacts 59$_0$ and 59$_9$.

Another possible use of contacts 59$_0$ and 59$_9$ is to incorporate them into the crosstalk compensation circuitry that is likely to be implemented when jack 44 is operating in the RJ45 mode, as shown in FIG. 16. By grounding contacts 59$_0$ and 59$_9$ via contacts pads 95$_0$ and 95$_9$ (which are grounded via the PCB 61), those contacts may provide an additional way of reducing or minimizing the imbalance effect caused by the split pair 3:6 coupling to the signal pair 1:2 and the signal pair 7:8. Thus, balancing on the 1:2 and 7:8 signal pairs may be improved. Furthermore, since 95$_0$, 95$_9$, 95'$_0$, and 95'$_9$ are grounded, pads 95$_0$ and 95'$_0$ may be combined into a single contact pad which will be in contact with the contact 59$_0$ regardless of the mode of operation, and pads 95$_9$ and 95'$_9$ may also be combined into a single contact pad which will also be in contact with the contact 59$_9$ regardless of the mode of operation.

Figure 17A:
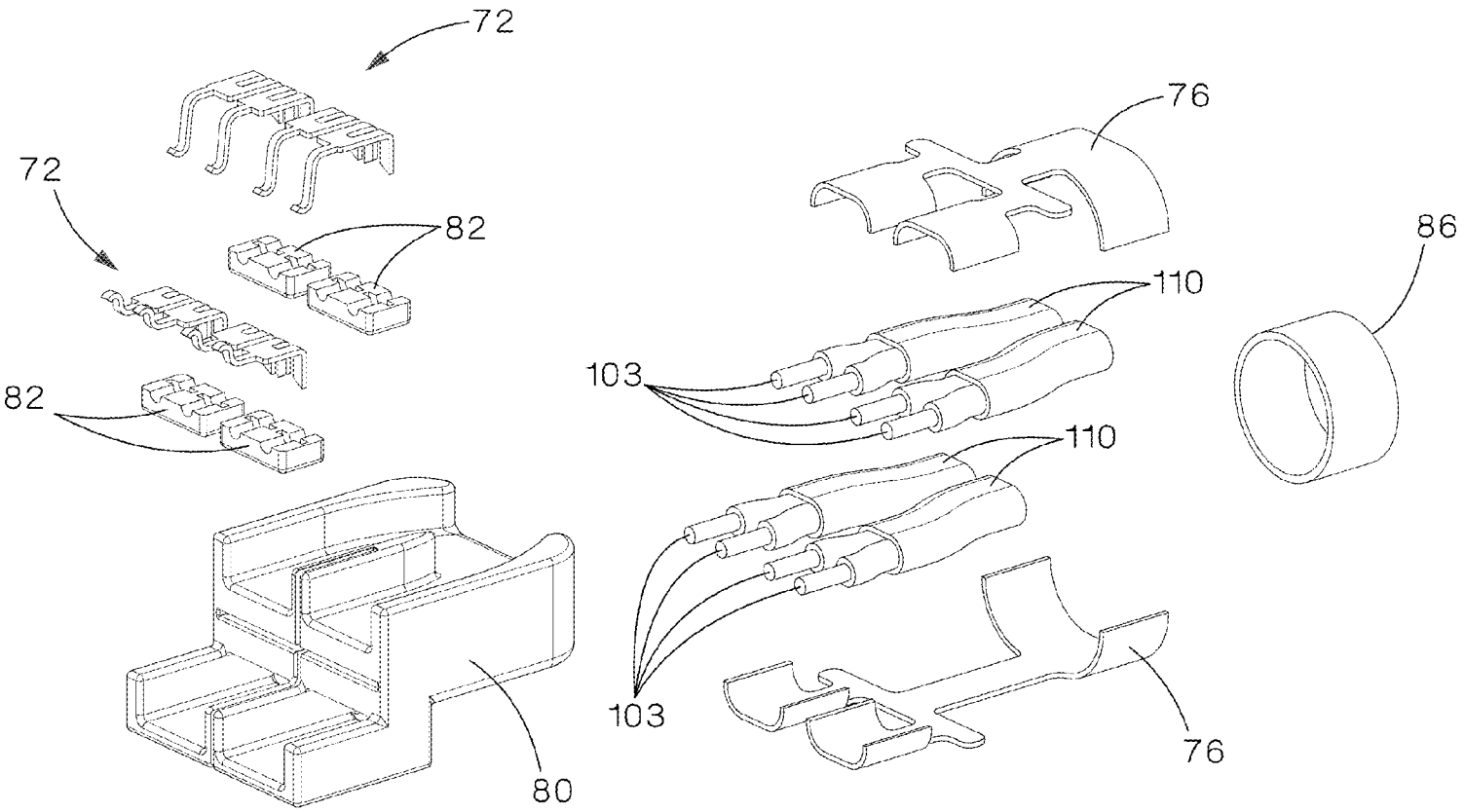
FIG. 17A illustrates an exploded isometric view of the wire manager assembly of FIG. 3.
Figure 17B:
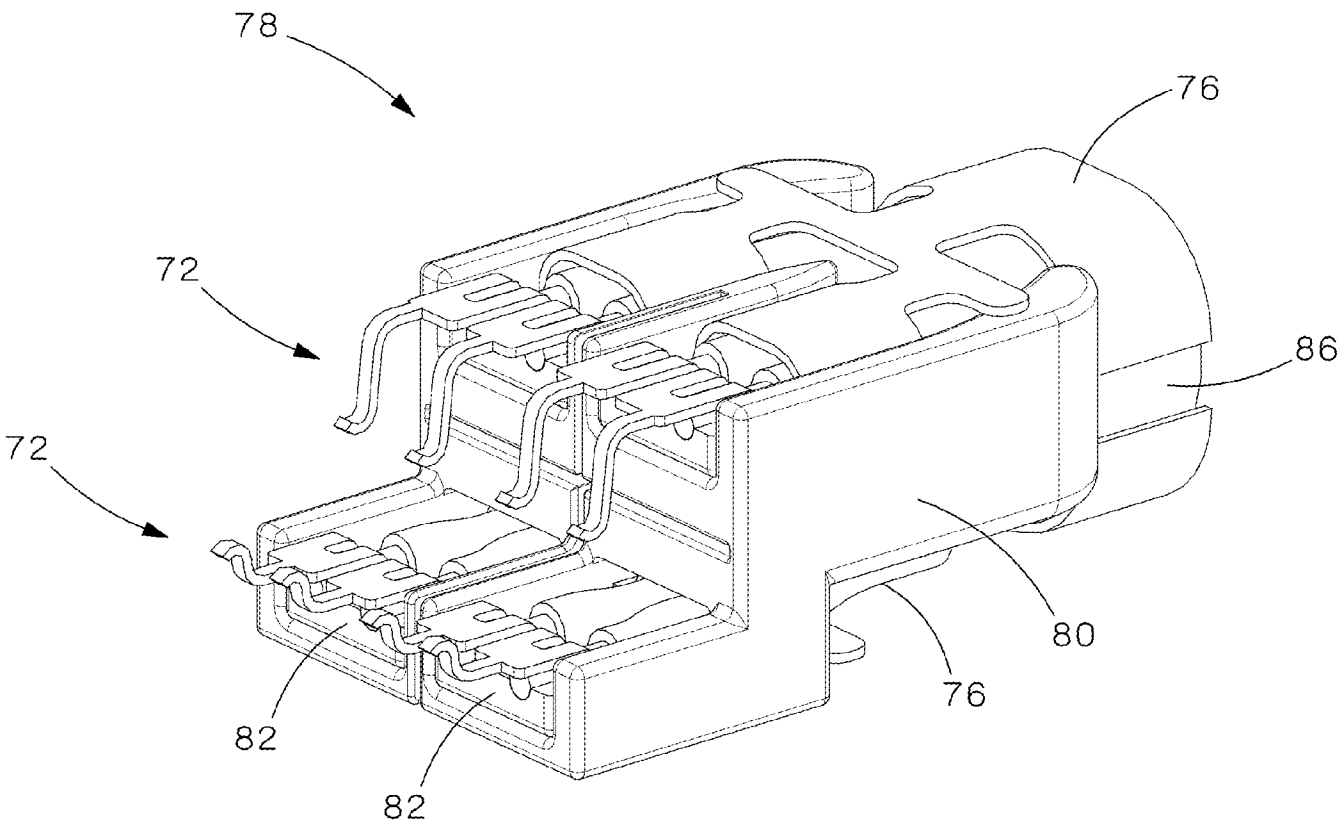
FIG. 17B illustrates an isometric view of an assembled wire manager assembly of FIG. 17A.

The jack 44 may be terminated to any number of communication cables 48 including shielded cables. Since the jack 44 may be employed in environments where operational speeds exceed 10GBASE-T, the jack may be terminated to braid shield cables and foil/braid shield cables. Those skilled in the art will be succulently familiar with these cables, and thus no further description is necessary regarding structure thereof. To help terminate the cable 48 to the jack 44, a wire manager assembly 78 shown in FIGS. 17A and 17B is used.

The wire manager assembly 78 includes a wire manager 80, foil terminators 76, a ferrule 86, and IDC inserts 82. Four IDC inserts 82 are positioned at the front end of the wire manager 80 such that the wires 103 inserted into the wire manager are laid over the inserts 82. The IDC inserts 82 include recessed portions designed to support and retain the cable wires 103 in place when the insulation of those wires is displaced during the IDC termination process. Prior to termination of the wires 103, the ferrule 86, and the rear cap 88 (see FIG. 3) are slipped over the cable 48. Thereafter, wire pairs 110 are separated and are inserted into the wire manager 80 with the braids of the cable being positioned over the ferrule. The wire pairs 110 are positioned over the IDC inserts 82 and the foil terminators 76 are placed over the foil of the wire pairs 110 and the cable braids. The foil terminators can be either pushed to fit in the wire manager 80, crimped over the wire pairs 110, or otherwise secured such that an electrical path is formed from the foil of the wire pairs to the foil terminators. The back end of foil terminators 76 can be crimped, or otherwise secured, over the braids of the cable 48 and the ferrule 86, thereby completing the electrical path from the foil of the wire pairs to the braids.

Figure 18:
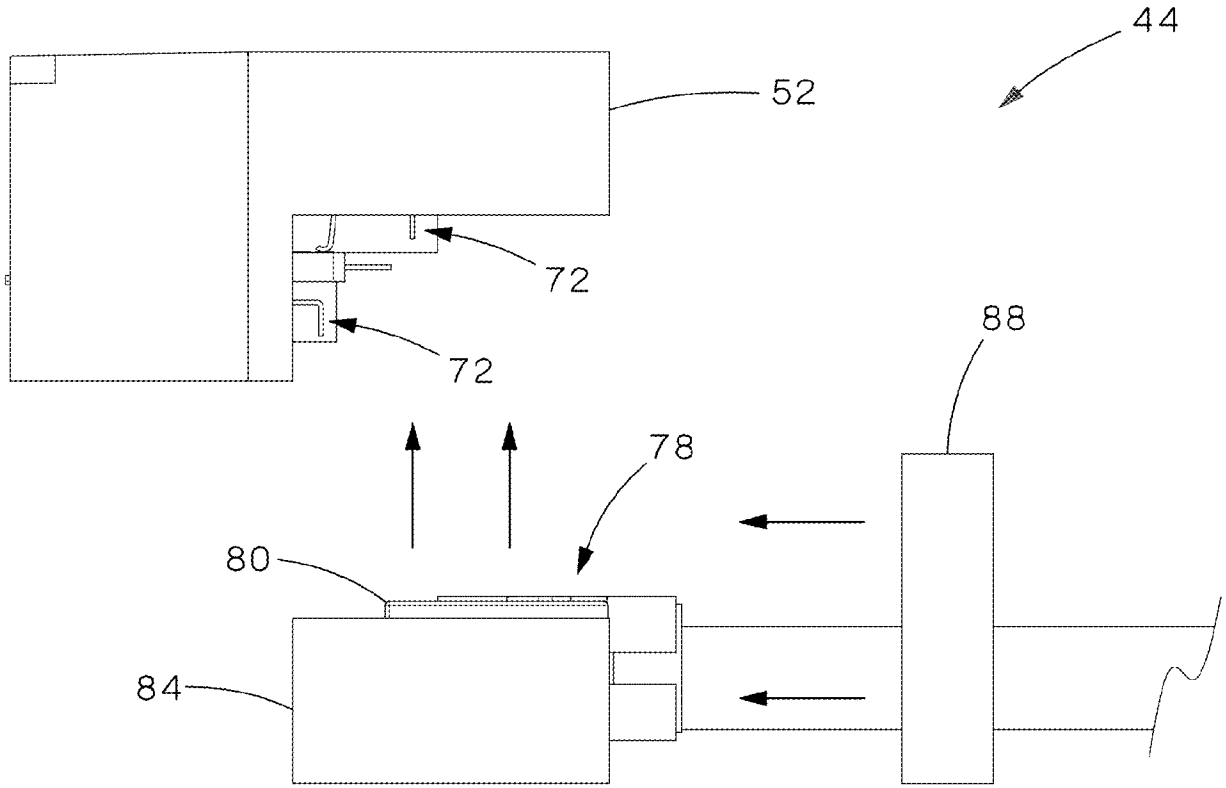
FIG. 18 illustrates an embodiment of a process of assembly of the jack of FIG. 3.

To complete the cable termination process, the wire manager assembly is attached to the rear housing 84. Thereafter, together with the wire manager assembly 78, the rear housing 84 is pushed up into the front housing 52, as shown in FIG. 18, causing the IDCs 72 (which are held rigidly in place within the front housing 52) to engage and terminate wires 103. Note that depending on the embodiment of the jack 44, the horizontal divider 64 may be short enough not to interfere with the upward movement of the wire manager 80. This configuration may allow the jack 44 to be assembled such that the switching components are installed in the front housing 52 prior to the wire termination step. In alternate embodiments where the horizontal divider 64 would interfere with the upward movement of the wire manager 80, the jack 44 may be assembled by first terminating the jack to the cable, and then positioning the switching components internally. However, these two methods should not be considered limiting in any way, and other assembly methods are fall within the scope of the present invention. Once the rear housing 84 has been joined to the front housing 52, the rear cap 88 is positioned over the rear end of the jack 44.

Figure 19:
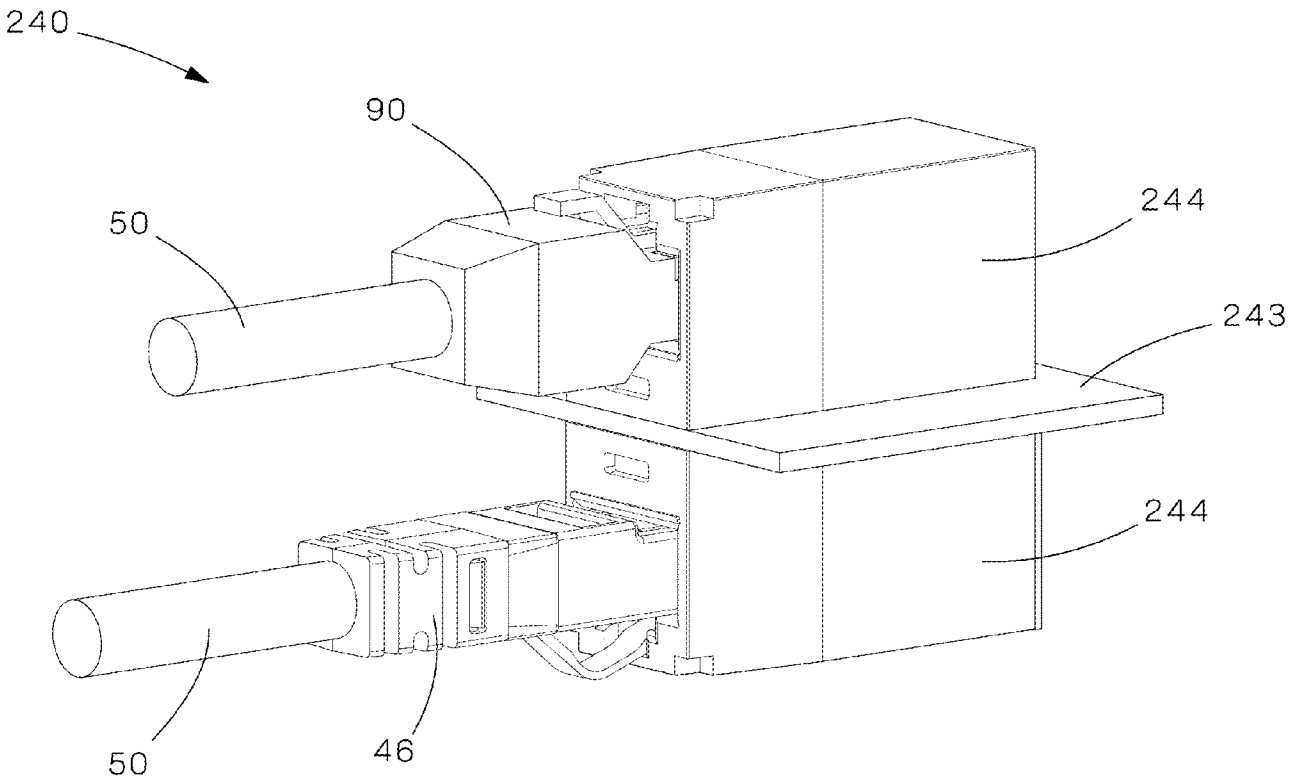
FIG. 19 illustrates a communication system according to an embodiment of the present invention.

Another exemplary embodiment of the present invention is illustrated in FIG. 19, which shows a copper structured cabling communication system 240 with jacks 244, an RJ45 plug 46, an ARJ45 plug 90, and an equipment/NIC card PCB 243. The RJ45 plug and the ARJ45 plug each have a respective communication cable 50 terminated thereto, and each of the jacks 244 is connected to the equipment PCB 243 via connector pins (see FIG. 20). When either of the plugs 46 or 90 is mated to any of the jacks 244, bi-directional data flow can be established through the plug/jack combination, and between the equipment and the communication cable 50.

Although the present embodiment can be used in communication system 240 as shown in FIG. 19, other communication systems according to the present invention can include equipment other than shown here. The equipment of the present invention can be passive equipment or active equipment. Examples of passive equipment can be, but are not limited to, modular patch panels, angled patch panels, wall jacks, etc. Examples of active equipment can be, but are not limited to, Ethernet switches, routers, servers, physical layer management systems, and Power-Over-Ethernet equipment as can be found in data centers/telecommunications rooms; security devices (cameras and other sensors, etc.) and door access equipment; and telephones, computers, fax machines, printers and other peripherals as can be found in workstation areas. Communication systems according to the present invention can further include cabinets, racks, cable management and overhead routing systems, and other such equipment.

Figure 20:
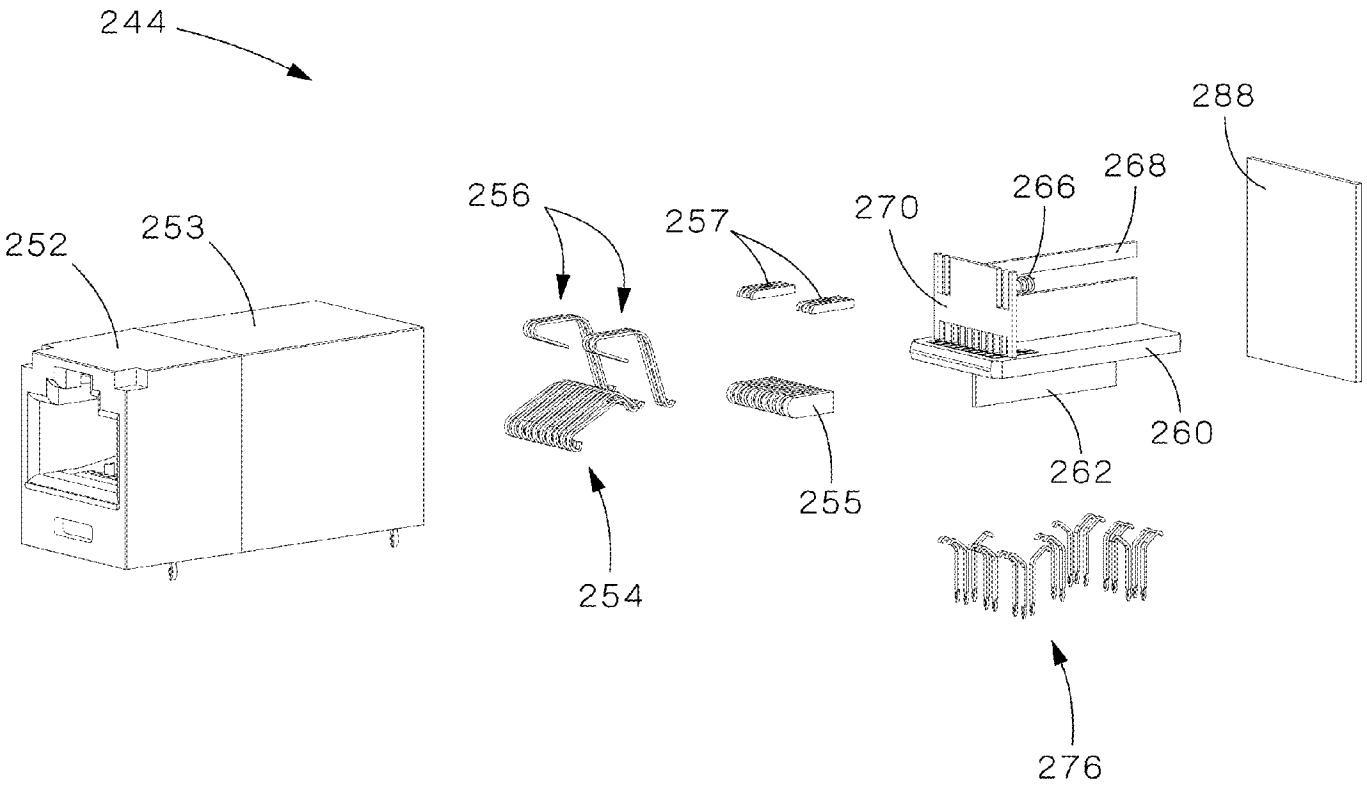
FIG. 20 illustrates an exploded view of a jack according to an embodiment of the present invention.

One embodiment of the jack 244 is shown in FIG. 20 which shows an exploded view of said jack. In this embodiment, jack 244 includes a front housing 252, a rear housing 253, PICs 254 ($\mathbf{254}_{1\text{-}8}$), upper PICs 256 ($\mathbf{256}_{3\text{-}6}$), dielectric structures 255 and 257, a PCB 260 connected to a switching plate 270 and dividers 262,268 (collectively referred to as "the switching components"), a spring 266 positioned between a retention wall 252*a* (see FIGS. 23 and 27C) and the switching components, connector pins 276, and a rear cap 288. The front housing 252 may be made of metal (or any other conductive material) and can include plug grounding tabs which can be used to electrically bond a shielded plug to jack 244. Alternatively, the housing may be made of plastic. Depending on the embodiment, the front housing 252 may be made entirely of metal or may have only some of its parts (e.g., the plug-receiving portion) made out of metal. Similarly, the rear housing 253 and the rear cap 288 may also be metal or may otherwise be made from a conductive material.

Based on the type of a plug that is inserted into the jack 244, the PCB 260 is located at one of two possible locations. This enables the switching of the signal paths between PICs 254, 256 and one of two independent circuits on PCB 260.

Figure 21A:
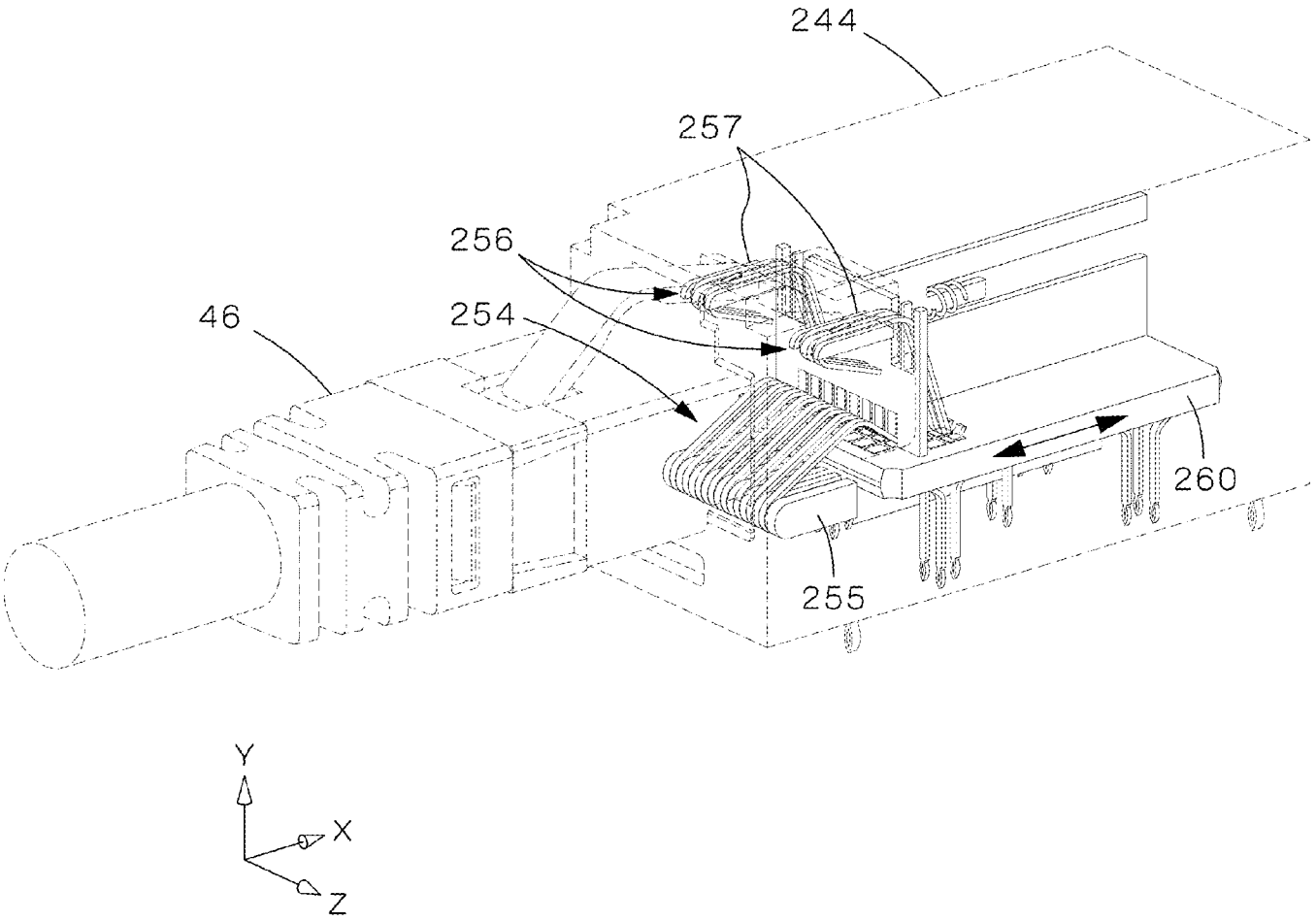
FIG. 21A illustrates the jack of FIG. 20 mated with an RJ45 plug.
Figure 21B:
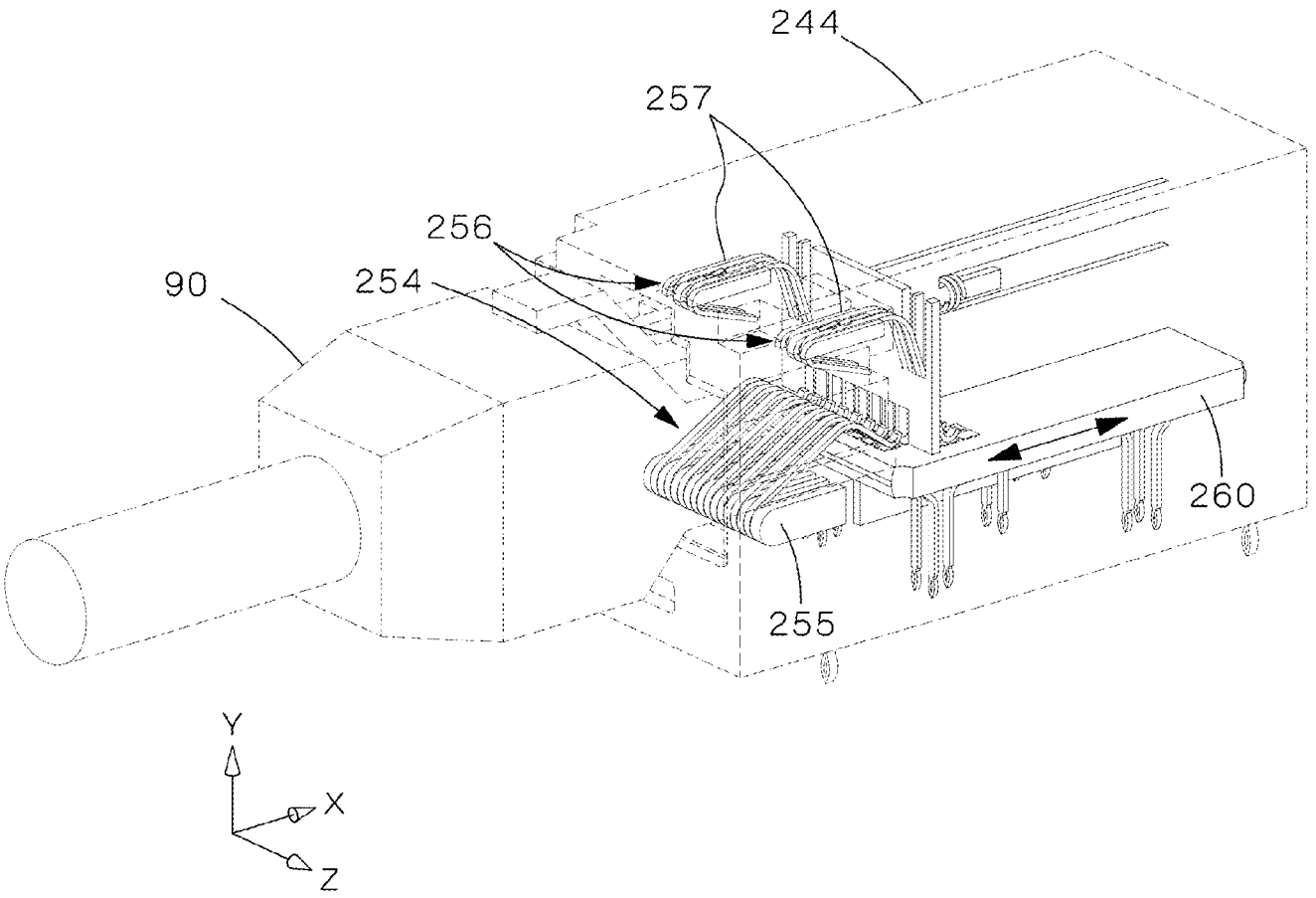
FIG. 21B illustrates the jack of FIG. 21A mated with an ARJ45 plug.

As shown in FIGS. 21A and 21B, the jack 244 is provided with twelve plug interface contacts (PICs $\mathbf{254}_{1\text{-}8}$ and PICs $\mathbf{256}_{3\text{-}6}$) which are at least partially held in place with dielectric structures 255, 257. The PICs 254 and 256 are positioned such that their proximal ends contact the plug contacts of a plug, and their distal ends make contact with contact pads on the PCB 260. PICs $\mathbf{254}_1$ through $\mathbf{254}_8$ are arranged in a fashion to mate with a traditional RJ45 plug, and each subscript number corresponds to the plug contact number of a plug having its plug contacts laid out in accordance with ANSI/TIA-568-C.2. PICs $\mathbf{254}_1$, $\mathbf{254}_2$, $\mathbf{254}_7$, and $\mathbf{254}_8$ are also arranged to mate with four of the eight plug contacts of an ARJ45 plug. The remaining four plug contacts of an ARJ45 plug mate with PICs $\mathbf{256}_3$, $\mathbf{256}_4$, $\mathbf{256}_5$, and $\mathbf{256}_6$.

Figure 22:
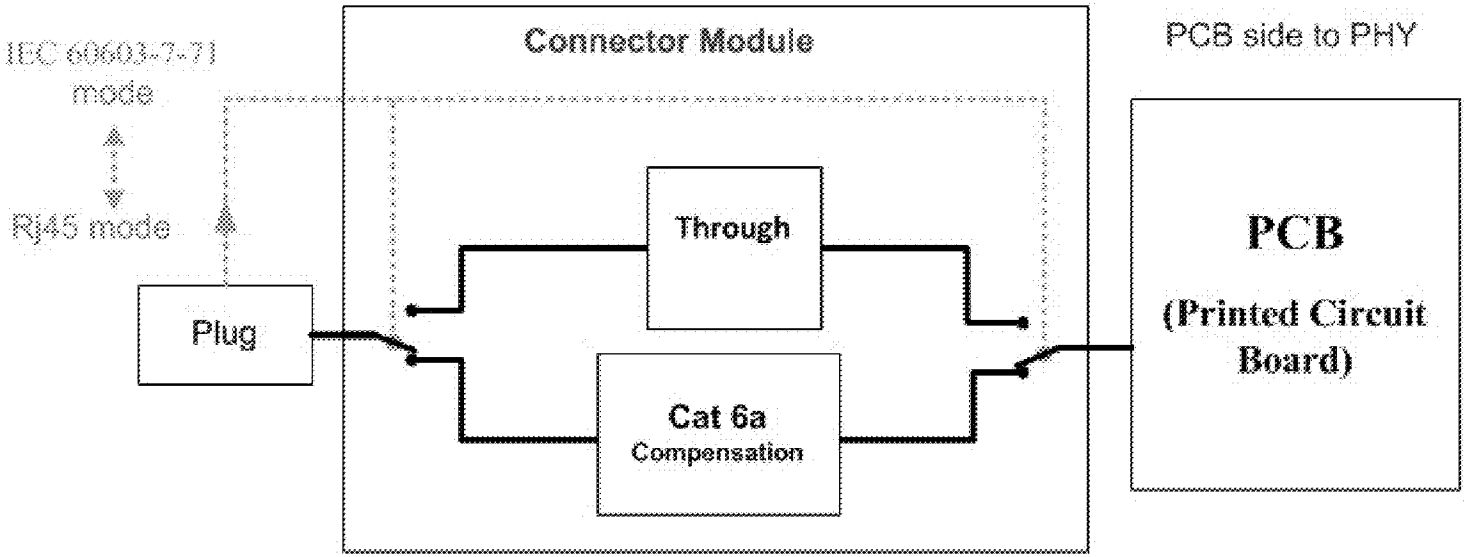
FIG. 22 illustrates a simplified schematic representation of a plug/jack/PHY combination according to an embodiment of the present invention.

The switching between the RJ45 and ARJ45 functionality states of the jack 244 is achieved primarily by incorporating independent circuits on the PCB 260 and switching between those circuits by moving the PCB 260 in a generally horizontal (longitudinal) direction along the x-axis, as shown in FIGS. 21A and 21B. Each circuit provides an electrical path from appropriate PICs to respective connector pins. A simplified exemplary schematic representation of the separation of the two circuits is shown in FIG. 22.

Figure 23:
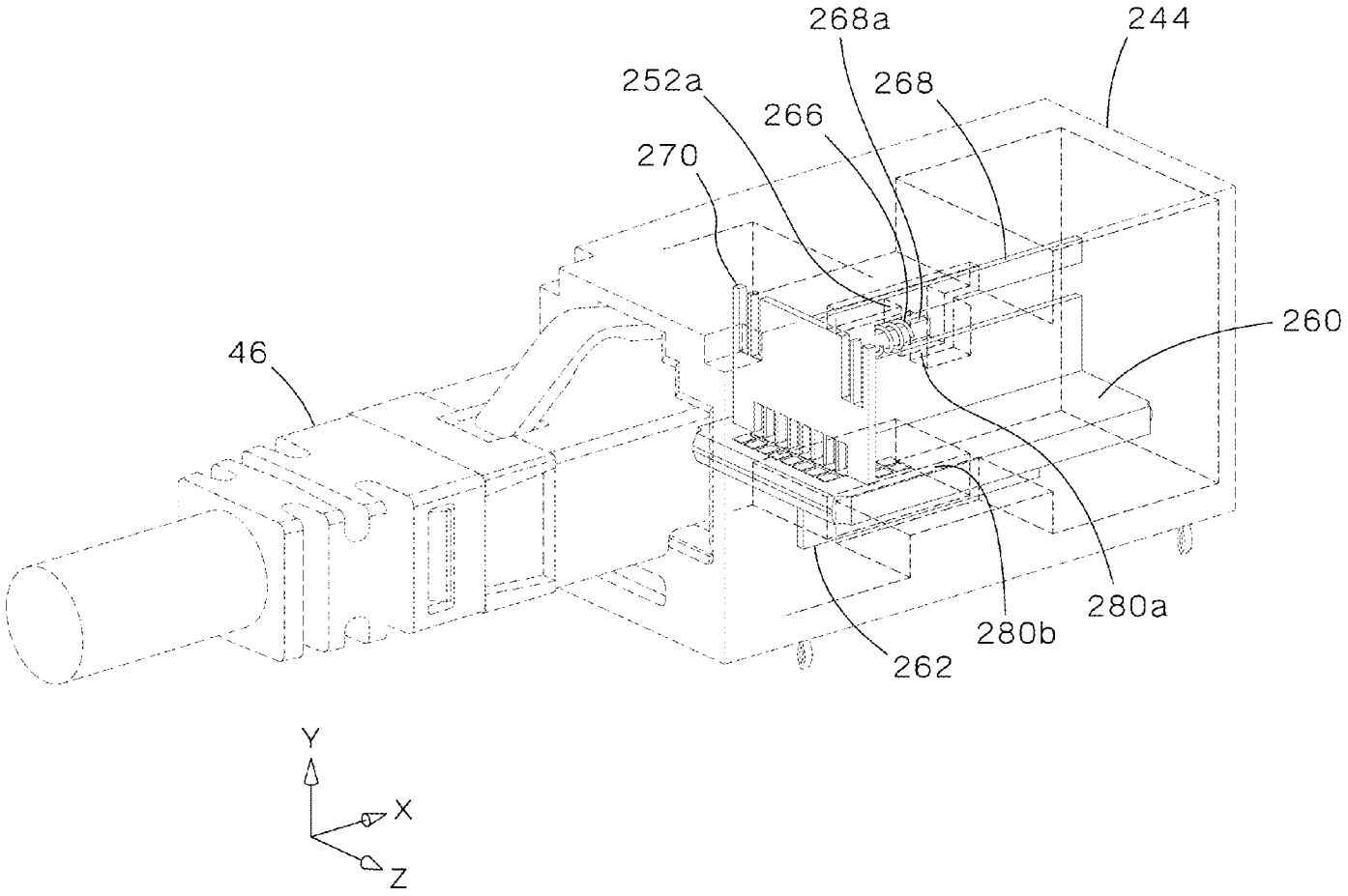
FIG. 23 illustrates internal positioning of the PCB and dividers within the jack of FIG. 20 according to an embodiment of the present invention.

To achieve the necessary switching, PCB 260 incorporates a switching plate 270 (preferably made from a dielectric material such as, but not limited to, plastic) and dividers 262,268 which allow the PCB to be pushed and guided along an appropriate path. Dividers 262,268 are comprised of a top divider 268 and a bottom divider 262. Preferably, the dividers are made from a material which has electromagnetic shielding properties, and in some embodiments the dividers are metal. As shown in FIG. 23, when the jack 244 is assembled, the top divider 268 is partially positioned within guide path 280*a* and the bottom divider 262 is partially positioned in within guide path 280*b*. The top divider 268 includes a protrusion 268*a* which acts as a post for the spring 266. When the top divider 268 is positioned within the guide path 280*a*, the spring 266 becomes trapped between the retention wall 252*a* and the divider 268, and biases the divider 268 along with the PCB 260 towards the front of the jack 244. This retains the PCB 260 in a forward position at all times except for when an ARJ45 plug is inserted.

In addition to guiding the PCB 260, dividers 262,268 help with crosstalk reduction. In order to maintain some level of isolation between the four signal pairs and reduce unwanted crosstalk therebetween in the middle and rear sections of the jack 244, dividers 262 and 268 are assembled and positioned between some of the four signal pairs. Grounding the dividers (when the dividers are metal) may help maintain the continuity of a shield from the plug cable to the jack and therethrough, and reduce undesired crosstalk. Note that selection of the materials for the PCB 260 may also factor into the amount of crosstalk which exists within the jack since various dielectric materials may reduce some levels of undesired crosstalk.

Figure 24:
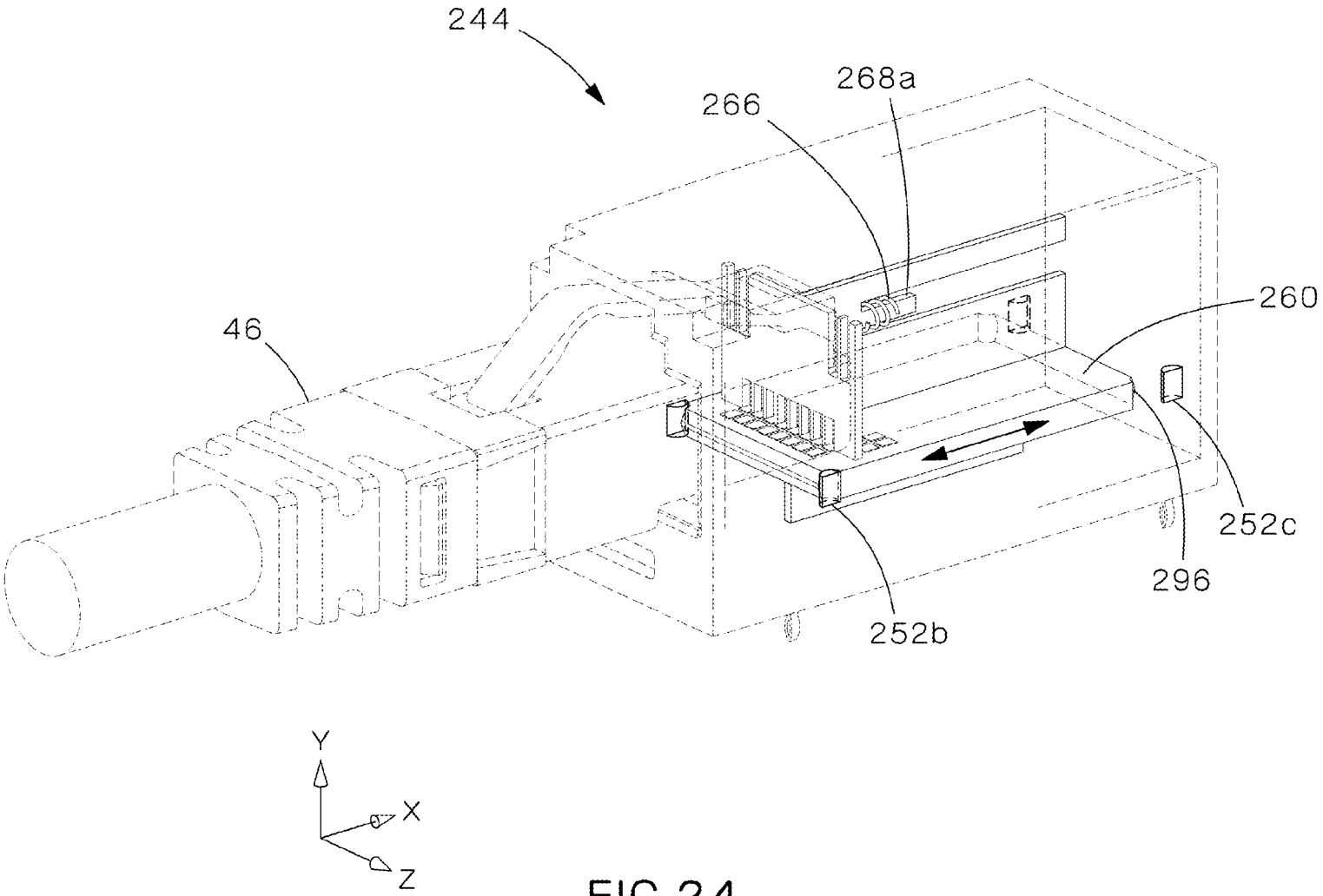
FIG. 24 illustrates the means for restraining the forwards/backwards movement of the PCB within the jack of FIG. 20 according to an embodiment of the present invention.

To retain the PCB 260 within certain bounds along the x-axis, front stops 252*b* and rear stops 252*c* are positioned on the inside of the jack 244. Referring to FIG. 24, the stops 252*b* and 252*c* are positioned approximately on the same plane as the PCB 260 and are designed to come in contact with the corners 296 of the PCB 260. The front stops 252*b* limit the amount of forward displacement that the PCB 260 may undergo. Thus, when the PCB 260 is biased forward via the spring 266, it rests against the front stops 252*b* in a forward position. The rear stops 252*c* limit the amount of rearward displacement that the PCB 260 may undergo when the PCB 260 is moved back. Thus, when an appropriate plug (e.g., an ARJ45 plug) is inserted into the jack 244 and that plug pushes the PCB 260 into its second position, the rear stops 252*c* prevent the PCB 260 from moving too far by having the rear corners 296 rest against the stops 252*c*. When that plug is removed, the spring 266 causes the PCB 260 to again move into its forward position and once again engage the front stops 252*b*. Stops 252*b* and 252*c* may help ensure that the PICs and connector pins contact the appropriate contact pads on the PCB 260.

Figure 25A:
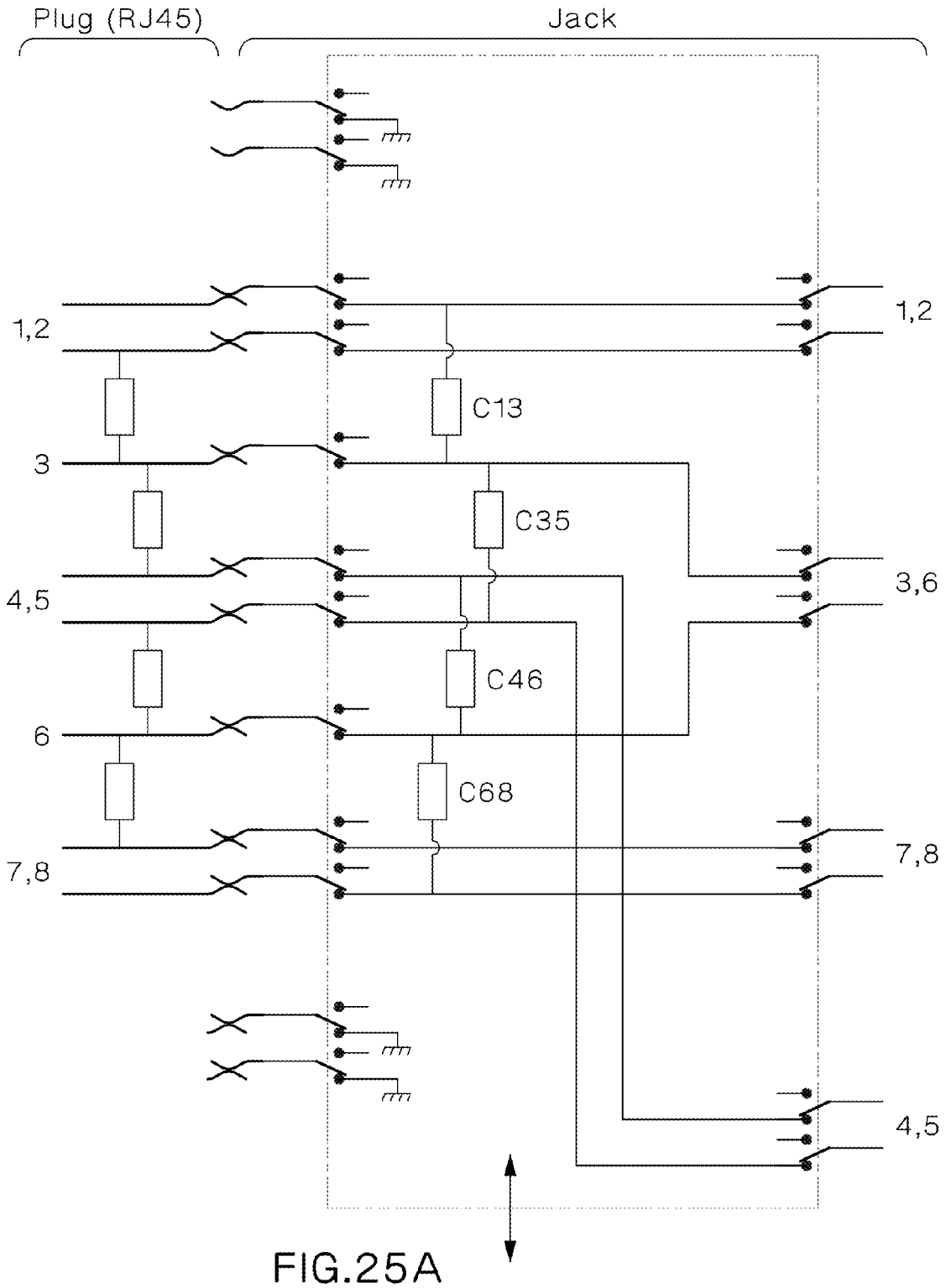
FIG. 25A illustrates a simplified schematic representation of an RJ45 plug mated to a first circuit of the jack of FIG. 20 according to an embodiment of the present invention.
Figure 25B:
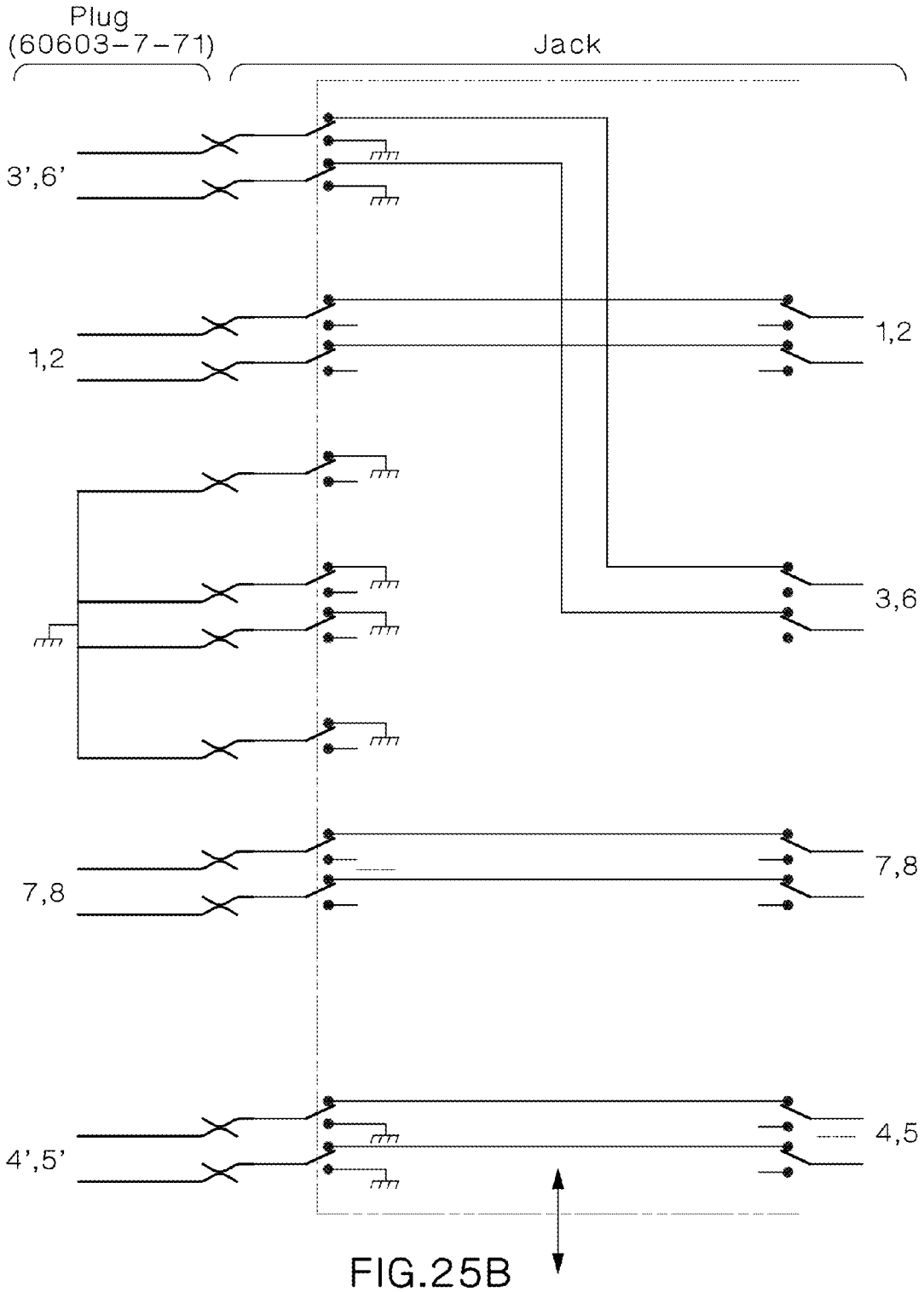
FIG. 25B illustrates a simplified schematic representation of an ARJ45 plug mated to a second circuit of the jack of FIG. 20 according to an embodiment of the present invention.
Figure 26A:
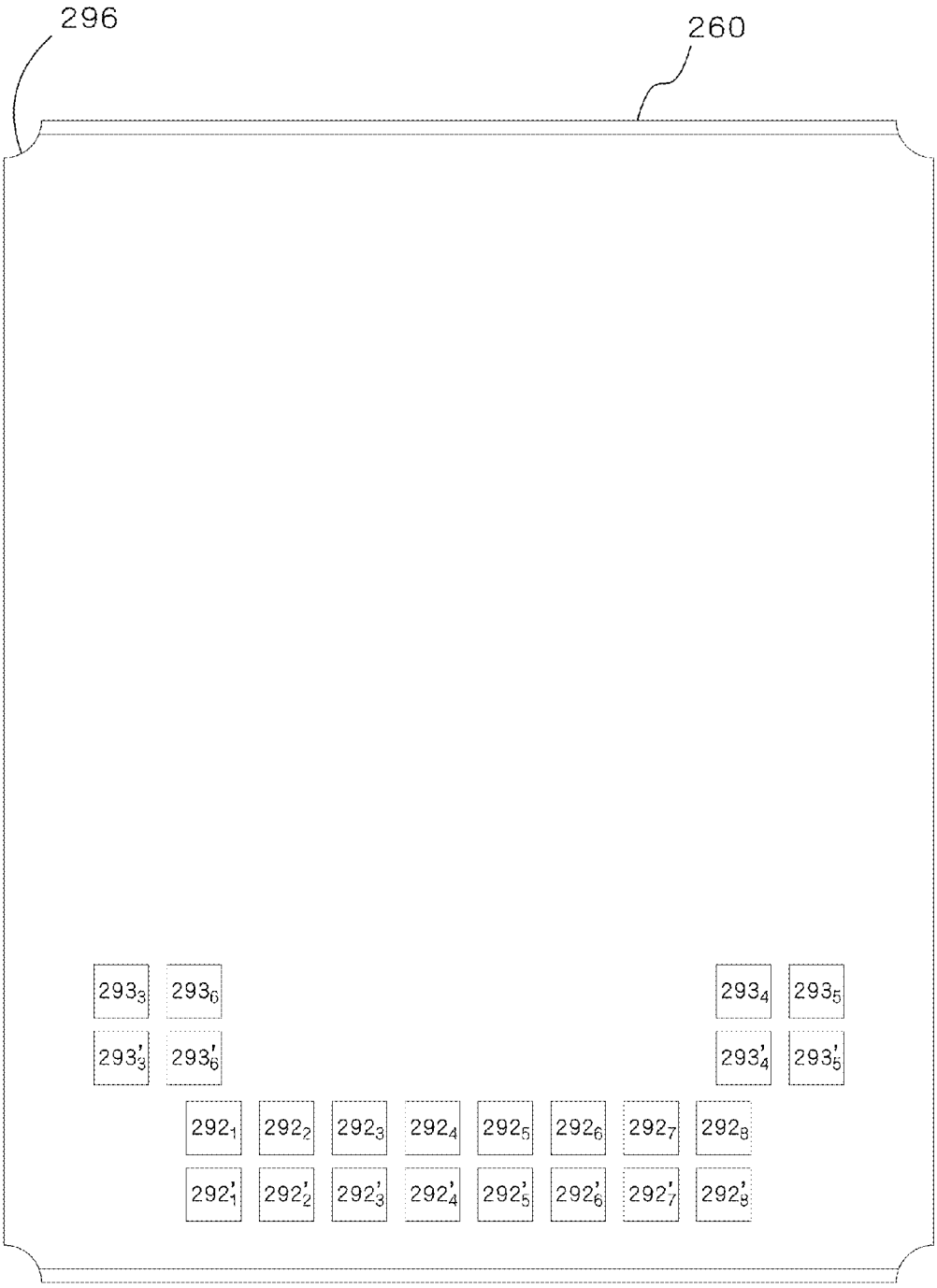
FIG. 26A illustrates a top view of a PCB, which may be used within the jack of FIG. 20, according to an embodiment of the present invention.
Figure 26B:
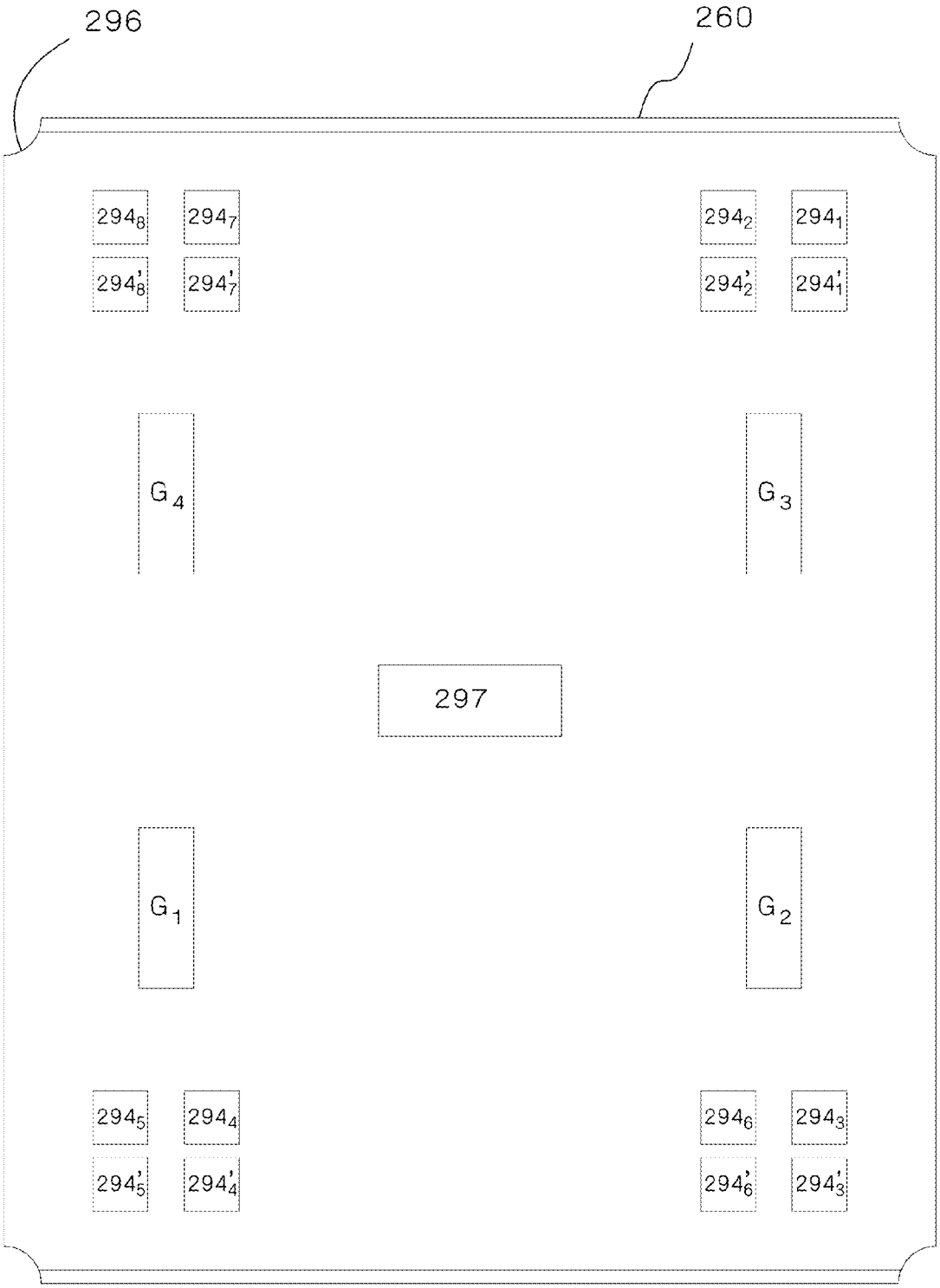
FIG. 26B illustrates a bottom view of the PCB of FIG. 26A

One embodiment of the PCB 260 together with a corresponding arrangement of the PICs is shown in FIGS. 25A-28C. In this embodiment, the PCB 260 is provided with two separate circuits; the first circuit is used for RJ45 connectivity and the second circuit is used for ARJ45 connectivity. FIGS. 25A and 25B illustrate schematic representations of these circuits, respectively. Note that not all circuit elements are shown, and instead only active signal paths between the PICs and the connector pins are represented. As shown in the top and bottom views of the PCB 260 shown in FIGS. 26A and 26B, the first circuit comprises contact pads $\mathbf{292}_1$-$\mathbf{292}_8$, $\mathbf{293}_3$-$\mathbf{293}_6$, and $\mathbf{294}_1$-$\mathbf{294}_8$. Contact pads $\mathbf{292}_1$-$\mathbf{292}_8$ are designed to contact the distal ends of the PICs $\mathbf{254}_1$-$\mathbf{254}_8$, respectively, and provide an electrical path to contact pads $\mathbf{294}_1$-$\mathbf{294}_8$ which are designed to contact connector pins $\mathbf{276}_1$-$\mathbf{276}_8$. Contact pads $\mathbf{293}_3$-$\mathbf{293}_6$ are designed to contact the distal ends of PICs $\mathbf{256}_3$-$\mathbf{256}_6$, respectively, and are grounded through the PCB 260.

Figure 27A:
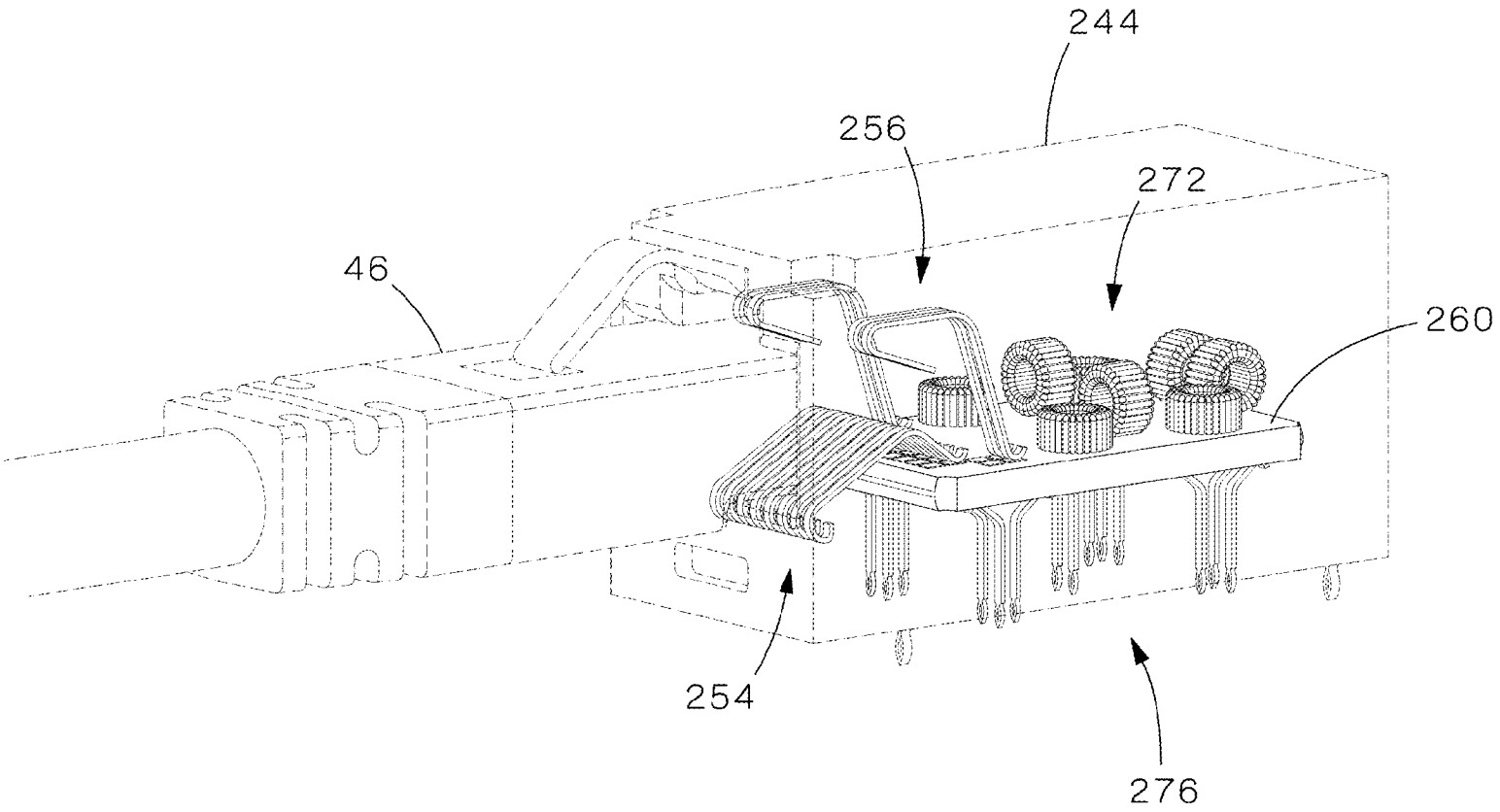
FIG. 27A illustrates an isometric view of the jack of FIG. 20 with a PCB of FIG. 26A mated with an RJ45 plug.
Figure 27B:
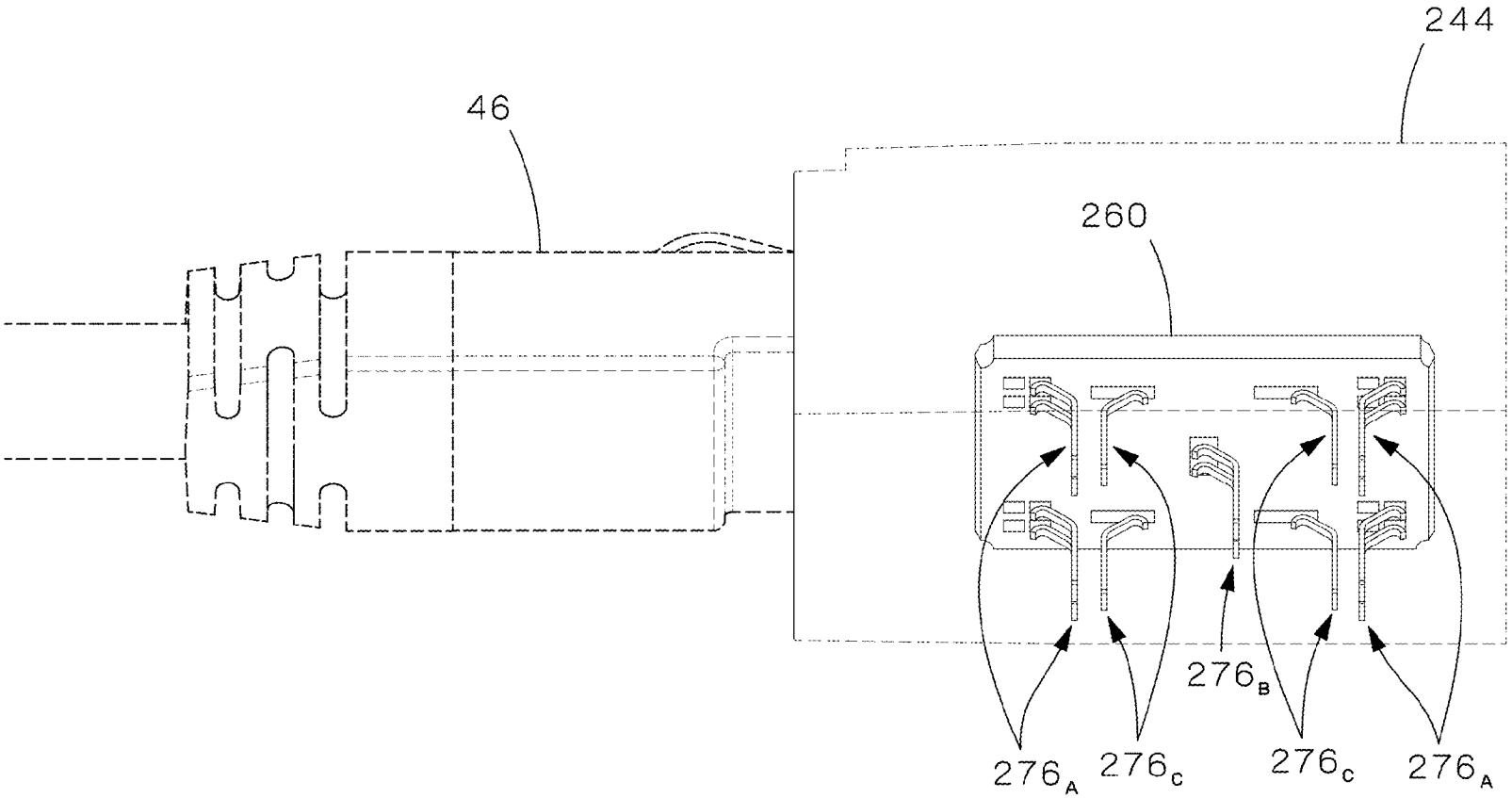
FIG. 27B illustrates a bottom isometric view of the jack/plug combination of FIG. 27A.
Figure 27C:
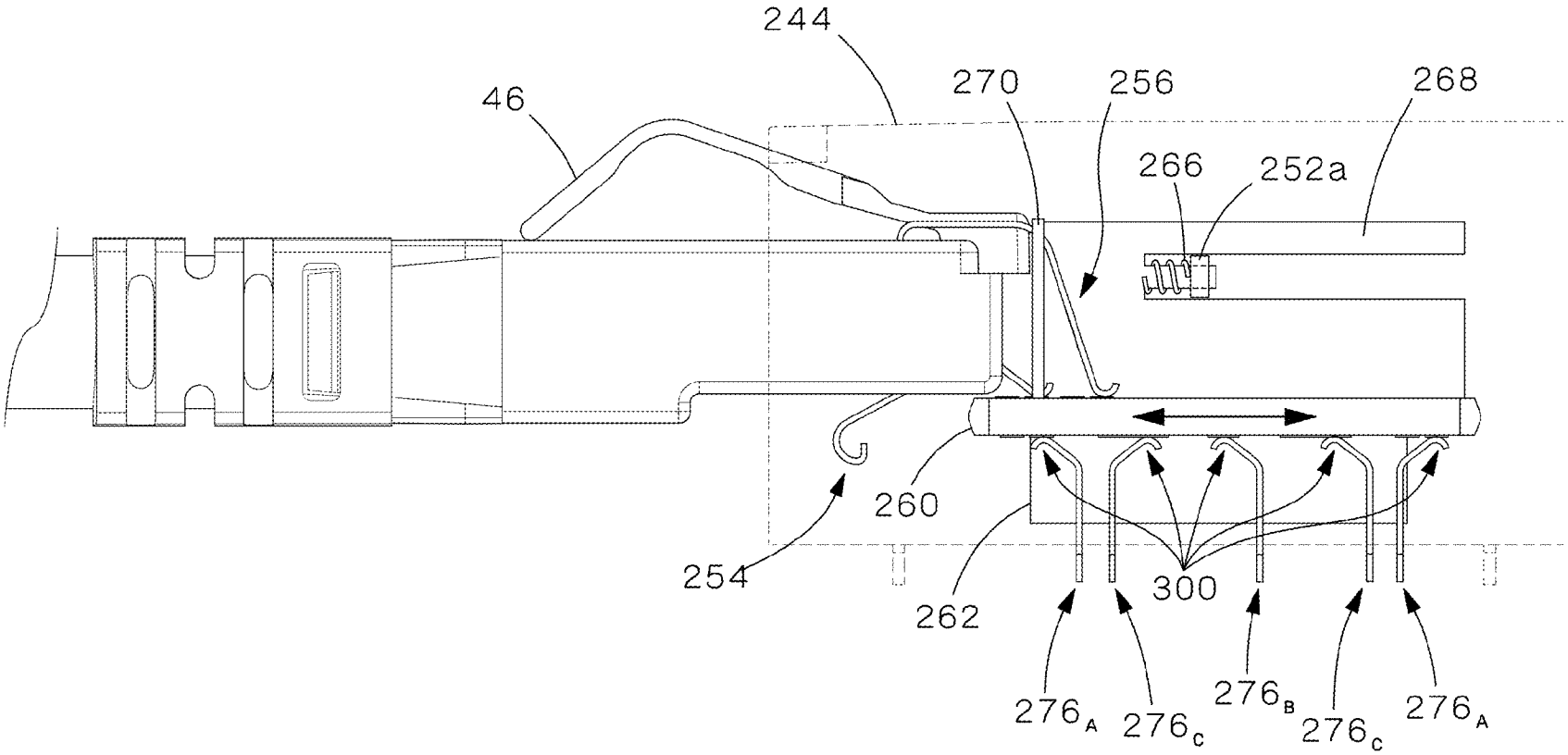
FIG. 27C illustrates a cross-sectional view of the jack/plug combination of FIG. 27A.

Referring to FIGS. 27A-27C, the first circuit is activated when there is no plug inserted into jack 244 or when an RJ45 plug is inserted. In this state, spring 266 forces PCB 260 forward where contact pads $\mathbf{292}_1$-$\mathbf{292}_8$ on the top side of the PCB 260 are in alignment with the distal ends of the PICs $\mathbf{254}_{1\text{-}8}$. The same positioning of the PCB 260 also causes the connector pin contact pads $\mathbf{294}_{1\text{-}8}$ to also align with the distal ends of the connector pins $\mathbf{276}_{A1\text{-}A8}$, respectively.

When an RJ45 plug 46 is inserted into jack 244, the plug contacts engage the PICs $\mathbf{254}_{1\text{-}8}$ in the jack 244 and thereby establish continuity between the plug 46 and the equipment on which the jack 244 is mounted on. As is typical in RJ45 jacks (e.g., CAT6A), various crosstalk compensation techniques may be used to counteract the inherent crosstalk that exists in an RJ45 plug. This compensation circuitry, which may include discrete and/or distributed capacitive and/or inductive elements between conductors (e.g., C13, C35, C46 and C68 shown schematically in FIG. 25A), may be realized on internal and/or external layers of the PCB 260. Other compensation elements which help optimize return loss, far-end crosstalk, balance, and etc. can also be included. In some instances, while the jack 244 is engaged with an RJ45 plug 46, the unused PICs $\mathbf{256}_3$, $\mathbf{256}_4$, $\mathbf{256}_5$, and $\mathbf{256}_6$ can introduce unintended coupling and crosstalk between signal pairs in the jack 244. To help reduce or prevent this unintended coupling and crosstalk from occurring, PICs $\mathbf{256}_{3\text{-}6}$ are grounded by way of contact pads $\mathbf{293}_3$-$\mathbf{293}_6$ on the PCB 260, which are connected to a grounding source.

In addition to the aforementioned compensation components, the first circuit used for the RJ45 mode of operation can include one or more various magnetics modules 272 (e.g., transformers, inductors, or the like). Those skilled in the art will recognize the need for the magnetics elements when using the jack on various kinds equipment. A $V_{cc}$ or a center tap signal can be added to convene the PHY's need for DC Biasing of the data signals. Biasing is typically needed for driving differential pairs in the PHY. It is used as a method of establishing predetermined voltages and/or currents to set an appropriate operating point. The DC Biasing signal can be inserted into the circuit using center taps on the magnetic modules in the RJ45 operation mode. Furthermore, an On/Off switch comprised of the contact pad 297 and connector pins $\mathbf{276}_{B1}$ and $\mathbf{276}_{B2}$ is included in the currently described embodiment to indicate to the PHY the type of the plug inserted to the jack. When in the RJ45 mode of operation, the connector pins $\mathbf{276}_{B1}$ and $\mathbf{276}_{B2}$ are in contact with the contact pad 297; when not in the RJ45 mode of operation, the connector pins $\mathbf{276}_{B1}$ and $\mathbf{276}_{B2}$ lose contact with the contact pad 297. In other words, the On/Off switch acts as an operation mode indicator for the PHY. This may allow the PHY to detect the mode of operation to utilize the correct compensation/correction or data processing schemes.

The second circuit on the PCB 260 comprises contact pads $\mathbf{292'}_1$-$\mathbf{292'}_8$, $\mathbf{293'}_3$-$\mathbf{293'}_6$, and $\mathbf{294'}_1$-$\mathbf{294'}_8$. As in the first circuit, contact pads $\mathbf{292'}_1$-$\mathbf{292'}_8$ contact the distal ends of the PICs $\mathbf{254}_1$-$\mathbf{254}_8$, respectively. However, of those, only contact pads $\mathbf{292'}_1$, $\mathbf{292'}_2$, $\mathbf{292'}_7$, and $\mathbf{292'}_8$ provide an electrical path to pads $\mathbf{294'}_1$, $\mathbf{294'}_2$, $\mathbf{294'}_7$, and $\mathbf{294'}_8$. The remaining contact pads $\mathbf{292'}_3$, $\mathbf{292'}_4$, $\mathbf{292'}_5$, and $\mathbf{292'}_6$ can be grounded through the PCB 260. As for contact pads $\mathbf{293'}_3$-$\mathbf{293'}_6$, these pads contact the distal ends of PICs $\mathbf{256}_3$-$\mathbf{256}_6$, respectively, and in this case provide an electrical path to pads $\mathbf{294'}_3$, $\mathbf{294'}_4$, $\mathbf{294'}_5$, and $\mathbf{294'}_6$.

Figure 28A:
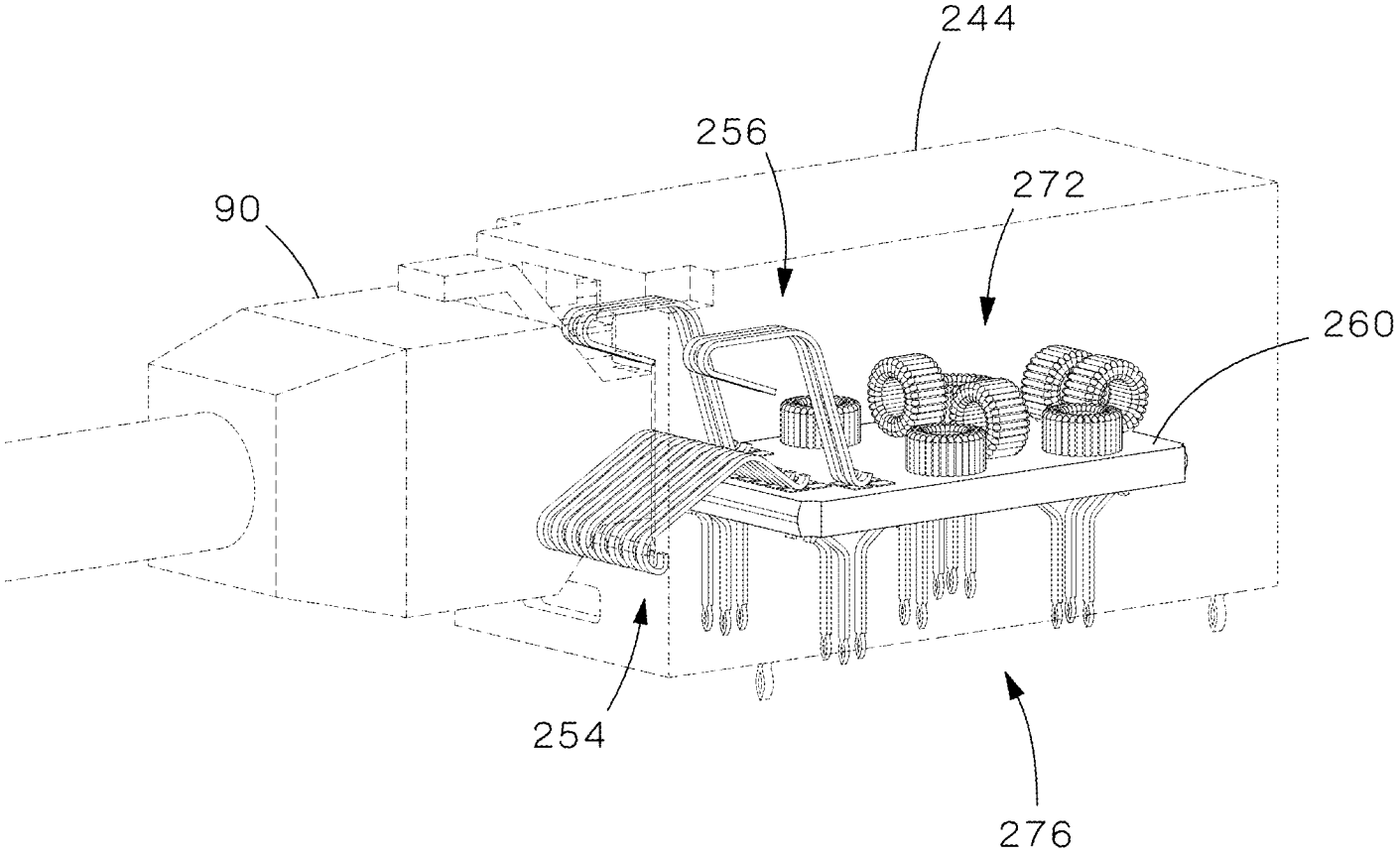
FIG. 28A illustrates an isometric view of the jack of FIG. 27A mated with an ARJ45 plug.
Figure 28B:
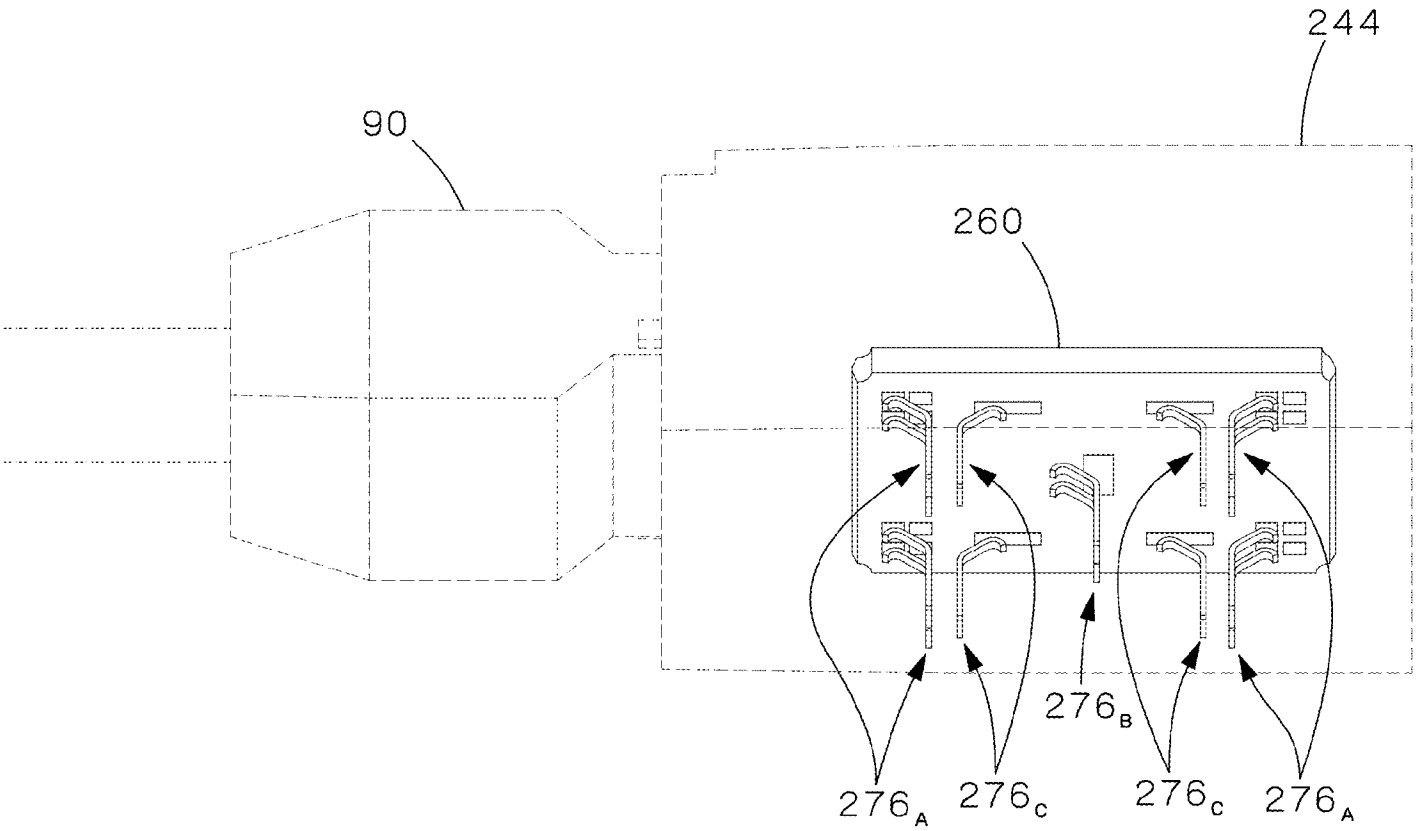
FIG. 28B illustrates a bottom isometric view of the jack/plug combination of FIG. 28A.
Figure 28C:
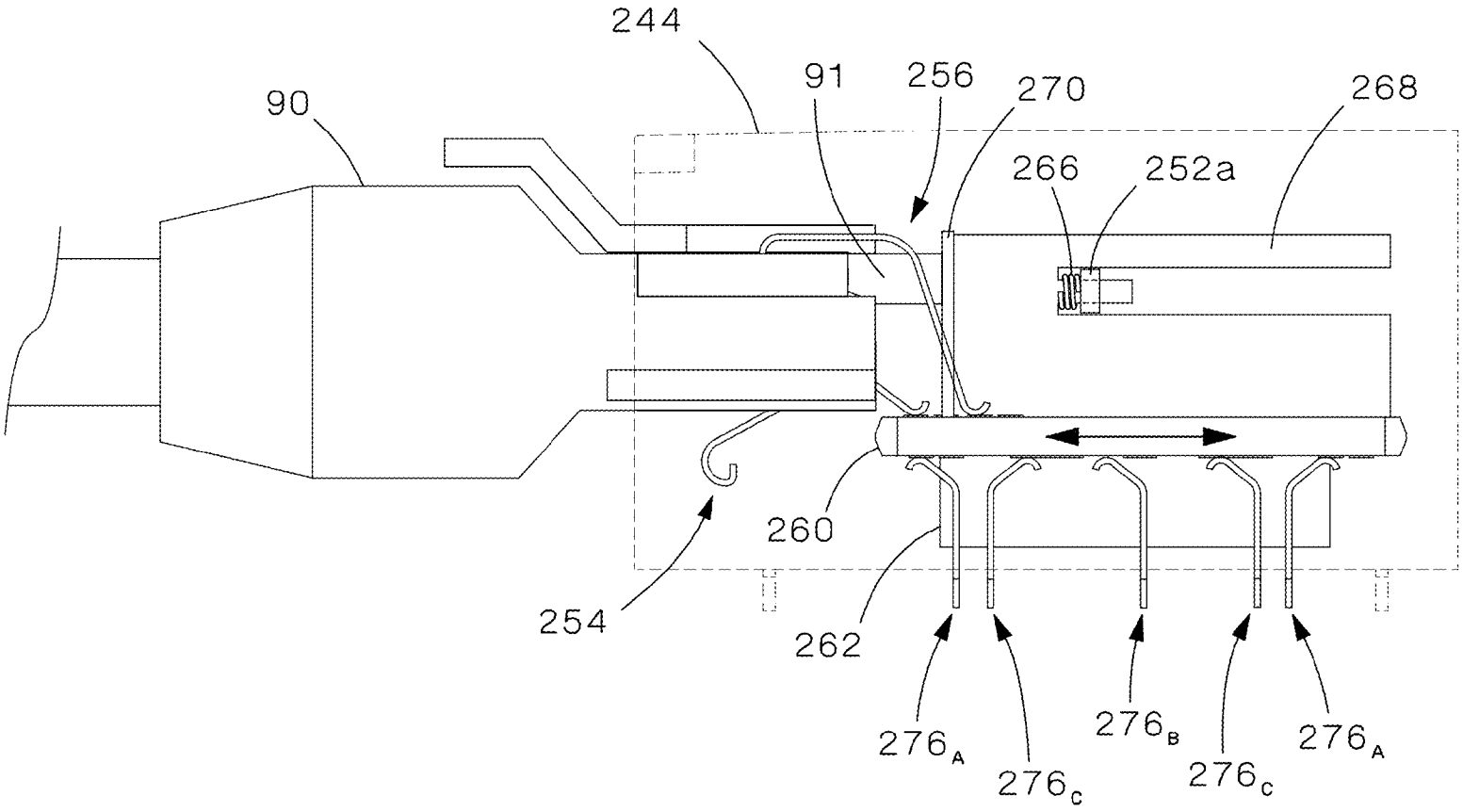
FIG. 28C illustrates a cross-sectional view of the jack/plug combination of FIG. 28A.

With reference to FIGS. 28A-28C, when an ARJ45 style plug 90 is inserted into the jack 244 the nose feature 91 on the front of the plug engages the switching plate 270 mounted to the PCB 260. As plug 90 is inserted further into the jack 244, the nose feature 91 applies force against the switching plate 270, and displaces the plate 270 and the PCB 260 horizontally in a rearward direction.

As the PCB 260 travels into its rearward position, the PICs $\mathbf{254}_{1\text{-}8}$ and $\mathbf{256}_{3\text{-}6}$, and connector pins $\mathbf{276}_{1\text{-}8}$ lose contact with contact pads $\mathbf{292}_1$-$\mathbf{292}_8$, $\mathbf{293}_3$-$\mathbf{293}_6$, and $\mathbf{294}_1$-$\mathbf{294}_8$, and instead come into contact with contact pads $\mathbf{292'}_1$-$\mathbf{292'}_8$, $\mathbf{293'}_3$-$\mathbf{293'}_6$, and $\mathbf{294'}_1$-$\mathbf{294'}_8$, respectively. Once the ARJ45 jack is fully inserted into the jack 244, contact pads $\mathbf{292'}_1$-$\mathbf{292'}_8$, $\mathbf{293'}_3$-$\mathbf{293'}_6$, and $\mathbf{294'}_1$-$\mathbf{294'}_8$ on the PCB 260 should align with the distal ends of the PICs and the distal ends of the connector pins. Stops 252*c* prevent the PCB 260 from traveling beyond its intended position. At this point, plug contacts of the ARJ45 plug engage the PICs $\mathbf{254}_1$, $\mathbf{254}_2$, $\mathbf{256}_3$, $\mathbf{256}_4$, $\mathbf{256}_5$, $\mathbf{256}_6$, $\mathbf{254}_7$, and $\mathbf{254}_8$ in the jack 244 and thereby establish continuity between the plug 90 and the equipment to which the connector pins 276 are mounted to.

To reduce unintentional coupling and achieve improved return loss, insertion loss, and electrical balance performance at higher frequencies, contact pads $\mathbf{292'}_3$, $\mathbf{292'}_4$, $\mathbf{292'}_5$, and $\mathbf{292'}_6$, and thus PICs $\mathbf{254}_3$, $\mathbf{254}_4$, $\mathbf{254}_5$, and $\mathbf{254}_6$, are preferably grounded via the PCB 260.

By switching to a second circuit, the compensation circuitry that is used in the RJ45 operation mode is disconnected from the signal path under ARJ45 operation. Likewise, the magnetics components which can make up a part of the first circuit are also disconnected from the signal path. As such, separate independent circuitry may be employed on the second circuit if so desired. By having separate circuits, the compensation circuitry required during the RJ45 mode of operation and any accompanying magnetics have little to no impact on jack's 244 electrical performance while operating in the ARJ45 mode. This isolation may be advantageous when meeting the high bandwidth performance targets of jack 244. It may also be advantageous in providing the user with an ability to utilize the same jack across a wide range of operating frequencies while utilizing two separate circuits where each circuit can be optimized for a targeted frequency range of operation.

In addition to the elements described above, the second circuit may include a bias-tee component that can be utilized in the ARJ45 mode of operation to insert a DC biasing signals into the data signals. Furthermore, other components may be added to and/or included on the second circuit as deemed necessary by design requirements. For example, the second circuit may include isolation (DC blocking) components and upper band common-mode rejection components/magnetics. These elements would remain separate from the elements implemented on the first circuit.

Figure 29:
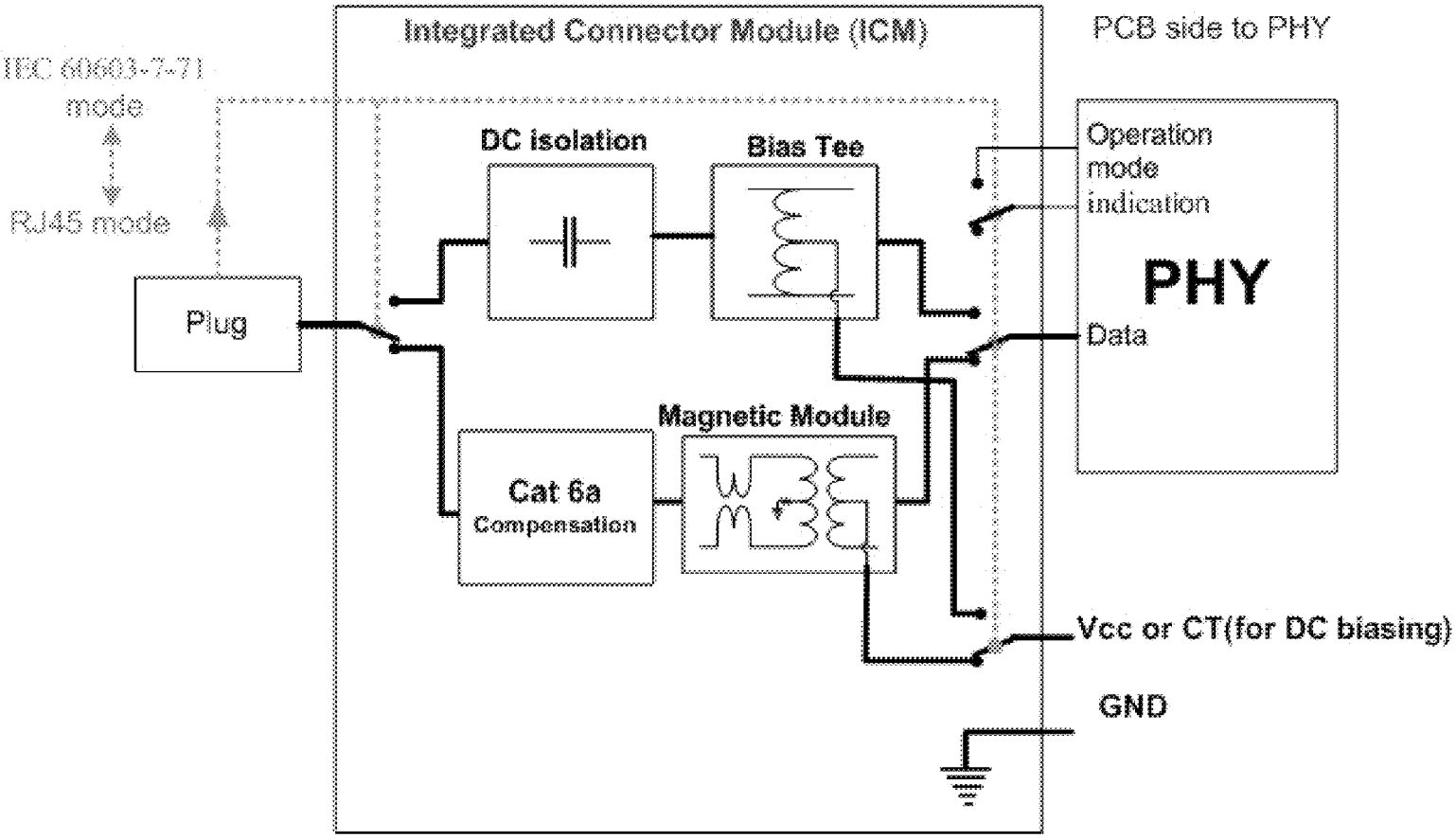
FIG. 29 illustrates a simplified schematic representation of a plug/jack/PHY combination according to another embodiment of the present invention.
Figure 30:
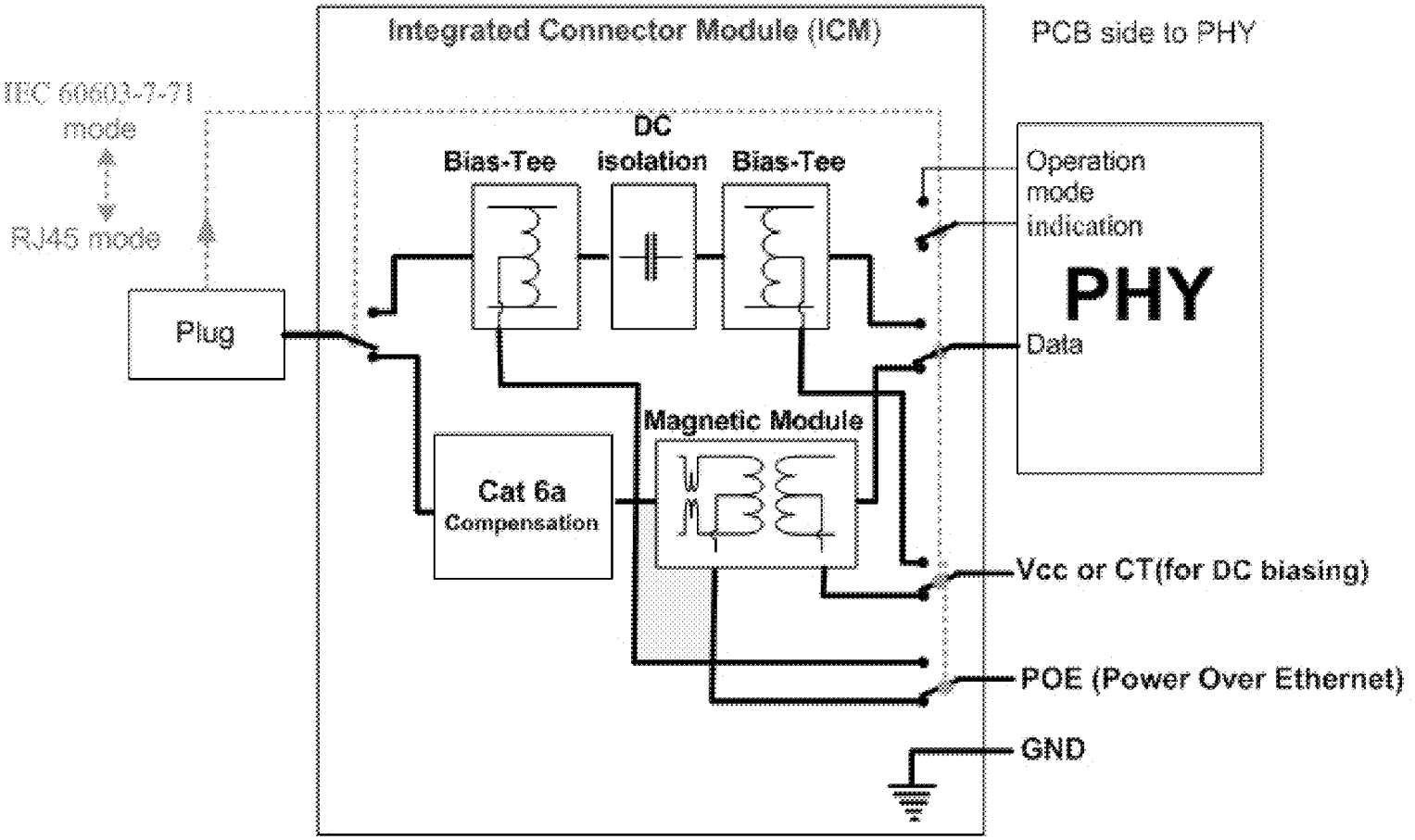
FIG. 30 illustrates a simplified schematic representation of a plug/jack/PHY combination according to yet another embodiment of the present invention.

FIGS. 29 and 30 illustrate exemplary schematic representations of two embodiments of the present invention. Both figures show the separation of circuits between the RJ45 and the ARJ45 modes of operation. In FIG. 29, the first circuit provides a path from the plug to the PHY via the CAT6a compensation circuitry and the one or more magnetic module, with an optional DC biasing component connected to the magnetic module. On the other hand, the second circuit provides a path from the plug to the PHY that bypasses all of the first circuit's components. In this embodiment, the second circuit includes a DC isolation component and a bias-tee component with an input for DC biasing. Similarly, in FIG. 30 both of the circuits comprise separate components and establish primarily separate data paths from the plug to the PHY. In the embodiment of FIG. 30, the first circuit includes a CAT6a compensation component and at least one magnetic module with a Power over Ethernet (POE) and a DC biasing input, and the second circuit includes a DC isolation component with two bias-tee components with one bias-tee receiving a POE input and the other bias-tee receiving a DC biasing input. Note that separating the circuits does not exclude the sharing of some components such as some of the PICs and the connector pins which may remain operational for both modes of operation.

In both modes of operation of jack 244, return loss, insertion loss, electrical balance, and/or other electrical performance characteristic may be further improved by providing grounded connector pins $\mathbf{276}_{C1\text{-}C4}$. To achieve this improvement, each of the grounded connector pins can be placed within certain proximity to each pair of the potentially data-carrying connector pins $\mathbf{276}_{A}$. Connector pins $\mathbf{276}_{C1\text{-}C4}$ remain in contact with contact pads $G_{1\text{-}4}$ regardless of the mode of operation and stay grounded via those contact pads and/or by way of connecting to a ground on the equipment to which the jack 244 is mounded to. Note that the dimensions of the grounded connector pins may vary in any number of ways. For example, the width of the grounded connector pins may be narrower than, equal to, or wide than any of the pairs of the potentially data-carrying connector pins which are positioned adjacent to any one of the grounded connector pins. Similarly, the dimensions of the grounded contact pads $G_{1\text{-}4}$ can be varied so as to accommodate the size of the grounded contact pins.

Preferably, PICs 254 and 256, and connector pins 276 are designed to be or resilient nature, causing the distal ends thereof to springingly press against the contact pads on the PCB 260. To help ensure a smooth transition between the contact pads, the distal ends of the PICs 254 and 256, and connector pins 276 are provided with curved feet 300 (see FIG. 27C) which may act as ramps. This design may help ensure a constant force on the contact pads and it may also help ensure that in the process of sliding on and off the contact pads of the PCB 260, contaminants or oxidation that may be present on the surface of the PCB 260 contact pads will be wiped away; thereby, providing a robust connection between the PICs and the contact pins.

Figure 31A:
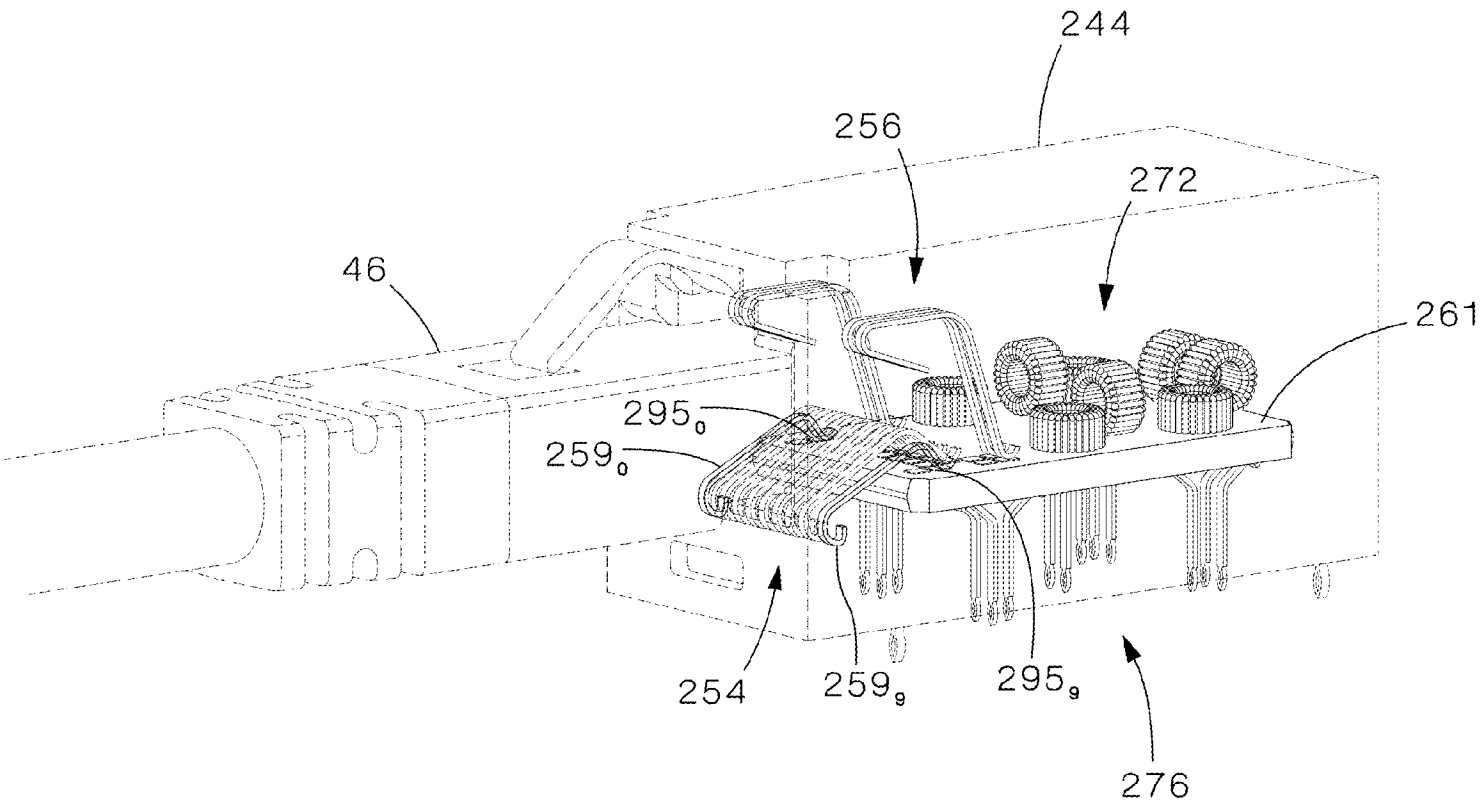
FIG. 31A illustrates an isometric view of another embodiment of a jack having another embodiment of the PCB therein mated with an ARJ45 plug.
Figure 31B:
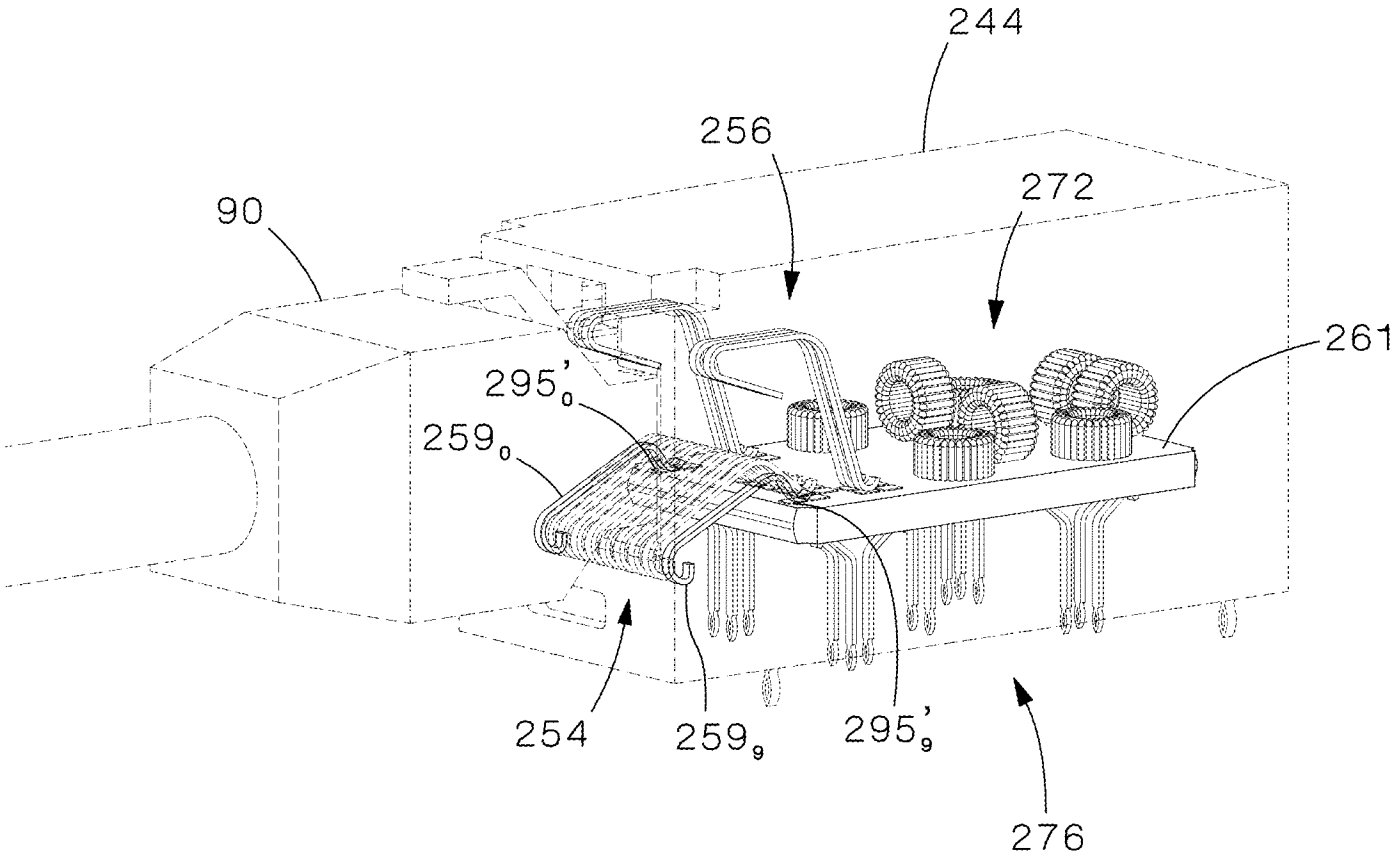
FIG. 31B illustrates the jack of FIG. 31A mated with an RJ45 plug.

Another embodiment of the present invention is illustrated in FIGS. 31A and 31B where a PCB 261 together with a corresponding arrangement of the PICs, including two additional contacts 259, is shown. While the entire jack 244 is not illustrated, one of ordinary skill in the art will understand that PCB 261 can substitute for the PCB 260 in the jack 244 and the additional contacts 259 may be implemented in a manner that is similar to the PICs 254 of the previously described embodiment.

The PCB 261 retains some features of the PCB 260, including all the contact pads of the previous embodiment and any potential interconnecting circuitry. Furthermore, the PCB 261 may be implemented with the same or similar magnetics components/configurations as described in the previous embodiments. However, PCB 261 includes additional contact pads $\mathbf{295}_0$, $\mathbf{295}_9$, $\mathbf{295'}_0$, and $\mathbf{295'}_9$ which are designed to contact the two additional contacts $\mathbf{259}_0$ and $\mathbf{259}_9$.

When operating PCB 260 in ARJ45 mode, PICs $\mathbf{254}_1$ and $\mathbf{254}_2$ are mated with their corresponding plug contacts of the ARJ45 plug and PIC $\mathbf{254}_3$ is connected to ground. With the position of PIC $\mathbf{254}_3$ being adjacent to PIC $\mathbf{254}_2$, an impedance discontinuity may occur. Even and odd mode impedance of PIC $\mathbf{254}_1$ will be inherently higher than PIC $\mathbf{254}_2$. This impedance discontinuity can results in an increase in electrical reflections at the plug/jack interface and an increase in mode conversion. The differential return loss, insertion loss, and crosstalk performance of signal-pair 1:2 may be degraded due to this inherent condition of the jack. Thus, to avoid these performance degradations, even and odd mode impedances of PICs $\mathbf{254}_1$ and $\mathbf{254}_2$ should be equal and matched to the characteristic impedance of the cable. By introducing contact $\mathbf{259}_0$, which is grounded in the ARJ45 mode of operation, adjacent to PIC $\mathbf{254}_1$ in the PCB 261 the impedances discontinuity may be reduced or otherwise eliminated. This can help provide a balanced configuration of ground conductors and signal conductors (Ground-Signal-Signal-Ground), which can become increasingly advantageous relative to signal integrity as the bandwidth increases.

A similar concern exists with PICs $\mathbf{254}_7$ and $\mathbf{254}_8$ in the ARJ45 mode of operation. PICs $\mathbf{254}_7$ and $\mathbf{254}_8$ are mated with their corresponding plug contacts of the ARJ45 plug and PIC $\mathbf{254}_6$ is grounded. With PIC $\mathbf{254}_6$ being adjacent to PIC $\mathbf{254}_7$, even and odd mode impedance of PIC $\mathbf{254}_8$ will be inherently higher than PIC $\mathbf{254}_7$. By adding an additional grounded contact $\mathbf{259}_9$ adjacent to PIC $\mathbf{254}_8$, a more balanced (Ground-Signal-Signal-Ground) configuration is created and performance degradations may be reduced or otherwise minimized.

To achieve the necessary grounding, the side contacts $\mathbf{259}_0$ and $\mathbf{259}_9$ are grounded through PCB contact pads $\mathbf{295'}_0$ and $\mathbf{295'}_9$ (which themselves are grounded through the PCB), respectively, which are engaged by the by the contacts $\mathbf{259}_0$ and $\mathbf{259}_9$ when the jack 244 is operating in the ARJ45 operating mode. Furthermore, the side contacts $\mathbf{259}_0$ and $\mathbf{259}_9$ are slightly offset relative to PICs $\mathbf{254}_{1\text{-}8}$ to allow the plug body to be fully inserted without interfering with or plastically deforming contacts $259_0$ and $259_9$. The plug body can also be beneficially modified to shield the side contacts $259_0$ and $259_9$.

Another possible use of contacts $259_0$ and $259_9$ is to incorporate them into the crosstalk compensation circuitry that is likely to be implemented when jack 244 is operating in the RJ45 mode. By grounding contacts $259_0$ and $259_9$ via contacts pads $295_0$ and $295_9$ (which are grounded via the PCB 261), those contacts may provide an additional way of reducing or minimizing the imbalance effect caused by the split pair 3:6 coupling to the signal pair 1:2 and the signal pair 7:8. Thus, balancing on the 1:2 and 7:8 signal pairs may be improved. Furthermore, since $295_0$, $295_9$, $295'_0$, and $295'_9$ are grounded, pads $295_0$ and $295'_0$ may be combined into a single contact pad which will be in contact with the contact $259_0$ regardless of the mode of operation, and pads $295_9$ and $295'_9$ may also be combined into a single contact pad which will also be in contact with the contact $259_9$ regardless of the mode of operation.

Figure 32:
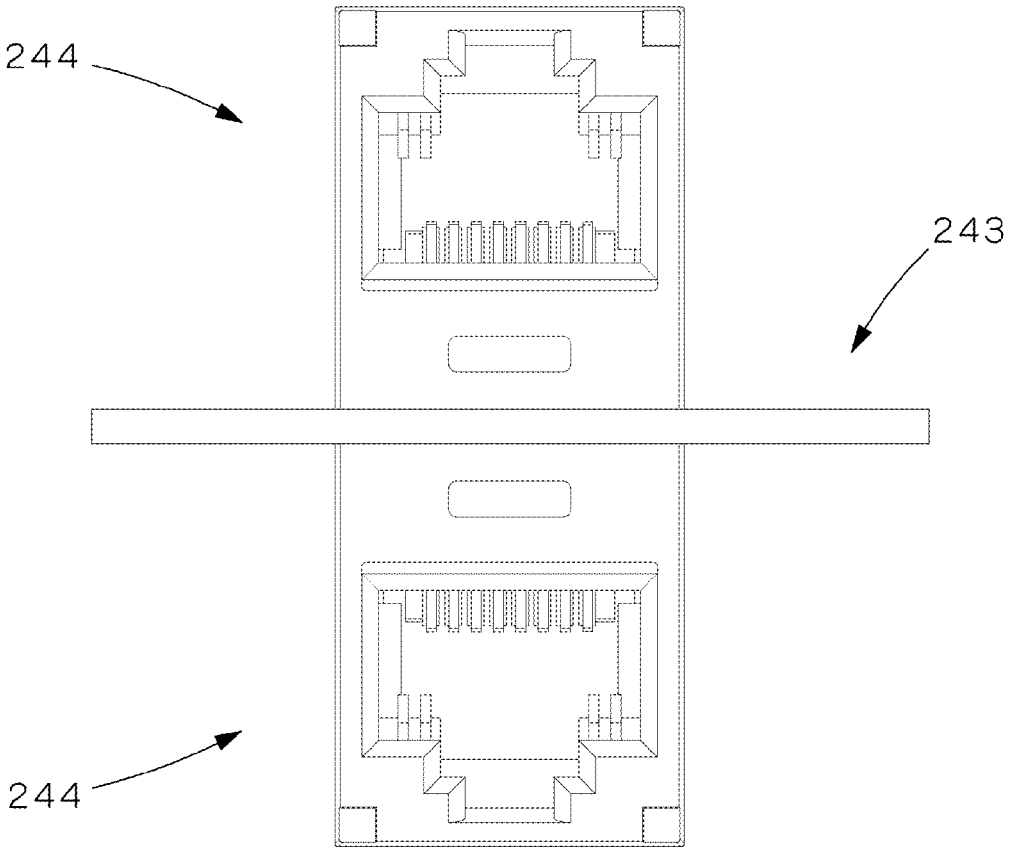
FIG. 32 illustrates an embodiment of a system according to an embodiment of the present invention.
Figure 33:
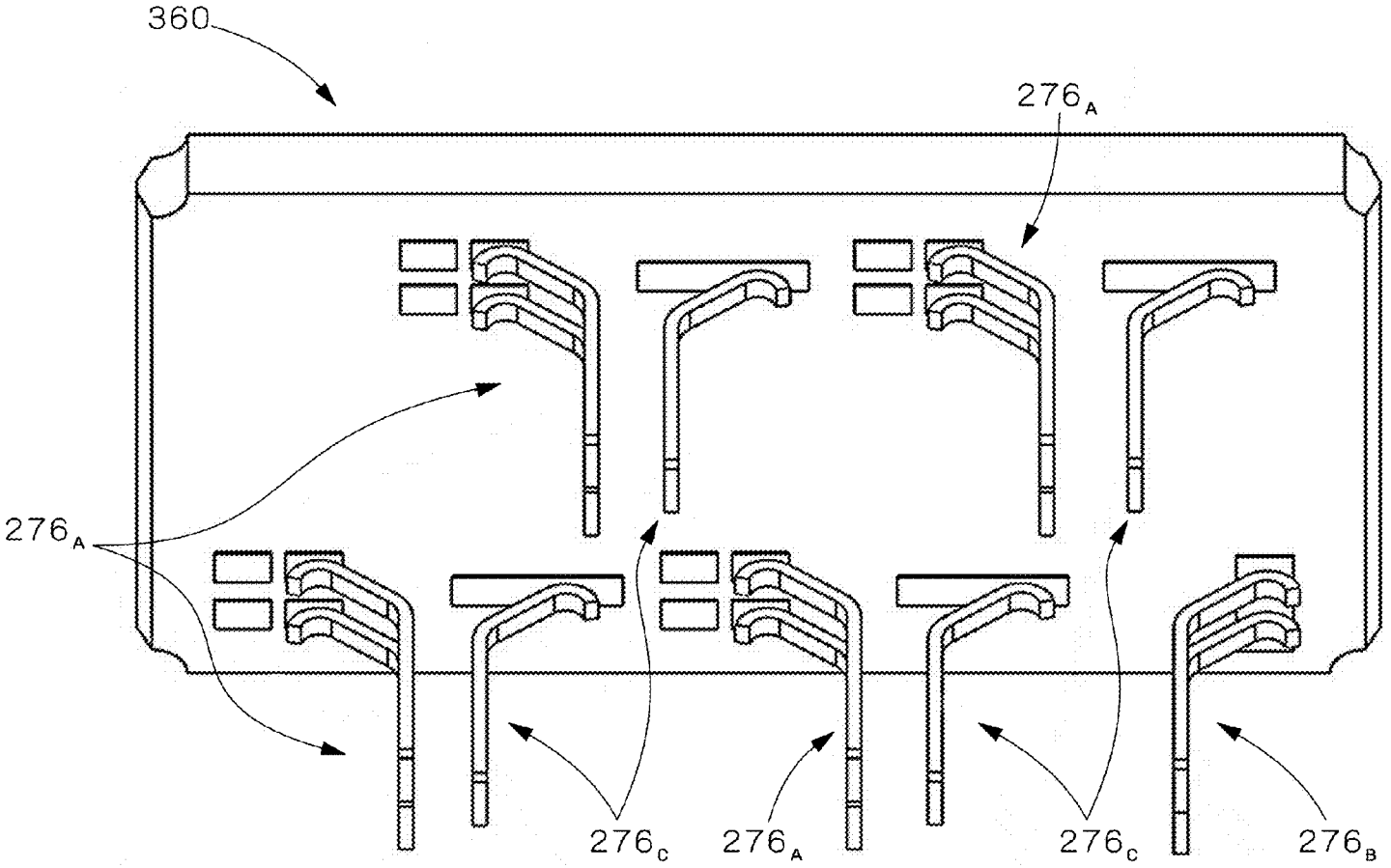
FIG. 33 illustrates a bottom view of a PCB and connector pin layout according to another embodiment of the present invention.

In another embodiment, the PCB which may be used in the jack 244 may have staggered connector pins. This arrangement may be useful when two jacks are positioned on an equipment circuit board opposite of each other as shown in FIG. 32. In this configuration, if the equipment circuit board if relatively thin, the contact pin arrangement shown in FIGS. 27B and 28B may cause a conflict between the top jack and the bottom jack. To avoid such interference, the contact pins (and accordingly the contact pads on the bottom side of the PCB) can be laid out in a staggered fashion, such that when two opposing jacks are mounted to the same circuit board over the same footprint, their contact pins do not interfere with each other. One embodiment of such a configuration is shown in FIG. 33, which shows the bottom view of a PCB 360. Separation between the connector pins could be increased or decreased depending on performance, space, or other requirements. The layout of the contact pads on the PCB 360 and the corresponding contact pin arrangement may be implemented in conjunction with any other embodiments described herein.

Figure 34:
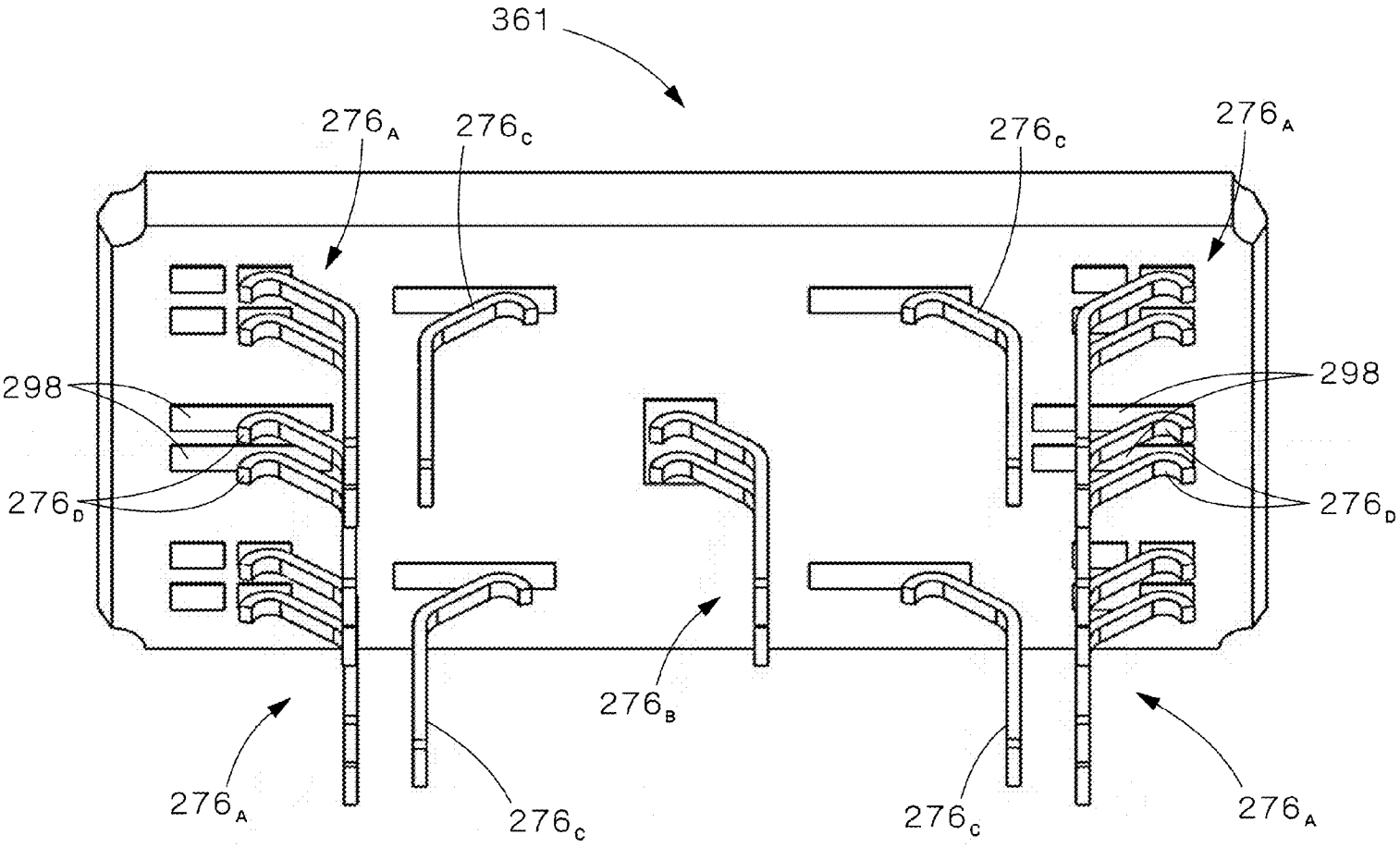
FIG. 34 illustrates a bottom view of a PCB and connector pin layout according to yet another embodiment of the present invention.

As noted previously, it is also possible to add POE functionality in certain embodiments of the present invention. When doing so, it may be necessary to provide a POE input/output to the various components of the jack. One example of achieving this is shown in FIG. 34. This figure shows an embodiment of a PCB 361 and a corresponding connector pin arrangement for use in the jack. Compared to the previous embodiments, PCB 361 includes four additional contact pads 298 which remain in contact with four connector pins $276_D$ regardless of the mode of operation. The additional connector pins $276_D$ and corresponding contact pads 298 can be used as a means to transmit/receive POE signals between the various components of the jack and the equipment on which it is mounted on.

Figure 35:
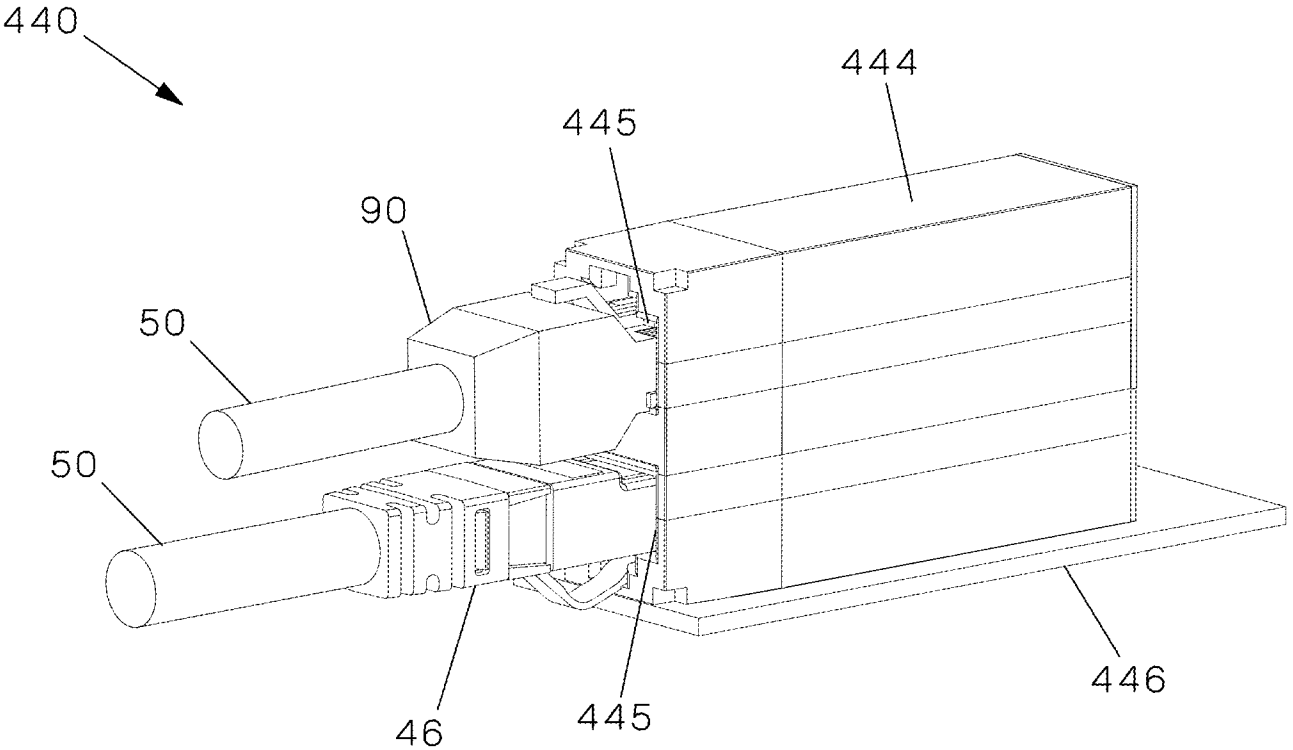
FIG. 35 illustrates a communication system according to an embodiment of the present invention.

Another exemplary embodiment of the present invention is illustrated in FIG. 35, which shows a copper structured cabling communication system 440. System 440 includes a duplex jack 444 mounted on an equipment/NIC card PCB 446. The jack 444 includes two plug receiving apertures 445, where the jack 444 can be mated to two plugs simultaneously. In the currently descried embodiment, the jack 444 can be mated with plugs having different form factors. FIG. 35 shows the jack 444 mated with an RJ45 plug 46 and an ARJ45 plug 90. Note that either of the apertures 445 can accept either plug style. Thus, while the ARJ45 plug 90 is illustrated as being mated with the top aperture, the same aperture can accept an RJ45 plug. Likewise, the bottom aperture can accept an ARJ45 plug. The represented communication system 440 is a typical application for this type of connector when used in a structured cabling environment such as a data center. When plugs 46,90 are mated with the jack 444, bidirectional communication can take place between communication cables 50 and the equipment PCB 446.

While the present embodiment is shown as used in the communication system 440 of FIG. 35, it can also be used in any suitable type of equipment, including passive equipment or active equipment. Examples of passive equipment include, but are not limited to, modular patch panels, angled patch panels, wall jacks, etc. Examples of active equipment include, but are not limited to, Ethernet switches, routers, servers, physical layer management systems, and Power-Over-Ethernet equipment as can be found in data centers/telecommunications rooms; security devices (cameras and other sensors, etc.) and door access equipment; and telephones, computers, fax machines, printers and other peripherals as can be found in workstation areas. Communication systems according to the present invention can further include cabinets, racks, cable management and overhead routing systems, and other such equipment.

Figure 36:
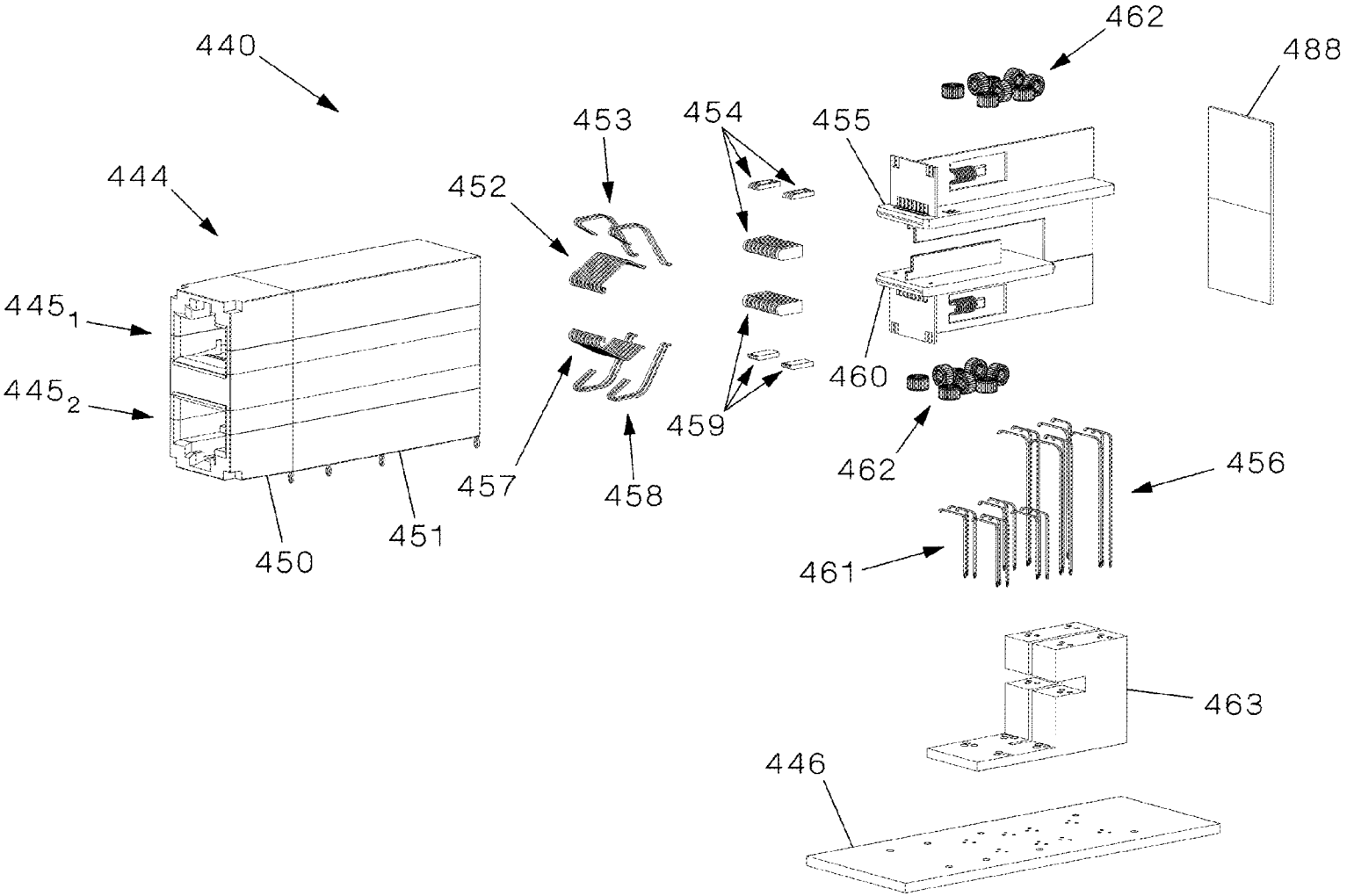
FIG. 36 illustrates an exploded view of a communication jack according to an embodiment of the present invention.

FIG. 36 shows an exploded view of the system 440 including the jack 444 and the equipment PCB 446. The jack 444 includes a front housing 450 and a rear housing 451. The housings 450 and/or 451 can be made from any conductive or semi-conductive material, including metal. Alternatively, the housing is made from plastic. The front housing 450 includes a first aperture $445_1$ and a second aperture $445_2$. Each aperture $445_1$ and $445_2$ can include conductive plug tabs to establish an electrical connection between the plug housing of a mated plug and the jack 444. Furthermore, each aperture $445_1$ and $445_2$ includes an associated set internal components. In particular, the first aperture $445_1$ is associated with a first set of lower PICs 452, a first set of upper PICs 453, a first set of support structures 454, a first jack PCB 455, and a first set of connector pins 456. The second aperture $445_2$ is associated with a second set of lower PICs 457, a second set of upper PICs 458, a second set of support structures 459, a second jack PCB 460, and a second set of connector pins 461. Each of the PCBs 455 and/or 460 can include magnetics components 462 mounted thereon. Those having ordinary skill in the art will be familiar with the use and implementation of such magnetics components. The jack 444 further includes a connector pin assembly 463 and a rear cover 488.

Figure 37:
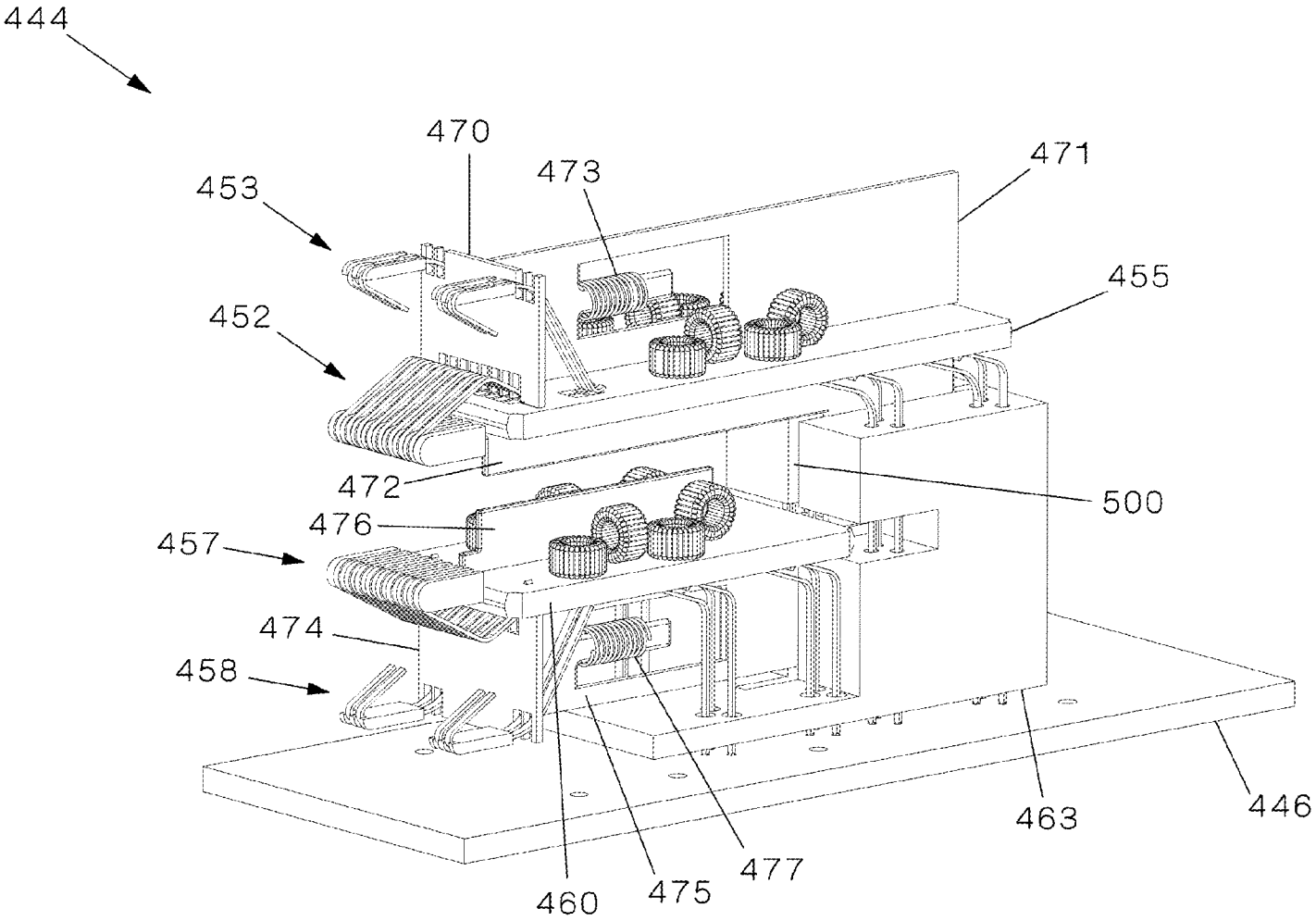
FIG. 37 illustrates some internal components of the jack of FIG. 36.

FIG. 37 illustrates the internal components of the jack 444 in greater detail. As noted previously, the jack 444 can be mated either with an RJ45 or an ARJ45 plug. This multi-plug compatibility is achieved by way of having switchable PCBs 455 and 460.

The switching mechanism for the first PCB 455 includes a switching plate 470, a first vertical divider 471, a second vertical divider 472, and a spring 473. The spring 473 is positioned between an internal housing wall (not shown) and a part of the first vertical divider 471 such that the PCB 455 is biased in a forward position unless an ARJ45 plug is inserted into the aperture $445_1$. The switching mechanism for the second PCB 460 includes a switching plate 474, a first vertical divider 475, a second vertical divider 476, and a spring 477. The spring 477 is positioned between an internal housing wall (not shown) and a part of the first vertical divider 475 such that the PCB 460 is biased in a forward position unless an ARJ45 plug is inserted into the aperture $445_2$. The vertical dividers 471,472,476,477 are positioned within appropriate guide paths, such as guide path 500 provided within the connector pin assembly 463 and other potential guide paths within the jack housing(s) (not shown). As a result, the vertical dividers help guide the PCBs 455,460 between their possible positions and may provide electromagnetic shielding between internal jack components. This can help reduce crosstalk between respective signal pairs, and improve the jack's performance and/or its tenability.

As noted, the PCBs 455,460 remain in their forward-biased position when the jack is not mated to any plugs. The switching plates 470,474 are positioned sufficiently far back within the jack 444 such that when an RJ45 plug is mated therewith, the plug does not interfere with the switching plates 470,474, and the PCBs 455,460 remain in their forward-biased position. This results in the distal ends of the lower PICs 452,457 and upper PICs 453,458 interfacing with a first set of contact pads on the PCBs 455,460. However, when an ARJ45 plug is mated with the jack, the longer nose of the ARJ45 plug pushes on the switching plates 470,474 towards the rear of the jack, causing the PCBs 455,460 to also move into their second, rearward position, respectively. When then PCBs 455,460 switch into the second position, the distal ends of the lower PICs 452,457 and upper PICs 453,458 lose contact with the first set of contact pads and come into contact with a second set of contact pads on the PCBs 455,460. In addition to switching between the first and second sets of contact pads which interface the PICs, moving the PCBs 455,460 between the available positions causes the connector pins to also interface two separate sets of contact pads.

Implementing switchable PCBs as described above can allow for separation of circuits for respective plugs. For example, when an RJ45 plug is mated with aperture $\mathbf{445}_1$, a first circuit on the PCB 455 may be used to transmit electrical signals between the PICs and the connector pins. This first circuit may include any desired circuitry, including, but not limited to, compensation circuitry typically found in RJ45 jacks (e.g., CAT6a jacks) and/or magnetics modules (e.g., transformers, inductors, or the like). However, when an ARJ45 plug is mated with aperture $\mathbf{445}_1$, the PCB's 455 movement causes a second circuit (that is different from the first circuit) to be positioned between the PICs and the connector pins. This second circuit could also have any desired circuitry components thereon, where such components can be utilized by the telecommunication taking place over the ARJ45 plug. The components on the second circuit can include, but are not limited to, compensation circuitry, magnetics components, current isolation components, and/or current biasing components. Note that the two primary circuits which handle RJ45 and ARJ45 communication can be separate and independent of each other. The same examples are equally applicable to aperture $\mathbf{445}_2$ and the corresponding internal components.

Figure 38A:
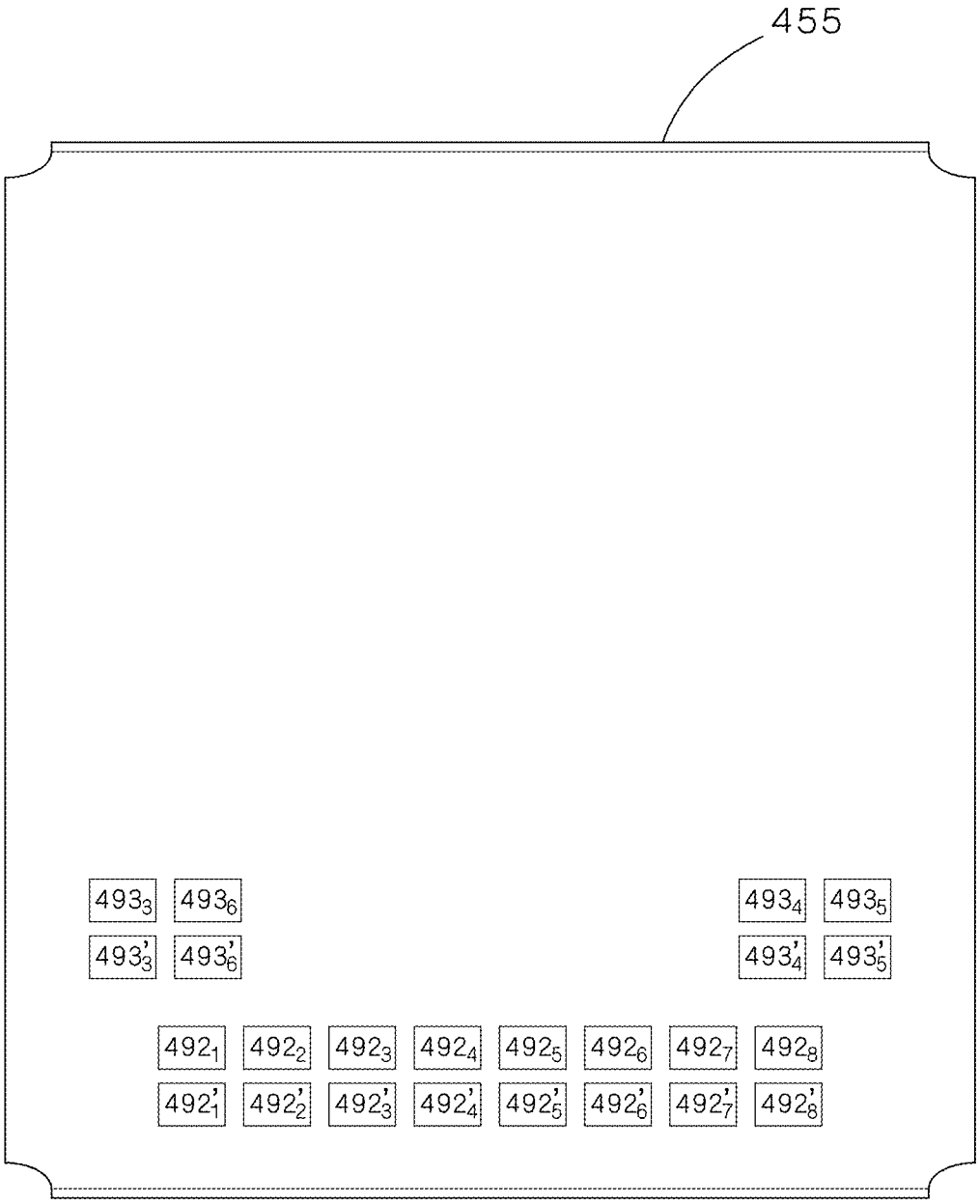
FIG. 38A illustrates a first side of a first PCB of the jack of FIG. 36.
Figure 38B:
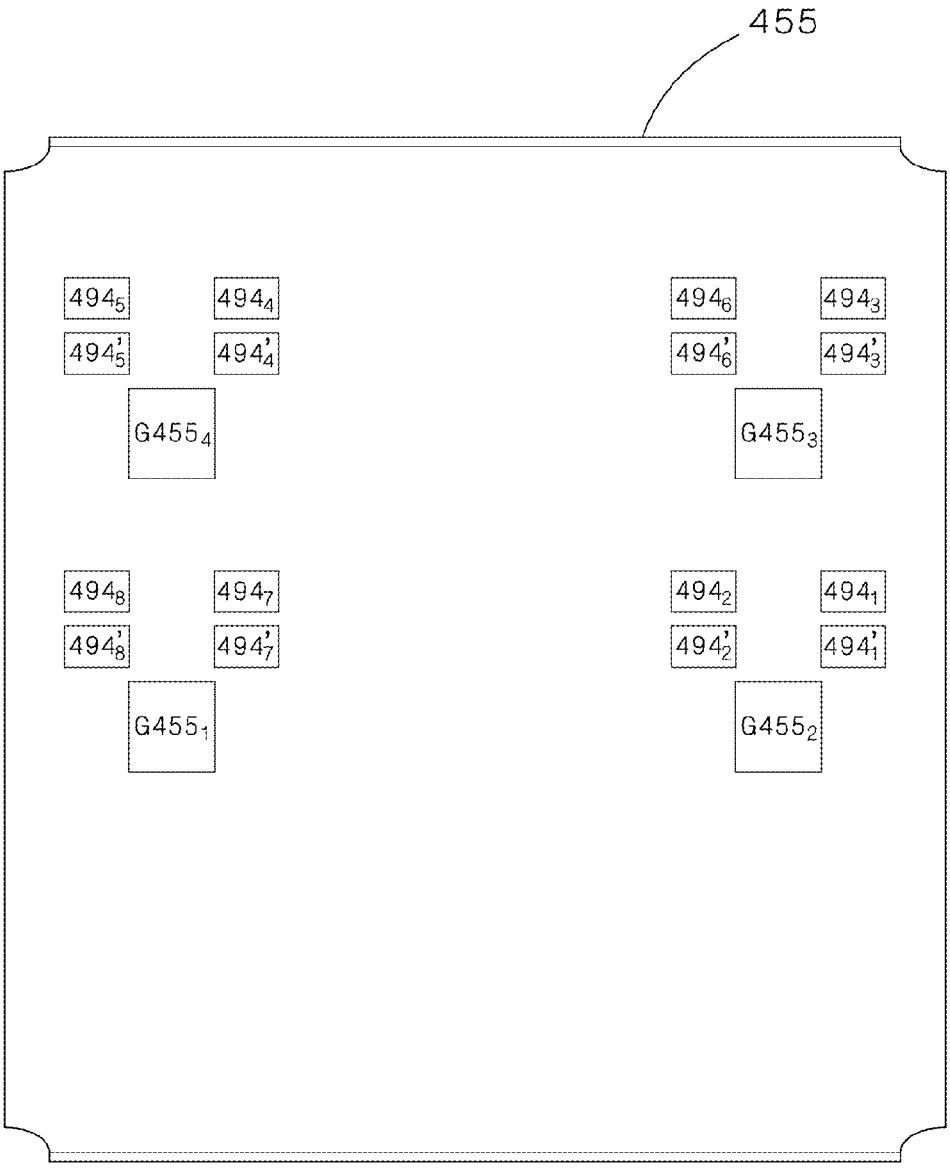
FIG. 38B illustrates a second side of a first PCB of the jack of FIG. 36.

Due to the vertical stacking of the apertures 445 and the respective internal components, there is a need to stagger the connector pins of each respective PCB so that said connector pins can interface to the equipment PCB 446. This can be achieved by implementing different PCB layouts. One example of the first PCB 455 is shown in FIGS. 38A (first side) and 38B (second side). The first side of the PCB 455 includes a first set of PIC contact pads $\mathbf{492}_{1\text{-}8}$,$\mathbf{493}_{3\text{-}6}$ and a second set of PIC contacts pads $\mathbf{492'}_{1\text{-}8}$,$\mathbf{493'}_{3\text{-}6}$. The second side of the PCB 455 includes a first set of connector pin contact pads $\mathbf{494}_{1\text{-}8}$ and a second set of connector pin contact pads $\mathbf{494'}_{1\text{-}8}$. As noted previously, the PCB 455 includes two separate circuits. The first circuit includes the PIC contact pads $\mathbf{492}_{1\text{-}8}$ and the connector pin contact pads $\mathbf{494}_{1\text{-}8}$, which are linked together, respectively, via first circuit elements (e.g., traces on the PCB 455). The second circuit includes PIC contact pads $\mathbf{492'}_{1\text{-}2}$, $\mathbf{493'}_{3\text{-}6}$, and $\mathbf{492'}_{7\text{-}8}$, and the connector pin contact pads $\mathbf{494'}_{1\text{-}8}$, which are linked together, respectively, via the second circuit elements (e.g., traces on the PCB 455). In addition, grounding pads $\mathrm{G}\mathbf{455}_{1\text{-}4}$ are also provided on the second side of the PCB 455.

When an RJ45 plug is mated with aperture $\mathbf{445}_1$, the distal ends of the PICs contact the first set of PIC contact pads $\mathbf{492}_{1\text{-}8}$,$\mathbf{493}_{3\text{-}6}$ and the distal ends of the potentially data-carrying connector pins $\mathbf{456}_{DATA}$ contact the first set of connector pin contact pads $\mathbf{494}_{1\text{-}8}$. While the upper PICs 453 are grounded via the contact pads $\mathbf{493}_{3\text{-}6}$, the lower PICs 452 act as conduits for signals traveling between the plug contacts and the contact pads $\mathbf{492}_{1\text{-}8}$. Since the contact pads $\mathbf{492}_{1\text{-}8}$ are connected to the first circuit, which is in turn connected to the connector pin contact pads $\mathbf{494}_{1\text{-}8}$, signals can travel between the plug 46 and equipment PCB 446 via the connector pins $\mathbf{456}_{DATA}$ and the first circuit on the PCB 455. Grounding the unused upper PICs 453 in the RJ45 mode of operation may help improve the electrical performance of the jack.

When an ARJ45 plug is mated with aperture $\mathbf{445}_1$, the distal ends of the PICs contact the second set of PIC contact pads $\mathbf{492'}_{1\text{-}8}$,$\mathbf{493'}_{3\text{-}6}$ and the distal ends of the potentially data-carrying connector pins $\mathbf{456}_{DATA}$ contact the second set of connector pin contact pads $\mathbf{494'}_{1\text{-}8}$. In this mode of operation, the PICs which interface with contact pads $\mathbf{492'}_{1\text{-}2}$, $\mathbf{493'}_{3\text{-}6}$, and $\mathbf{492'}_{7\text{-}8}$ act as conduits for signals traveling between the plug contacts and the PCB 455. Since the contact pads $\mathbf{492'}_{1\text{-}2}$, $\mathbf{493'}_{3\text{-}6}$, and $\mathbf{492'}_{7\text{-}8}$ are connected to the second circuit, which is in turn connected to the connector pin contact pads $\mathbf{494'}_{1\text{-}8}$, signals can travel between the plug 90 and equipment PCB 446 via the connector pins $\mathbf{456}_{DATA}$ and the second circuit on the PCB 455. To improve the jack's performance, the unused PICs can be grounding via PIC contact pads $\mathbf{492'}_{3\text{-}6}$.

To further improve the jack's electrical performance (e.g., return loss, insertion loss, electrical balance, and/or other electrical performance characteristics), connector pins $\mathbf{456}_G$ can be positioned within certain proximity to the potentially data-carrying connector pins $\mathbf{456}_{DATA}$, and grounded via contact pads $\mathrm{G}\mathbf{455}_{1\text{-}4}$. Connector pins $\mathbf{456}_G$ remain in contact with contact pads $\mathrm{G}\mathbf{455}_{1\text{-}4}$ regardless of the mode of operation.

Figure 39:
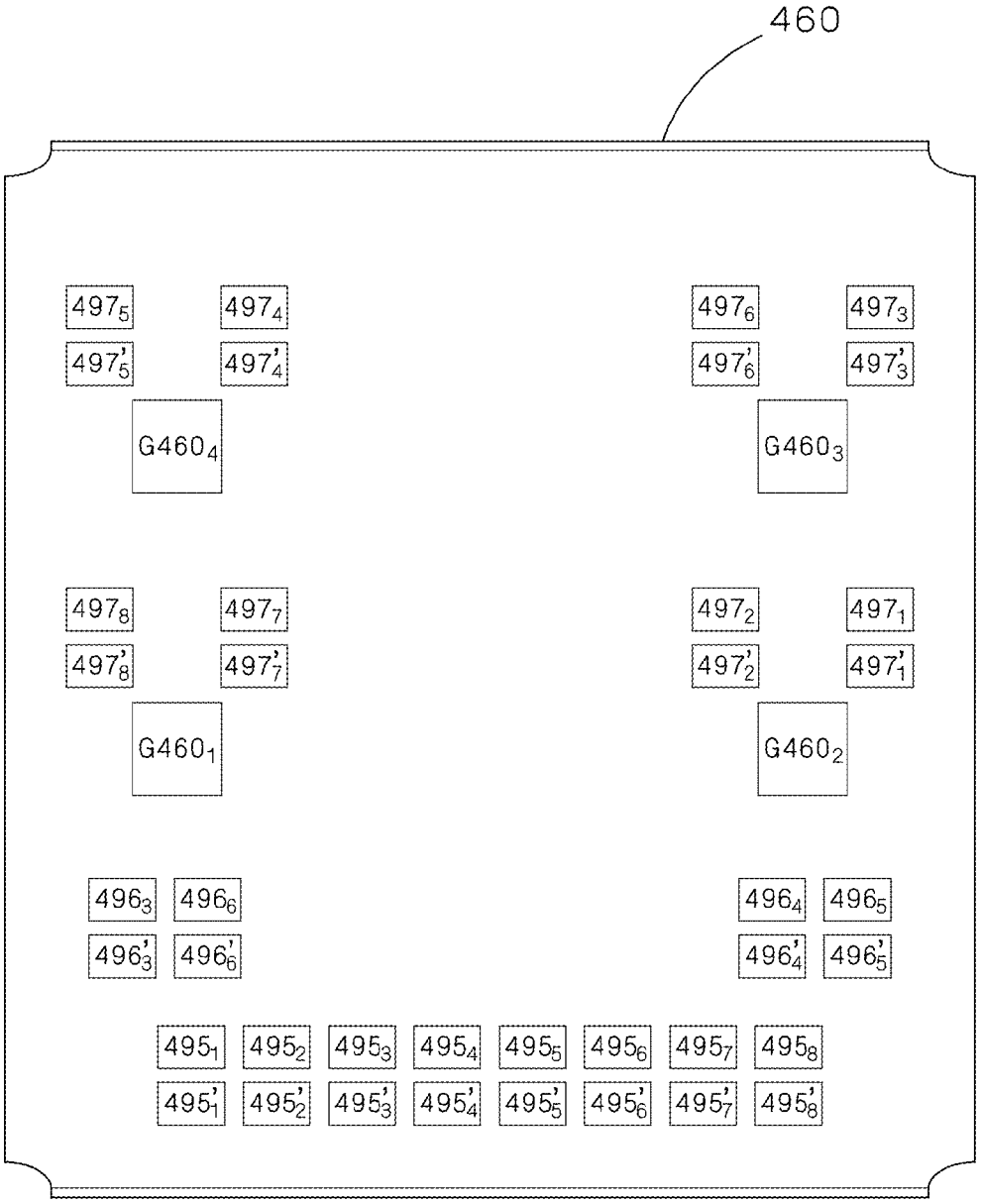
FIG. 39 illustrates a first side of a second PCB of the jack of FIG. 36.

While the first PCB 455 includes contact pads on both sides thereof, the second PCB 460 has contact pads situated only on a single side. This layout is shown in FIG. 39. As shown therein, the PCB 460 includes a first set of PIC contact pads $\mathbf{495}_{1\text{-}8}$,$\mathbf{496}_{3\text{-}6}$, and a second set of PIC contacts pads $\mathbf{495'}_{1\text{-}8}$, $\mathbf{496'}_{3\text{-}6}$. The PCB 460 further includes a first set of connector pin contact pads $\mathbf{497}_{1\text{-}8}$ and a second set of connector pin contact pads $\mathbf{497'}_{1\text{-}8}$. Like PCB 455, PCB 460 includes two separate circuits.

The first circuit includes the PIC contact pads $\mathbf{495}_{1\text{-}8}$ and the connector pin contact pads $\mathbf{497}_{1\text{-}8}$, which are linked together, respectively, via first circuit elements (e.g., traces on the PCB 460). The second circuit includes PIC contact pads $\mathbf{495'}_{1\text{-}2}$, $\mathbf{496'}_{3\text{-}6}$, and $\mathbf{495'}_{7\text{-}8}$, and the connector pin contact pads $\mathbf{497'}_{1\text{-}8}$, which are linked together, respectively, via the second circuit elements (e.g., traces on the PCB 460). In addition, the PCB 460 includes grounding pads $\mathrm{G}\mathbf{460}_{1\text{-}4}$.

When an RJ45 plug is mated with aperture $\mathbf{445}_2$, the distal ends of the PICs contact the first set of PIC contact pads $\mathbf{495}_{1\text{-}8}$,$\mathbf{496}_{3\text{-}6}$ and the distal ends of the potentially data-carrying connector pins $\mathbf{461}_{DATA}$ contact the first set of connector pin contact pads $\mathbf{497}_{1\text{-}8}$. While the upper PICs 458 are grounded via the contact pads $\mathbf{496}_{3\text{-}6}$, the lower PICs 457 act as conduits for signals traveling between the plug contacts and the contact pads $\mathbf{495}_{1\text{-}8}$. Since the contact pads $\mathbf{495}_{1\text{-}8}$ are connected to the first circuit, which is in turn connected to the connector pin contact pads $\mathbf{497}_{1\text{-}8}$, signals can travel between the plug 46 and equipment PCB 446 via the connector pins $461_{DATA}$ and the first circuit on the PCB 460. Grounding the unused upper PICs 458 in the RJ45 mode of operation may help improve the electrical performance of the jack.

When an ARJ45 plug is mated with aperture $445_2$, the distal ends of the PICs contact the second set of PIC contact pads $495'_{1-8}$,$496'_{3-6}$ and the distal ends of the potentially data-carrying connector pins $461_{DATA}$ contact the second set of connector pin contact pads $497'_{1-8}$. In this mode of operation, the PICs which interface with contact pads $495'_{1-2}$, $496'_{3-6}$, and $495'_{7-8}$ act as conduits for signals traveling between the plug contacts and the PCB 460. Since the contact pads $495'_{1-2}$, $496'_{3-6}$, and $495'_{7-8}$ are connected to the second circuit, which is in turn connected to the connector pin contact pads $497'_{1-8}$, signals can travel between the plug 90 and equipment PCB 446 via the connector pins $461_{DATA}$ and the second circuit on the PCB 460. To improve the jack's performance, the unused PICs can be grounding via PIC contact pads $495'_{3-6}$.

To further improve the jack's electrical performance (e.g., return loss, insertion loss, electrical balance, and/or other electrical performance characteristics), connector pins $461_G$ can be positioned within certain proximity to the potentially data-carrying connector pins $461_{DATA}$, and grounded via contact pads $G460_{1-4}$. Connector pins $461_G$ remain in contact with contact pads $G460_{1-4}$ regardless of the mode of operation.

Note that in alternate embodiments the positioning of the PIC contact pads along with the respective PICs may vary. In other words, while the PIC contact pads on the PCB 455 are positioned on one side thereof, in alternate embodiments those PIC contact pads may be positioned on the opposite side. Consequently, the PICs will have to be adjusted to ensure appropriate mating. The positioning of the PIC contact pads on the PCB 460 may also be altered in a similar manner.

Additionally, PCB 455 and/or 460 can include optional mode indicator contact pads which can interface mode indicator connector pins. These contact pads may be configured to contact the mode indicator connector pins in a particular mode of operation, thereby signaling to the equipment that the jack (or a part thereof) is operating in a particular mode. For example, if the mode indicator contact pads come in contact with the mode indicator connector pins in the RJ45 operating mode but not in the ARJ45 operating mode, this electrical connection can be used as a mode-of-operation signal.

In additional embodiments, the jack can include additional lower PICs which can be grounded to help improve the jack's electrical performance even further. For example, lower PICs 452 may include one additional PIC on each side of said set of PICs where the additional PICs interface with additional grounded contact pads on the PCB 455 regardless of operation. This can help provide a balanced configuration of ground conductors and signal conductors (Ground-Signal-Signal-Ground) in an ARJ45 operating mode, and this balanced transmission line configuration may become increasingly advantageous relative to signal integrity as the bandwidth increases. The same configuration may be implemented on the lower PICs 457 and the second PCB 460.

Furthermore, PICs 452,453,457,458 and connector pins 456,461 are preferably designed to be or resilient nature, causing the distal ends thereof to springingly press against the contact pads on the PCBs 455,460. To help ensure a smooth transition between the contact pads, the distal ends of the PICs 452,453,457,458 and connector pins 456,461 are provided with curved feet which may act as ramps. This design may help ensure a constant force on the contact pads and it may also help ensure that in the process of sliding on and off the contact pads, contaminants or oxidation that may be present on the surface of the contact pads will be wiped away; thereby, providing a robust connection between the PICs and the connector pins.

Figure 40:
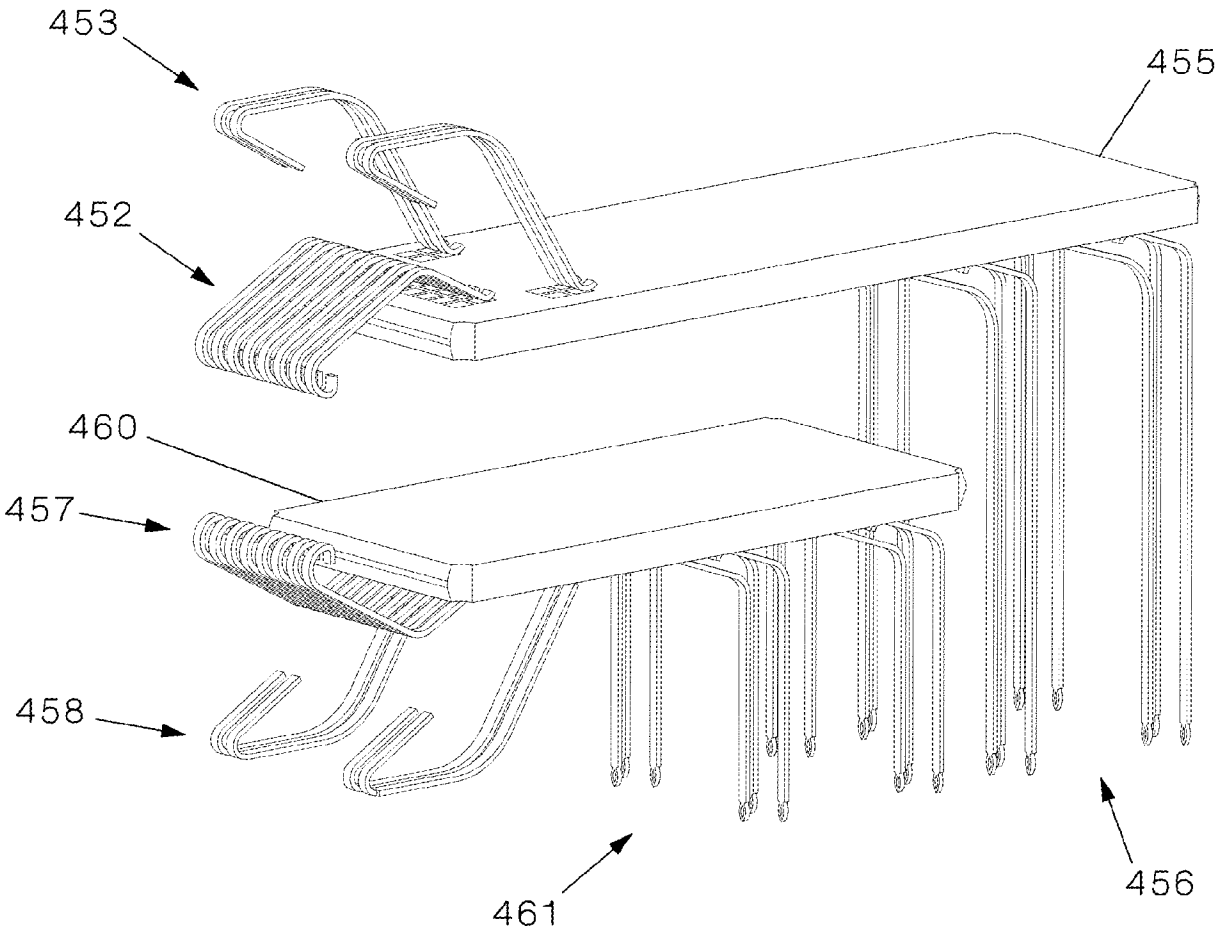
FIG. 40 illustrates an isometric view of the two PCBs, PICs, and connector pins of the jack of FIG. 36.
Figure 41:
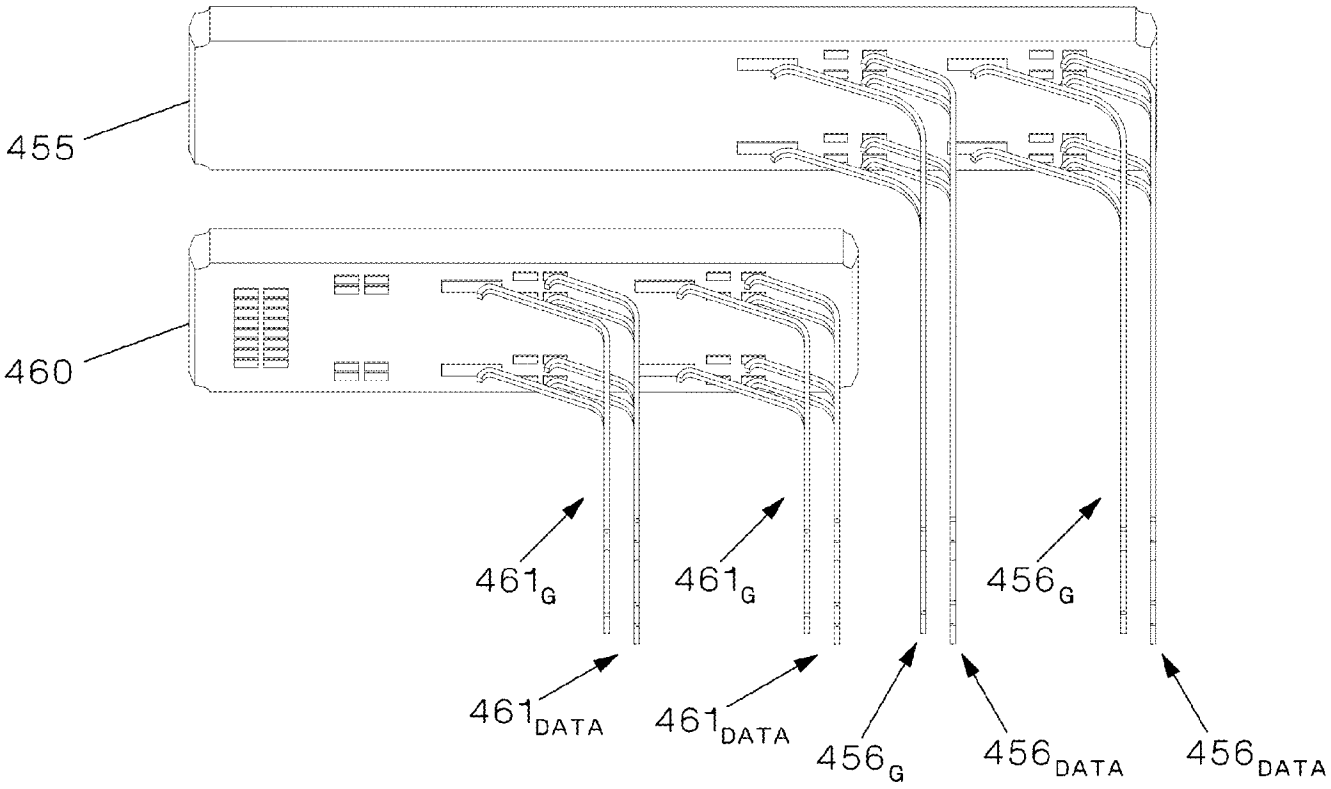
FIG. 41 illustrates a bottom-side view of the interaction of the connector pins with the PCBs within the jack of FIG. 36.

In order to stager the connector pins 456 and 461 so that they do not interfere with each other, the first PCB 455 is longer than the second PCB 460. This configuration allows the connector pin contact pads 494 of the PCB 455 to be positioned further back within the jack 444 relative to the connector pin contact pads 497 of the PCB 460. This provides the space necessary to position the respective connector pins for both PCBs. The relative placement of the connector pin contact pads and the connect pins is shown in FIGS. 40 and 41.

To help reduce the potential crosstalk between connector pins 456 or between the connector pins 456 and connector pins 461, said connector pins are mounted within the connector pin assembly 463. The connector pin assembly 463 may provide an electromagnetic shield between the connector pins and may also act as a physical support for said pins. This can be especially helpful in case of the connector pins 456 which are longer than connector pins 461, and therefore more susceptible to deformation.

Note that while this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A communication jack capable of mating with either one of a first type of a communication plug and a second type of a communication plug, said first type and second type of a communication plug being different, said communication jack comprising:

a housing having a front portion, said front portion including an aperture for receiving said either one of said first type of a communication plug and said second type of a communication plug;

a first set of plug interface contacts (PICs) configured to interface said first type of a communication plug, and a second set of PICs configured to interface said second type of a communication plug;

jack contacts, said jack contacts being one of insulation displacement contacts (IDCs) or connector pin contacts; and a printed circuit board (PCB), said PCB being movable between a first position and a second position along a longitudinal plane relative to said communication jack, said first position providing a first current path from said first set of PICs to said jack contacts through said PCB, and said second position providing a second current path from said second set of PICs to said jack contacts through said PCB, said PCB being positioned at said first position when mated with said first type of a communication plug, and said PCB being positioned at said second position when mated with said second type of a communication plug.

2. The communication jack of claim 1, wherein said first set of PICs and said second set of PICs share at least some PICs.

3. The communication jack of claim 1, further comprising a switching plate positioned substantially perpendicular to said PCB, said switching plate being one of directly or indirectly secured to said PCB, wherein said mating with said second type of a communication plug causes said second type of a communication plug to exert force on said switching plate to move said PCB into said second position.

4. The communication jack of claim 1, wherein said PCB is springingly biased into said first position.

5. The communication jack of claim 4, further comprising:

a retention wall positioned internally relative to said housing;

a switching plate positioned substantially perpendicular to said PCB, said switching plate being one of directly or indirectly secured to said PCB;

a first divider being one of directly or indirectly secured to said PCB; and a spring positioned between said first divider and said retention wall, said spring biasing said PCB into said first position when said communication jack is mated with said first type of a communication plug.

6. The communication jack of claim 1, wherein at least one of said first set of PICs and said second set of PICs comprises grounding contacts.

7. The communication jack of claim 1, wherein said first set of PICs includes a first through eighth first-contacts arranged in a generally grouped array at least partially inside said aperture, and wherein said second set of PICs includes:

first and second second-contacts arranged in a first corner inside said aperture opposite of said generally grouped array of said first-contacts;

third and fourth second-contacts arranged in a second corner inside said aperture opposite of said generally grouped array of said first-contacts; and fifth through eighth second-contacts selected from some of said first-contacts.

8. The communication jack of claim 7, wherein said first set of PICs further includes a zeroth grounded contact positioned on one side of said generally grouped array of said first-contacts and a ninth grounded contact positioned on another side of said generally grouped array of said first-contacts, and wherein said third and sixth first-contacts are grounded when said PCB is positioned in said second position.

9. The communication jack of claim 1, wherein said first type of a communication plug is an RJ45 communication plug and said second type of a communication plug is an IEC 60603-7-71 communication plug.

10. A communication jack capable of mating with either one of a first type of a communication plug and a second type of a communication plug, said first type and second type of a communication plug being different, said communication jack comprising:

a housing having a front portion, said front portion including an aperture for receiving said either one of said first type of a communication plug and said second type of a communication plug;

a first set of plug interface contacts (PICs) configured to interface said first type of a communication plug, and a second set of PICs configured to interface said second type of a communication plug;

insulation displacement contacts (IDCs); and a printed circuit board (PCB) having first side and a second side, some of said IDCs interfacing said PCB on said first side and some of said IDCs interfacing said PCB on said second side, said PCB being movable between a first position and a second position, said first position providing a first electrical path from said first set of PICs to said IDCs, and said second position providing a second electrical path from said second set of PICs to said IDCs.

11. The communication jack of claim 10, wherein said PCB is movable along a longitudinal plane relative to said communication jack.

12. The communication jack of claim 10, wherein said first set of PICs and said second set of PICs share at least some PICs.

13. The communication jack of claim 10, wherein said PCB is positioned at said first position when mated with said first type of a communication plug, and said PCB is positioned at said second position when mated with said second type of a communication plug.

14. The communication jack of claim 13, further comprising a switching plate positioned substantially perpendicular to said PCB, said switching plate being one of directly or indirectly secured to said PCB, wherein said mating with said second type of a communication plug causes said second type of a communication plug to exert force on said switching plate to move said PCB into said second position.

15. The communication jack of claim 10, wherein said PCB is springingly biased into said first position.

16. The communication jack of claim 15, further comprising:

a retention wall positioned internally relative to said housing;

a switching plate positioned substantially perpendicular to said PCB, said switching plate being one of directly or indirectly secured to said PCB;

a first divider being one of directly or indirectly secured to said PCB; and a spring positioned between said first divider and said retention wall, said spring biasing said PCB into said first position when said communication jack is mated with said first type of a communication plug.

17. The communication jack of claim 10, wherein at least one of said first set of PICs and said second set of PICs comprises grounding contacts.

18. The communication jack of claim 10, wherein said first set of PICs includes a first through eighth first-contacts arranged in a generally grouped array at least partially inside said aperture, and wherein said second set of PICs includes:

first and second second-contacts arranged in a first corner inside said aperture opposite of said generally grouped array of said first-contacts;

third and fourth second-contacts arranged in a second corner inside said aperture opposite of said generally grouped array of said first-contacts; and fifth through eighth second-contacts selected from some of said first-contacts.

19. The communication jack of claim 18, wherein said first set of PICs further includes a zeroth grounded contact positioned on one side of said generally grouped array of said first-contacts and a ninth grounded contact positioned on another side of said generally grouped array of said first-contacts, and wherein said third and sixth first-contacts are grounded when said PCB is positioned in said second position.

20. The communication jack of claim 11, further comprising a wire manager assembly, said wire manager assembly including a wire manager and IDC inserts positioned inside said wire manager, said IDC inserts providing troughs for conductors of a communication cable and slots for receiving said IDCs, wherein said IDCs terminate to said conductors of a communication cable.

21. The communication jack of claim 10, wherein said first type of a communication plug is an RJ45 communication plug and said second type of a communication plug is an IEC 60603-7-71 communication plug.

22. A communication system comprising:

an electronic equipment; and a communication jack connected to said electronic equipment, said communication jack capable of mating with either one of a first type of a communication plug and a second type of a communication plug, said first type and second type of a communication plug being different, said communication jack comprising:

a housing having a front portion, said front portion including an aperture for receiving said either one of said first type of a communication plug and said second type of a communication plug;

a first set of plug interface contacts (PICs) configured to interface said first type of a communication plug, and a second set of PICs configured to interface said second type of a communication plug;

jack contacts, said jack contacts being one of insulation displacement contacts (IDCs) or connector pin contacts; and a printed circuit board (PCB), said PCB being movable between a first position and a second position along a longitudinal plane relative to said communication jack, said first position providing a first current path from said first set of PICs to said jack contacts through said PCB, and said second position providing a second current path from said second set of PICs to said jack contacts through said PCB, said PCB being positioned at said first position when mated with said first type of a communication plug, and said PCB being positioned at said second position when mated with said second type of a communication plug.

* * * * *